US011578549B2

(12) United States Patent
Eitschberger et al.

(10) Patent No.: US 11,578,549 B2
(45) Date of Patent: Feb. 14, 2023

(54) SINGLE USE SETTING TOOL FOR ACTUATING A TOOL IN A WELLBORE

(71) Applicant: DynaEnergetics Europe GmbH, Troisdorf (DE)

(72) Inventors: Christian Eitschberger, Munich (DE); Dimitri Riesen, Troisdorf (DE); Thilo Scharf, Letterkenny (IE); Arash Shahinpour, Troisdorf (DE); Robert J Staats, Meridian, TX (US); Joern Olaf Loehken, Troisdorf (DE); Denis Will, Troisdorf (DE); Liam McNelis, Bonn (DE); Jason Schroeder, Richmond, TX (US)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 17/381,701

(22) Filed: Jul. 21, 2021

(65) Prior Publication Data

US 2021/0355773 A1 Nov. 18, 2021

Related U.S. Application Data

(63) Continuation-in-part of application No. 16/924,504, filed on Jul. 9, 2020, now Pat. No. 11,255,147, which (Continued)

(51) Int. Cl.

| | |
|---|---|
| ***E21B 23/04*** | (2006.01) |
| ***E21B 23/00*** | (2006.01) |
| ***E21B 41/00*** | (2006.01) |

(52) U.S. Cl.

CPC ..... *E21B 23/00* (2013.01); *E21B 41/0085* (2013.01)

(58) Field of Classification Search

CPC .... E21B 23/00; E21B 23/0417; E21B 23/042; E21B 23/0411; E21B 41/0085; E21B 43/116; E21B 43/1185; E21B 23/04

See application file for complete search history.

(56) References Cited

U.S. PATENT DOCUMENTS 2,142,572 A 1/1939 Metzner
2,216,359 A 10/1940 Spencer
(Continued)

FOREIGN PATENT DOCUMENTS

CA 2021396 A1 1/1991
CA 2271620 A1 11/2000
(Continued)

OTHER PUBLICATIONS

Baker Hughes, E-4 Wireline Pressure Setting Assembly and BHGE C Firing Heads, Mar. 8, 2018, 16 pages.
(Continued)

*Primary Examiner* — Taras P Bemko
(74) *Attorney, Agent, or Firm* — Moyles IP, LLC

(57) ABSTRACT

A single use setting tool and associated method for actuating a tool in a wellbore may include an inner piston having a piston proximal end, a piston distal end, and a piston annular wall that defines a piston cavity. The setting tool may include a gas-generating power charge positioned within the piston cavity. The power charge may extend along a longitudinal axis from a proximal end to a distal end and have at least two different widths along its length. The power charge may further include a tapered portion. The setting tool may further include a piston extension connected to the piston distal end. The inner piston may further include a shear element groove circumferentially extending in an outer surface of the inner piston, for receiving a shear element.

20 Claims, 35 Drawing Sheets

Related U.S. Application Data is a continuation-in-part of application No. 16/858,041, filed on Apr. 24, 2020, now Pat. No. 10,927,627.

(60) Provisional application No. 62/908,747, filed on Oct. 1, 2019, provisional application No. 62/862,867, filed on Jun. 18, 2019, provisional application No. 62/847,488, filed on May 14, 2019.

(56) References Cited

U.S. PATENT DOCUMENTS

| | | | |
|---|---|---|---|
| 2,252,270 | A | 8/1941 | Miller |
| 2,308,004 | A | 1/1943 | Hart |
| 2,358,466 | A | 9/1944 | Miller |
| 2,418,486 | A | 4/1947 | Smylie |
| 2,462,784 | A | 2/1949 | Smith |
| 2,618,343 | A | 11/1952 | Conrad |
| 2,640,547 | A | 6/1953 | Baker et al. |
| 2,644,530 | A | 7/1953 | Baker |
| 2,681,114 | A | 6/1954 | Conrad |
| 2,692,023 | A | 10/1954 | Conrad |
| 2,695,064 | A | 11/1954 | Ragan et al. |
| 2,696,259 | A | 12/1954 | Greene |
| 2,713,910 | A | 7/1955 | Baker et al. |
| 2,765,739 | A | 10/1956 | Mohaupt et al. |
| 2,769,701 | A | 11/1956 | Frederick |
| 2,799,343 | A | 7/1957 | Conrad |
| 2,807,325 | A | 9/1957 | Webb |
| 2,815,816 | A | 12/1957 | Baker |
| 2,889,775 | A | 6/1959 | Owen |
| 2,979,904 | A | 4/1961 | Royer |
| 3,024,843 | A | 3/1962 | Dean |
| 3,026,939 | A | 3/1962 | Sweetman |
| 3,031,964 | A | 5/1962 | Chesnut |
| 3,036,636 | A | 5/1962 | Clark |
| 3,055,430 | A | 9/1962 | Campbell |
| 3,076,507 | A | 2/1963 | Sweetman |
| 3,094,166 | A | 6/1963 | Mccullough |
| 3,140,537 | A | 7/1964 | Popoff |
| 3,160,209 | A | 12/1964 | Bonner |
| 3,170,400 | A | 2/1965 | Nelson |
| 3,173,992 | A | 3/1965 | Boop |
| 3,186,485 | A | 6/1965 | Owen |
| RE25,846 | E | 8/1965 | Campbell |
| 3,211,222 | A | 10/1965 | Myers |
| 3,220,480 | A | 11/1965 | Myers |
| 3,233,674 | A | 2/1966 | Kurt |
| 3,244,232 | A | 4/1966 | Myers |
| 3,246,707 | A | 4/1966 | Bell |
| 3,264,994 | A | 8/1966 | Kurt |
| 3,266,575 | A | 8/1966 | Owen |
| 3,298,437 | A | 1/1967 | Conrad |
| 3,303,884 | A | 2/1967 | Medford |
| 3,361,204 | A | 1/1968 | Howard et al. |
| 3,366,179 | A | 1/1968 | Kinley et al. |
| 3,374,735 | A | 3/1968 | Moore |
| 3,398,803 | A | 8/1968 | Kurt et al. |
| 3,498,376 | A | 3/1970 | Sizer et al. |
| 3,504,723 | A | 4/1970 | Cushman et al. |
| 3,630,284 | A | 12/1971 | Fast et al. |
| 3,669,190 | A | 6/1972 | Sizer et al. |
| 3,691,954 | A | 9/1972 | Kern |
| 3,712,376 | A | 1/1973 | Young et al. |
| 3,762,470 | A | 10/1973 | Eggleston |
| 3,859,921 | A | 1/1975 | Stephenson |
| 4,003,433 | A | 1/1977 | Goins |
| 4,007,790 | A | 2/1977 | Henning |
| 4,007,796 | A | 2/1977 | Boop |
| 4,058,061 | A | 11/1977 | Mansur, Jr. et al. |
| 4,064,935 | A | 12/1977 | Mohaupt |
| 4,140,188 | A | 2/1979 | Vann |
| 4,172,421 | A | 10/1979 | Regalbuto |
| 4,182,216 | A | 1/1980 | DeCaro |
| 4,250,960 | A | 2/1981 | Chammas |
| 4,266,613 | A | 5/1981 | Boop |
| 4,269,120 | A | 5/1981 | Brede et al. |
| 4,290,486 | A | 9/1981 | Regalbuto |
| 4,317,413 | A | 3/1982 | Strandli et al. |
| 4,429,741 | A | 2/1984 | Hyland |
| 4,457,383 | A | 7/1984 | Boop |
| 4,485,741 | A | 12/1984 | Moore et al. |
| 4,491,185 | A | 1/1985 | McClure |
| 4,496,008 | A | 1/1985 | Pottier et al. |
| 4,512,418 | A | 4/1985 | Regalbuto et al. |
| 4,523,650 | A | 6/1985 | Sehnert et al. |
| 4,530,396 | A | 7/1985 | Mohaupt |
| 4,535,842 | A | 8/1985 | Ross |
| 4,566,544 | A | 1/1986 | Bagley et al. |
| 4,574,892 | A | 3/1986 | Grigar et al. |
| 4,598,775 | A | 7/1986 | Vann et al. |
| 4,605,074 | A | 8/1986 | Barfield |
| 4,609,056 | A | 9/1986 | Colle, Jr. et al. |
| 4,617,997 | A | 10/1986 | Jennings, Jr. |
| 4,619,318 | A | 10/1986 | Ferrell et al. |
| 4,620,591 | A | 11/1986 | Ferrell et al. |
| 4,621,396 | A | 11/1986 | Walker et al. |
| 4,637,478 | A | 1/1987 | George |
| 4,657,089 | A | 4/1987 | Stout |
| 4,660,910 | A | 4/1987 | Sharp et al. |
| 4,662,450 | A | 5/1987 | Haugen |
| 4,747,201 | A | 5/1988 | Donovan et al. |
| 4,753,170 | A | 6/1988 | Regalbuto et al. |
| 4,754,812 | A | 7/1988 | Gentry |
| 4,756,363 | A | 7/1988 | Lanmon et al. |
| 4,776,393 | A | 10/1988 | Forehand et al. |
| 4,790,383 | A | 12/1988 | Savage et al. |
| 4,798,244 | A | 1/1989 | Trost |
| 4,800,815 | A | 1/1989 | Appledorn et al. |
| 4,830,120 | A | 5/1989 | Stout |
| 4,840,231 | A | 6/1989 | Berzin et al. |
| 4,852,647 | A | 8/1989 | Mohaupt |
| 4,869,325 | A | 9/1989 | Halbardier |
| 4,889,183 | A | 12/1989 | Sommers et al. |
| 5,024,270 | A | 6/1991 | Bostick |
| 5,027,708 | A | 7/1991 | Gonzalez et al. |
| 5,042,594 | A | 8/1991 | Gonzalez et al. |
| 5,046,567 | A | 9/1991 | Aitken et al. |
| 5,052,489 | A | 10/1991 | Carisella et al. |
| 5,060,573 | A | 10/1991 | Montgomery et al. |
| 5,088,413 | A | 2/1992 | Huber |
| 5,105,742 | A | 4/1992 | Sumner |
| 5,155,293 | A | 10/1992 | Barton |
| 5,159,145 | A | 10/1992 | Carisella et al. |
| 5,211,224 | A | 5/1993 | Bouldin |
| 5,303,772 | A | 4/1994 | George et al. |
| 5,316,087 | A | 5/1994 | Manke et al. |
| 5,322,019 | A | 6/1994 | Hyland |
| 5,346,014 | A | 9/1994 | Ross |
| 5,347,929 | A | 9/1994 | Lerche et al. |
| 5,379,845 | A | 1/1995 | Blount et al. |
| 5,392,860 | A | 2/1995 | Ross |
| 5,396,951 | A | 3/1995 | Ross |
| 5,398,760 | A | 3/1995 | George et al. |
| 5,436,791 | A | 7/1995 | Furano et al. |
| 5,447,202 | A | 9/1995 | Littleford |
| 5,456,319 | A | 10/1995 | Schmidt et al. |
| 5,509,480 | A | 4/1996 | Terrell et al. |
| 5,511,620 | A | 4/1996 | Baugh et al. |
| 5,575,331 | A | 11/1996 | Terrell |
| 5,603,384 | A | 2/1997 | Bethel et al. |
| 5,703,319 | A | 12/1997 | Fritz et al. |
| 5,732,869 | A | 3/1998 | Hirtl |
| 5,775,426 | A | 7/1998 | Snider et al. |
| 5,816,343 | A | 10/1998 | Markel et al. |
| 5,831,204 | A | 11/1998 | Lubben et al. |
| 5,871,052 | A | 2/1999 | Benson et al. |
| 5,984,006 | A | 11/1999 | Read et al. |
| 5,992,289 | A | 11/1999 | George et al. |
| 6,006,833 | A | 12/1999 | Burleson et al. |
| 6,012,525 | A | 1/2000 | Burleson et al. |
| 6,082,450 | A | 7/2000 | Snider et al. |
| 6,085,659 | A | 7/2000 | Beukes et al. |
| 6,102,120 | A | 8/2000 | Chen et al. |
| 6,112,666 | A | 9/2000 | Murray et al. |

(56) References Cited

U.S. PATENT DOCUMENTS 6,164,375 A 12/2000 Carisella
6,227,116 B1 5/2001 Dumenko
6,272,782 B1 8/2001 Dittrich et al.
6,298,915 B1 10/2001 George
6,305,287 B1 10/2001 Capers et al.
6,349,767 B2 2/2002 Gissler
6,354,374 B1 3/2002 Edwards et al.
6,385,031 B1 5/2002 Lerche et al.
6,412,415 B1 7/2002 Kothari et al.
6,414,905 B1 7/2002 Owens et al.
6,418,853 B1 7/2002 Duguet et al.
6,435,096 B1 8/2002 Watson
6,467,387 B1 10/2002 Espinosa et al.
6,502,736 B2 1/2003 Dittrich et al.
6,506,083 B1 1/2003 Bickford et al.
6,571,906 B2 6/2003 Jones et al.
6,582,251 B1 6/2003 Burke et al.
6,591,753 B1 7/2003 Schmid et al.
6,651,747 B2 11/2003 Chen et al.
6,679,327 B2 1/2004 Sloan et al.
6,702,009 B1 3/2004 Drury et al.
6,719,061 B2 4/2004 Muller et al.
6,739,265 B1 5/2004 Badger et al.
6,742,602 B2 6/2004 Trotechaud
6,752,083 B1 6/2004 Lerche et al.
6,763,883 B2 7/2004 Green et al.
6,817,298 B1 11/2004 Zharkov et al.
6,843,317 B2 1/2005 Mackenzie
6,880,637 B2 4/2005 Myers, Jr. et al.
7,017,672 B2 3/2006 Owen, Sr.
7,066,280 B2 6/2006 Sullivan et al.
7,073,589 B2 7/2006 Tiernan et al.
7,086,481 B2 8/2006 Hosie et al.
7,104,323 B2 9/2006 Cook et al.
7,107,908 B2 9/2006 Forman et al.
7,128,162 B2 10/2006 Quinn
7,193,527 B2 3/2007 Hall
7,228,906 B2 6/2007 Snider et al.
7,243,722 B2 7/2007 Oosterling et al.
7,246,548 B2 7/2007 Kash
7,278,482 B2 10/2007 Azar
7,278,491 B2 10/2007 Scott
7,347,278 B2 3/2008 Lerche et al.
7,364,451 B2 4/2008 Ring et al.
7,428,932 B1 9/2008 Wintill et al.
7,431,075 B2 10/2008 Brooks et al.
7,455,104 B2 11/2008 Duhon et al.
7,487,827 B2 2/2009 Tiernan
7,493,945 B2 2/2009 Doane et al.
7,510,017 B2 3/2009 Howell et al.
7,533,722 B2 5/2009 George et al.
7,568,429 B2 8/2009 Hummel et al.
7,574,960 B1 8/2009 Dockery et al.
7,604,062 B2 10/2009 Murray
7,661,474 B2 2/2010 Campbell et al.
7,721,650 B2 5/2010 Barton et al.
7,748,457 B2 7/2010 Walton et al.
7,762,172 B2 7/2010 Li et al.
7,762,331 B2 7/2010 Goodman et al.
7,762,351 B2 7/2010 Vidal
7,778,006 B2 8/2010 Stewart et al.
7,779,926 B2 8/2010 Turley et al.
7,810,430 B2 10/2010 Chan et al.
7,823,508 B2 11/2010 Anderson et al.
7,896,077 B2 3/2011 Behrmann et al.
7,901,247 B2 3/2011 Ring
7,905,290 B2 3/2011 Schicks
7,908,970 B1 3/2011 Jakaboski et al.
7,929,270 B2 4/2011 Hummel et al.
7,980,874 B2 7/2011 Finke et al.
8,066,083 B2 11/2011 Hales et al.
8,069,789 B2 12/2011 Hummel et al.
8,074,737 B2 12/2011 Hill et al.
3,141,639 A1 3/2012 Gartz et al.
8,127,846 B2 3/2012 Hill et al.
8,141,639 B2 3/2012 Gartz et al.
8,157,022 B2 4/2012 Bertoja et al.
8,181,718 B2 5/2012 Burleson et al.
8,182,212 B2 5/2012 Parcell
8,186,259 B2 5/2012 Burleson et al.
8,186,425 B2 5/2012 Smart et al.
8,230,946 B2 7/2012 Crawford et al.
8,256,337 B2 9/2012 Hill
8,322,426 B2 12/2012 Wright et al.
8,387,533 B2 3/2013 Runkel
8,395,878 B2 3/2013 Stewart et al.
8,397,741 B2 3/2013 Bisset
8,443,915 B2 5/2013 Storm, Jr. et al.
8,451,137 B2 5/2013 Bonavides et al.
8,464,624 B2 6/2013 Asahina et al.
8,474,381 B2 7/2013 Streibich et al.
8,474,533 B2 7/2013 Miller et al.
8,522,863 B2 9/2013 Tiernan et al.
8,561,683 B2 10/2013 Wood et al.
8,661,978 B2 3/2014 Backhus et al.
8,695,506 B2 4/2014 Lanclos
8,695,716 B2 4/2014 Ravensbergen
8,752,486 B2 6/2014 Robertson et al.
8,770,271 B2 7/2014 Fielder et al.
8,826,821 B2 9/2014 Martin
8,833,441 B2 9/2014 Fielder et al.
8,863,665 B2 10/2014 DeVries et al.
8,869,887 B2 10/2014 Deere et al.
8,875,787 B2 11/2014 Tassaroli
8,881,816 B2 11/2014 Glenn et al.
8,881,836 B2 11/2014 Ingram
8,931,569 B2 1/2015 Fagley et al.
8,943,943 B2 2/2015 Tassaroli
8,950,480 B1 2/2015 Strickland
8,960,093 B2 2/2015 Preiss et al.
9,057,261 B2 6/2015 Walters et al.
9,065,201 B2 6/2015 Borgfeld et al.
9,080,405 B2 7/2015 Carisella
9,080,433 B2 7/2015 Lanclos et al.
9,145,764 B2 9/2015 Burton et al.
9,175,553 B2 11/2015 McCann et al.
9,181,790 B2 11/2015 Mace et al.
9,182,199 B2 11/2015 Skidmore et al.
9,194,219 B1 11/2015 Hardesty et al.
9,222,331 B2 12/2015 Schneidmiller et al.
9,284,819 B2 3/2016 Tolman et al.
9,285,199 B2 3/2016 Beikoff
9,328,559 B2 5/2016 Schwarz et al.
9,441,465 B2 9/2016 Tassaroli
9,453,381 B2 9/2016 Moyes
9,453,382 B2 9/2016 Carr et al.
9,464,495 B2 10/2016 Picciotti et al.
9,476,272 B2 10/2016 Carisella et al.
9,476,275 B2 10/2016 Wells et al.
9,476,289 B2 10/2016 Wells
9,482,069 B2 11/2016 Powers
9,488,024 B2 11/2016 Hoffman et al.
9,494,021 B2 11/2016 Parks et al.
9,506,316 B2 11/2016 Carr et al.
9,581,422 B2 2/2017 Preiss et al.
9,587,466 B2 3/2017 Burguieres et al.
9,598,942 B2 3/2017 Wells et al.
9,605,937 B2 3/2017 Eitschberger et al.
9,677,363 B2 6/2017 Schacherer et al.
9,689,223 B2 6/2017 Schacherer et al.
9,689,240 B2 6/2017 LaGrange et al.
9,695,673 B1 7/2017 Latiolais
9,702,211 B2 7/2017 Tinnen
9,771,769 B2 9/2017 Baker et al.
9,784,549 B2 10/2017 Eitschberger
9,810,035 B1 * 11/2017 Carr ..... E21B 23/065
9,810,048 B2 11/2017 Balun
9,822,609 B2 11/2017 Wright et al.
9,822,618 B2 11/2017 Eitschberger
9,835,006 B2 12/2017 George et al.
9,835,428 B2 12/2017 Mace et al.
9,879,501 B2 1/2018 Hammer et al.
9,890,604 B2 2/2018 Wood et al.
9,903,192 B2 2/2018 Entchev et al.

(56) References Cited

U.S. PATENT DOCUMENTS 9,926,750 B2 3/2018 Ringgenberg
9,926,765 B2 3/2018 Goodman et al.
9,963,398 B2 5/2018 Greeley et al.
9,995,115 B2 6/2018 Kasperski
10,018,018 B2 7/2018 Cannon et al.
10,036,236 B1 7/2018 Sullivan et al.
10,041,321 B2 8/2018 Oag et al.
10,066,921 B2 9/2018 Eitschberger
10,077,626 B2 9/2018 Xu et al.
10,077,641 B2 9/2018 Rogman et al.
10,087,708 B2 10/2018 Al-Gouhi et al.
10,107,054 B2 10/2018 Drury et al.
10,138,713 B2 11/2018 Tolman et al.
10,151,180 B2 12/2018 Robey et al.
10,151,181 B2 12/2018 Lopez et al.
10,167,691 B2 1/2019 Zhang et al.
10,188,990 B2 1/2019 Burmeister et al.
10,190,398 B2 1/2019 Goodman et al.
10,246,961 B2 4/2019 Robertson et al.
10,267,603 B2 4/2019 Marshall et al.
10,273,788 B2 4/2019 Bradley et al.
10,309,199 B2 6/2019 Eitschberger
10,337,270 B2 7/2019 Carisella et al.
10,352,136 B2 7/2019 Goyeneche
10,352,144 B2 7/2019 Entchev et al.
10,365,079 B2 7/2019 Harrington et al.
10,393,482 B2 8/2019 Khatiwada et al.
10,428,595 B2 10/2019 Bradley et al.
10,429,161 B2 10/2019 Parks et al.
10,443,331 B1 10/2019 Andres et al.
10,458,213 B1 10/2019 Eitschberger et al.
10,472,938 B2 11/2019 Parks et al.
10,538,981 B2 1/2020 Covalt et al.
10,605,018 B2 3/2020 Schmidt et al.
10,669,822 B2 6/2020 Eitschberger
10,689,931 B2 6/2020 Mickey et al.
10,794,122 B2 10/2020 Kitchen et al.
10,830,566 B2 11/2020 Maxted et al.
10,844,678 B2 11/2020 Mickey et al.
10,883,327 B1 1/2021 Drury et al.
10,900,309 B2 1/2021 Robertson et al.
10,927,627 B2 2/2021 Eitschberger et al.
10,934,795 B2 3/2021 Wells
10,941,625 B2 3/2021 Mickey
11,053,759 B2 7/2021 Covalt et al.
11,053,760 B2 7/2021 Baker et al.
2002/0020320 A1 2/2002 Lebaudy et al.
2002/0062991 A1 5/2002 Farrant et al.
2002/0129940 A1 9/2002 Yang et al.
2003/0000411 A1 1/2003 Cernocky et al.
2003/0155112 A1 8/2003 Tiernan et al.
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0229805 A1 10/2005 Myers. Jr. et al.
2006/0048664 A1 3/2006 Tiernan et al.
2006/0075890 A1 4/2006 Tiernan
2006/0081374 A1 4/2006 Bland et al.
2007/0079966 A1 4/2007 George et al.
2007/0084336 A1 4/2007 Neves
2007/0125540 A1 6/2007 Gerez et al.
2008/0047456 A1 2/2008 Li et al.
2008/0110612 A1 5/2008 Prinz et al.
2008/0134922 A1 6/2008 Grattan et al.
2008/0149338 A1 6/2008 Goodman et al.
2008/0173204 A1 7/2008 Anderson et al.
2008/0264639 A1 10/2008 Parrott et al.
2008/0314591 A1 12/2008 Hales et al.
2009/0050322 A1 2/2009 Hill et al.
2010/0000789 A1 1/2010 Barton et al.
2010/0065302 A1 3/2010 Nesbitt
2010/0089643 A1 4/2010 Vidal
2010/0096131 A1 4/2010 Hill et al.
2010/0163224 A1 7/2010 Strickland
2010/0230104 A1 9/2010 Nölke et al.
2010/0307773 A1 12/2010 Finnen et al.
2011/0024116 A1 2/2011 McCann et al.
2012/0080202 A1 4/2012 Greenlee et al.
2012/0085538 A1 4/2012 Guerrero et al.
2012/0199031 A1 8/2012 Lanclos
2012/0199352 A1 8/2012 Lanclos et al.
2012/0241169 A1 9/2012 Hales et al.
2012/0242135 A1 9/2012 Thomson et al.
2012/0247769 A1 10/2012 Schacherer et al.
2012/0247771 A1 10/2012 Black et al.
2012/0298361 A1 11/2012 Sampson
2013/0048376 A1 2/2013 Rodgers et al.
2013/0062055 A1 3/2013 Tolman et al.
2013/0118342 A1 5/2013 Tassaroli
2013/0199843 A1 8/2013 Ross
2013/0248174 A1 9/2013 Dale et al.
2014/0033939 A1 2/2014 Priess et al.
2014/0060839 A1 3/2014 Wang et al.
2014/0131035 A1 5/2014 Entchev et al.
2014/0209381 A1 7/2014 Huang et al.
2014/0318766 A1 10/2014 Bishop
2015/0176386 A1 6/2015 Castillo et al.
2015/0226533 A1 8/2015 Grattan
2015/0247375 A1 9/2015 Stout
2015/0330192 A1 11/2015 Man et al.
2015/0354310 A1 12/2015 Zaiser
2015/0356403 A1 12/2015 Storm, Jr.
2016/0040520 A1 2/2016 Tolman et al.
2016/0053560 A1 2/2016 Drury et al.
2016/0053561 A1 2/2016 Carr et al.
2016/0061572 A1 3/2016 Eitschberger et al.
2016/0069163 A1 3/2016 Tolman et al.
2016/0084048 A1 3/2016 Harrigan et al.
2016/0145990 A1 5/2016 Mace et al.
2016/0153271 A1 6/2016 Mace et al.
2016/0153272 A1 6/2016 Mace et al.
2016/0168961 A1 6/2016 Parks et al.
2016/0186511 A1 6/2016 Coronado et al.
2016/0186513 A1 6/2016 Robertson et al.
2016/0258240 A1 9/2016 Fripp et al.
2016/0356132 A1 12/2016 Burmeister et al.
2017/0009560 A1 1/2017 Wells
2017/0030162 A1 2/2017 Carragher
2017/0030693 A1* 2/2017 Preiss ..... E21B 43/1185
2017/0037716 A1 2/2017 Kohlik
2017/0044865 A1 2/2017 Sabins et al.
2017/0051586 A1 2/2017 Wells et al.
2017/0138150 A1 5/2017 Yencho
2017/0145798 A1 5/2017 Robey et al.
2017/0211363 A1 7/2017 Bradley et al.
2017/0241244 A1 8/2017 Barker et al.
2017/0268860 A1 9/2017 Eitschberger
2017/0276465 A1 9/2017 Parks et al.
2017/0314372 A1 11/2017 Tolman et al.
2017/0328134 A1 11/2017 Sampson et al.
2017/0335646 A1 11/2017 Huang et al.
2018/0030334 A1 2/2018 Collier et al.
2018/0080298 A1* 3/2018 Covalt ..... E21B 23/065
2018/0080300 A1 3/2018 Angstmann et al.
2018/0087330 A1 3/2018 Bradley et al.
2018/0106121 A1 4/2018 Griffin et al.
2018/0120066 A1 5/2018 Khatiwada et al.
2018/0127641 A1 5/2018 Nguyen et al.
2018/0135398 A1 5/2018 Entchev et al.
2018/0148995 A1 5/2018 Burky et al.
2018/0163497 A1* 6/2018 Younger ..... E21B 23/04
2018/0171757 A1 6/2018 Xu
2018/0202248 A1 7/2018 Harrington et al.
2018/0202249 A1 7/2018 Harrington et al.
2018/0209251 A1 7/2018 Robey et al.
2018/0238132 A1 8/2018 Oag et al.
2018/0274342 A1 9/2018 Sites
2018/0274356 A1 9/2018 Hazel
2018/0283836 A1 10/2018 Thomas
2018/0299239 A1 10/2018 Eitschberger et al.
2018/0305993 A1 10/2018 Perkins et al.
2018/0306010 A1 10/2018 Von Kaenel et al.
2018/0318770 A1 11/2018 Eitschberger et al.

(56) References Cited

U.S. PATENT DOCUMENTS

| | | | |
|---|---|---|---|
| 2018/0363424 | A1 | 12/2018 | Schroeder et al. |
| 2019/0017356 | A1 | 1/2019 | Harrington et al. |
| 2019/0040722 | A1 | 2/2019 | Yang et al. |
| 2019/0048693 | A1 | 2/2019 | Henke et al. |
| 2019/0049225 | A1 | 2/2019 | Eitschberger |
| 2019/0106956 | A1* | 4/2019 | Wells ..... E21B 23/065 |
| 2019/0106962 | A1 | 4/2019 | Lee et al. |
| 2019/0128657 | A1 | 5/2019 | Harrington et al. |
| 2019/0136673 | A1 | 5/2019 | Sullivan et al. |
| 2019/0162057 | A1 | 5/2019 | Montoya Ashton et al. |
| 2019/0195054 | A1 | 6/2019 | Bradley et al. |
| 2019/0211655 | A1 | 7/2019 | Bradley et al. |
| 2019/0257181 | A1 | 8/2019 | Langford et al. |
| 2019/0277103 | A1 | 9/2019 | Wells et al. |
| 2019/0284889 | A1 | 9/2019 | LaGrange et al. |
| 2019/0292887 | A1 | 9/2019 | Austin, II et al. |
| 2019/0316449 | A1 | 10/2019 | Schultz et al. |
| 2019/0338612 | A1 | 11/2019 | Holodnak et al. |
| 2019/0368293 | A1* | 12/2019 | Covalt ..... E21B 23/065 |
| 2020/0018132 | A1 | 1/2020 | Ham |
| 2020/0032602 | A1 | 1/2020 | Jennings et al. |
| 2020/0032603 | A1 | 1/2020 | Covalt et al. |
| 2020/0063537 | A1 | 2/2020 | Langford et al. |
| 2020/0095838 | A1 | 3/2020 | Baker |
| 2020/0332630 | A1 | 10/2020 | Davis et al. |
| 2020/0362652 | A1 | 11/2020 | Eitschberger et al. |
| 2021/0048284 | A1 | 2/2021 | Maxted et al. |
| 2022/0074718 | A1 | 3/2022 | Mcnelis |

FOREIGN PATENT DOCUMENTS

| | | | |
|---|---|---|---|
| CA | 2821506 | A1 | 1/2015 |
| CA | 2941648 | A1 | 9/2015 |
| CA | 2848060 | A1 | 10/2015 |
| CA | 3040116 | A1 | 10/2016 |
| CA | 3022946 | A1 | 11/2017 |
| CA | 3021913 | A1 | 2/2018 |
| CA | 3050712 | A1 | 7/2018 |
| CA | 2980935 | C | 11/2019 |
| CN | 85107897 | A | 9/1986 |
| CN | 2823549 | | 10/2006 |
| CN | 1284750 | C | 11/2006 |
| CN | 101397890 | A | 4/2009 |
| CN | 201620848 | U | 11/2010 |
| CN | 103485750 | A | 1/2014 |
| CN | 104499977 | A | 4/2015 |
| CN | 208870580 | U | 5/2019 |
| CN | 104481492 | B | 6/2019 |
| CN | 209195374 | U | 8/2019 |
| CN | 110424930 | A | 11/2019 |
| CN | 106522886 | B | 12/2019 |
| CN | 209908471 | U | 1/2020 |
| EP | 0216527 | B1 | 11/1990 |
| EP | 332287 | B1 | 7/1992 |
| EP | 2177866 | A1 | 4/2010 |
| EP | 3277913 | A1 | 2/2018 |
| EP | 3077612 | B1 | 5/2020 |
| GB | 2065750 | B | 6/1983 |
| GB | 2537749 | B | 3/2017 |
| RU | 2087693 | C1 | 8/1997 |
| RU | 2204706 | C1 | 5/2003 |
| RU | 30160 | U1 | 6/2003 |
| RU | 2221141 | C1 | 1/2004 |
| RU | 2312981 | C2 | 12/2007 |
| RU | 98047 | U1 | 9/2010 |
| RU | 2439312 | C1 | 1/2012 |
| RU | 2633904 | C1 | 10/2017 |
| WO | 1994009246 | A1 | 4/1994 |
| WO | 1994021882 | A1 | 9/1994 |
| WO | 0049271 | A1 | 8/2000 |
| WO | 2008066544 | A2 | 6/2008 |
| WO | 2011160099 | A1 | 12/2011 |
| WO | 2012006357 | A2 | 1/2012 |
| WO | 2012140102 | A1 | 10/2012 |
| WO | 2014178725 | A1 | 11/2014 |
| WO | 2015006869 | A1 | 1/2015 |
| WO | 2015028204 | A2 | 3/2015 |
| WO | 2015134719 | A1 | 9/2015 |
| WO | 2016100064 | A1 | 6/2016 |
| WO | 2016100269 | A1 | 6/2016 |
| WO | 2016145420 | A1 | 9/2016 |
| WO | 2016161379 | A1 | 10/2016 |
| WO | 2017041772 | A1 | 3/2017 |
| WO | 2017125745 | A1 | 7/2017 |
| WO | 2017192878 | A1 | 11/2017 |
| WO | 2017199037 | A1 | 11/2017 |
| WO | 2018009223 | A1 | 1/2018 |
| WO | 2018136808 | A1 | 7/2018 |
| WO | 2018177733 | A1 | 10/2018 |
| WO | 2018213768 | A1 | 11/2018 |
| WO | 2019071027 | A1 | 4/2019 |
| WO | 2019148009 | A2 | 8/2019 |
| WO | 2019165286 | A1 | 8/2019 |
| WO | 2019180462 | A1 | 9/2019 |
| WO | 2019204137 | A1 | 10/2019 |
| WO | 2021013731 | A1 | 1/2021 |
| WO | 2021063920 | A1 | 4/2021 |

OTHER PUBLICATIONS

Halliburton; Wireline and Perforating Advances in Perforating; dated Nov. 2012; 12 pages.

Hunting Energy Services, Hunting T-Set Animation Web Video Screenshot, 2015, 1 page.

Hunting, T-Set® Family of Setting Tools, 2 pages.

Hunting, T-Set® Tool Catalog, Sep. 27, 2016, 87 pages.

International Searching Authority; International Search Report and Written Opinion of the International Searching Authority for PCT/EP2020/077180; dated Jan. 28, 2021; 13 pages.

Baker Hughes; Power charge, Slow set, Size 10 E4; dated Sep. 18, 2020; https://www.shopbakerhughes.com/wireline/power-charge-slow-set-size-10-e4-h437660010.html; 4 pages.

Baker Hughes; Power charge, Standard, Size 20 E4; dated Sep. 20, 2020; https://www.shopbakerhughes.com/wireline/power-charge-standard-size-20-e4-h437643223.html; 4 pages.

United States Patent and Trademark Office; Non-Final Office Action for U.S. Appl. No. 16/379,341; dated Sep. 21, 2020; 15 pages.

Brico Oil Tools; BT Tool Inspection, Care and Maintenance Guideline; Setting Tool Inspection Information Product Family No. 41-21; dated Jan. 11, 2014; https://www.bricooiltools.com/pdfs/Brico-Setting-Tool-Inspection-manual.pdf.

Thilo Scharf; "DynaStage & BTM Introduction"; pp. 4-5, 9; presented at 2014 Offshore Technology Conference; May 2014.

Thru-Tubing Systems, Thru-Tubing Systems Wireline Products Catalog, Apr. 25, 2016, 45 pgs., http://www.thrutubingsystems.com/phire-content/assets/files/Thru%20Tubing%20Systems%20Wireline%20Products.pdf.

U.S. Patent Trial and Appeal Board, Institution of Inter Partes Review of U.S. Pat. No. 9,581,422, Case IPR2018-00600,Aug. 21, 2018, 9 pages.

United States District Court for the Southern District of Texas Houston Division, Case 4:19-cv-01611 for U.S. Pat. No. 9,581,422B2, Plaintiff's Complaint and Exhibits, dated May 2, 2019, 26 pgs.

United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.

United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.

United States Patent and Trademark Office, Case IPR2018-00600 for U.S. Pat. No. 9,581,422 B2, Reply In Support of Patent Owner's Motion to Amend, dated Mar. 21, 2019, 15 pgs.

United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.

(56) References Cited

OTHER PUBLICATIONS

United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of Patent No. 9,581,422, dated Mar. 7, 2019, 44 pgs.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, Non-Final Office Action for U.S. Appl. No. 10/573,581, dated Nov. 14, 2008, 7 pages.
United States Patent and Trademark Office, Office Action of U.S. Appl. No. 16/858,041, dated Jun. 16, 2020, 11 pgs.
United States Patent and Trademark Office, U.S. Appl. No. 61/733,129, filed Dec. 4, 2012; 10 pages.
United States Patent and Trademark Office, U.S. Appl. No. 61/819,196, filed May 3, 2013 ; 10 pages.
United States Patent and Trademark Office; Non Final Office Action for U.S. Appl. No. 16/886,257; dated Jan. 15, 2021; 7 pages.
United States Patent and Trademark Office; Notice of Allowance for U.S. Appl. No. 16/858,041; dated Oct. 22, 2020; 10 pages.
United States Patent Trial and Appeal Board; Decision Denying Institution of Post-Grant Review; PGR No. 2020-00072; dated Jan. 19, 2021; 38 pages.
International Searching Authority, International Search Report for International App No. PCT/EP2020/063214, dated Jul. 29, 2020, 17 pages.
Amit Govil, Selective Perforation: A Game Changer in Perforating Technology—Case Study, presented at the 2012 European and West African Perforating Symposium, Schlumberger, Nov. 7-9, 2012, 14 pgs.
Austin Powder Company; A-140 F & Block, Detonator & Block Assembly; Jan. 5, 2017; 2 pgs.; https://www.austinpowder.com/wp-content/uploads/2019/01/OilStar_A140Fbk-2.pdf.
Baker Hughes; SurePerf Rapid Select-Fire System Perforate production zones in a single run; 2012; 2 pages.
Core Lab, ZERO180™ Gun SystemAssembly and Arming Procedures, 2015, 33 pgs., https://www.corelab.com/owen/CMS/docs/Manuals/gunsys/zero180/MAN-Z180-000.pdf.
Dynaenergetics Europe Gmbh; Patent Owner's Preliminary Response for PGR2020-00080; dated Nov. 18, 2020; 119 pages.
Dynaenergetics Europe Gmbh; Principal and Response Brief of Cross-Appellant for United States Court of Appeals case No. 2020-2163, -2191; dated Jan. 11, 2021; 95 pages.
Dynaenergetics Europe; Complaint and Demand for Jury Trial, Civil Action No. 6:20-cv-00069; dated Jan. 30, 2020; 9 pages.
Dynaenergetics Europe; Complaint and Demand for Jury Trial,Civil Action No. 4:17-cv-03784; dated Dec. 14, 2017; 7 pages.
Dynaenergetics Europe; Plaintiffs' Motion to Dismiss Defendants' Counterclaim and to strike Affirmative Defenses, Civil Action No. 4:17-cv-03784; dated Feb. 20, 2018; 9 pages.
Dynaenergetics Europe; Plaintiffs' Preliminary Infringement Contentions, Civil Action No. 6:20-cv-00069-ADA; dated Apr. 22, 2020; 32 pages.
Dynaenergetics Europe; Plaintiffs' Response to Defendants' Answer to Second Amended Complaint Civil Action No. 6:20-cv-00069-ADA; dated May 26, 2020; 18 pages.
Dynaenergetics Gmbh & Co. KG, Patent Owner's Response to Hunting Titan's Petition for Inter Parties Review—Case IPR2018-00600, filed Dec. 6, 2018, 73 pages.
Dynaenergetics GmbH & Co. KG; Patent Owner's Precedential Opinion Panel Request for Case IPR2018-00600; Sep. 18, 2019, 2 pg.
Dynaenergetics, DYNAselect Electronic Detonator 0015 SFDE RDX 1.4B, Product Information, Dec. 16, 2011, 1 pg.
Dynaenergetics, DYNAselect Electronic Detonator 0015 SFDE RDX 1.4S, Product Information, Dec. 16, 2011, 1 pg.
Dynaenergetics, DYNAselect System, information downloaded from website, Jul. 3, 2013, 2 pages, http://www.dynaenergetics.com/.
Dynaenergetics, Through Wire Grounded Bulkhead (DynaTWG). May 25, 2016, 1 pg., https://www.dynaenergetics.com/uploads/files/5756f884e289a_U233%20DynaTWG%20Bulkhead.pdf.
Dynaenergetics; DynaStage Solution—Factory Assembled Performance-Assured Perforating Systems; 6 pages.
Eric H. Findlay, Jury Trial Demand in Civil Action No. 6:20-cv-00069-ADA, dated Apr. 22, 2020, 32 pages.
GE Oil & Gas, Pipe Recovery Technology & Wireline Accessories, 2013, 435 pages.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Energy Service,ControlFire RF Safe ControlFire® RF-Safe Manual, 33 pgs., Jul. 2016, http://www.hunting-intl.com/media/2667160/ControlFire%20RF_Assembly%20Gun%20Loading_Manual.pdf.
Hunting Titan Inc.; Petition for Post Grant Review of U.S. Pat. No. 10,429,161; dated Jun. 30, 2020; 109 pages.
Hunting Titan Inc.; Petition for Post Grant Review of U.S. Pat. No. 10,472,938; dated Aug. 12, 2020; 198 pages.
Hunting Titan Ltd,; Defendants' Answer and Counterclaims, Civil Action No. 4:19-cv-01611, consolidated to Civil Action No. 4:17-cv-03784; dated May 28, 2019; 21 pages.
Hunting Titan Ltd.; Petition for Inter Partes Review of U.S. Pat. No. 9,581,422 Case No. IPR2018-00600; dated Feb. 16, 2018; 93 pages.
Hunting Titan Ltd.; Defendants' Answer and Counterclaims, Civil Action No. 6:20-cv-00069; dated Mar. 17, 2020; 30 pages.
Hunting Titan Ltd.; Defendants' Answer to First Amended Complaint and Counterclaims, Civil Action No. 6:20-cv-00069; dated Apr. 6, 2020; 30 pages.
Hunting Titan Ltd.; Defendants' Answer to Second Amended Complaint and Counterclaims, Civil Action No. 6:20-cv-00069; dated May 12, 2020; 81 pages.
Hunting Titan Ltd.; Defendants Invalidity Contentions Pursuant to Patent Rule 3-3, Civil Action No. 4:17-cv-03784; dated Jul. 6, 2018; 29 pages.
Hunting Titan Ltd.; Defendants' Objections and Responses to Plaintiffs' First Set of Interrogatories, Civil Action No. 4:17-cv-03784; dated Jun. 11, 2018.
Hunting Titan, T-Set Setting Tool Product Catalog, 2015, 87 pgs., http://www.hunting-intl.com/media/1872254/AMG-1054.HT_T-Set_Catalog_LowRes.pdf.

(56) References Cited

OTHER PUBLICATIONS

Jet Research Center Inc., JRC Catalog, 2008, 36 pgs., https://www.jetresearch.com/content/dam/jrc/Documents/Books_Catalogs/06_Dets.pdf.
Jet Research Center, Plugs and Setting Tools, Alvarado,Texas, 13 pgs., https://www.jetresearch.com/content/dam/jrc/Documents/Books_Catalogs/02_Plugs_STNG_Tool.pdf.
Jet Research Center, Velocity™ Perforating System Plug and Play Guns For Pumpdown Operation, Ivarado, Texas, Jul. 2019, 8 pgs., https://www.jetresearch.com/content/dam/jrc/Documents/Brochures/jrc-velocity-perforating-system.pdf.
Norwegian Industrial Property Office, Office Action for NO Application No. 20061842, dated Dec. 21, 2014, 2 pages (Eng. Translation 2 pages).
Norwegian Industrial Property Office, Search Report for NO Application No. 20061842, dated Dec. 21, 2014, 2 pages.
Owens Oil Tools, E & B Select Fire Side Port Tandem Sub Assembly, 2009, 9 pgs., https://www.corelab.com/owen/CMS/docs/Manuals/gunsys/MAN-30-XXX-0002-96-R00.pdf.
Parrot, Robert; Declaration, PGR 2020-00080; dated Aug. 11, 2020; 400 pages.
Robert Parrott, Case IPR2018-00600 for U.S. Pat. No. 9,581,422 B2, Declaration regarding Patent Invalidity, dated Jun. 29, 2020, 146 pages.
Rodgers, John; Declaration for PGR2020-00080; dated Nov. 18, 2020; 142 pages.
Scharf Thilo; Declaration for PGR2020-00080; dated Nov. 16, 2020; 16 pages.
Schlumberger, CPST Pressure Setting Tool, 2014, 1 pg., https://www.slb.com/-/media/files/co/product-sheet/cpst-pressure-setting-tool.
Schlumberger, Perforating Services Catalog, 2008, 521 pages.
Schlumberger; Selective Perforation: A Game Changer in Perforating Technology—Case Study; issued 2012; 14 pages.
Thilo Scharf; "DynaEnergetics exhibition and product briefing"; pp. 5-6; presented at 2014 Offshore Technology Conference; May 2014.
SPEX Group; SPEX Bridge Plugs & Setting Tools; Jan. 12, 2017; 3 pages.
Gazda., A Battery-Operated, Electro-Mechanical Setting Tool for Use with Bridge Plugs and Similar Wellbore Tools, Jun. 1996, 7 pgs., https://onepetro.org/OTCONF/proceedings-abstract/95OTC/All-95OTC/OTC-7877-MS/44138.

* cited by examiner

SINGLE USE SETTING TOOL FOR ACTUATING A TOOL IN A WELLBORE

CROSS-REFERENCE TO RELATED APPLICATIONS

This application is a Continuation-in-Part of and claims priority to U.S. patent application Ser. No. 16/924,504 filed Jul. 9, 2020 (now U.S. Pat. No. 11,255,147 issued Feb. 22, 2022), which is a Continuation-in-Part of and claims priority to U.S. patent application Ser. No. 16/858,041 filed Apr. 24, 2020 (now U.S. Pat. No. 10,927,627 issued Feb. 23, 2021), which claims the benefit of U.S. Provisional Patent Application No. 62/847,488 filed May 14, 2019, U.S. Provisional Patent Application No. 62/862,867 filed Jun. 18, 2019, and U.S. Provisional Patent Application No. 62/908,747 filed Oct. 1, 2019. Each application listed above is incorporated herein by reference, in its entirety.

BACKGROUND OF THE DISCLOSURE

Oil and gas are extracted by subterranean drilling and introduction of machines into the resultant wellbore. It is often advantageous or required that portions of a wellbore be sealed off from other portions of the wellbore. Among other functions, a running or setting tool is utilized to place plugs at locations inside the wellbore to seal portions thereof from other portions.

Primarily used during completion or well intervention, a plug isolates a part of the wellbore from another part. For example, when work is carried out on an upper section of the well, the lower part of the wellbore must be isolated and plugged; this is referred to as zonal isolation. Plugs can be temporary or permanent. Temporary plugs can be retrieved whereas permanent or frac plugs can only be removed by destroying them with a drill. There are a number of types of plugs, e.g., bridge plugs, cement plugs, frac plugs and disappearing plugs. Plugs may be set using a setting tool conveyed on wire-line, coiled tubing or drill pipe.

In a typical operation, a plug can be lowered into a well and positioned at a desired location in the wellbore. A setting tool may be attached to and lowered along with the plug or it may be lowered after the plug, into an operative association therewith. The setting tool may include a power charge and a piston; activation of the power charge results in a substantial force by means of combustion being exerted on the setting tool piston. When it is desired to set the plug, the power charge is initiated, resulting in the power charge burning, pressure being generated and the piston being subjected to a substantial force. The piston being constrained to movement in a single direction, the substantial force causes the piston to move axially and actuate the plug to seal a desired area of the well. The substantial force exerted by the power charge on the piston can also shear one or more shear pins or similar frangible members that serve certain functions, e.g., holding the piston in place prior to activation and separating the setting tool from the plug.

The force applied to a plug by the power charge and/or setting tool piston must be controlled; it must be sufficient to set the plug or to similarly actuate other tools but excessive force may damage the setting tool, other downhole tools or the wellbore itself. Also, even a very strong explosive force can fail to actuate a tool if delivered over a too short time duration. Even if a strong force over a short time duration will actuate a tool, such a set-up is not ideal. That is, a power charge configured to provide force over a period of a few seconds instead of a few milliseconds is sometimes preferred; such an actuation is referred to as a "slow set". Favorable setting characteristics may be provided with either a fast set or a slow set, depending on the tool being set and other parameters.

Plug setting tools and other components in the tool string such as perforating gun assemblies in particular are also subject to tremendous shock when the plug is detached from the setting tool even in slow set devices. For example, combustion of the power charge may generate gas pressure to urge the piston against a setting sleeve that is locked, e.g., by shear pins, in a first position above the plug. The shear pins will shear under a threshold amount of force and the piston will force the setting sleeve to a second position. The plug is set and detached from the setting tool by the time the setting sleeve reaches the second position. The sudden detachment and setting of the plug under the force of the piston may impart to the piston a drastic accelerative force (i.e., a "kick") in the opposite direction. The degree of the kick may vary among combinations of known plugs and setting tools from different manufacturers. Some kicks are strong enough to damage the setting sleeve, setting tool, and upstream components. The piston may also accelerate as it continues its travel, or stroke, until it is mechanically stopped by a barrier or connection to another component of the setting tool. The sudden mechanical stop may create additional damaging forces or deform components.

Existing setting tools and techniques involve multiple components, many of which need to have precise tolerances. Thus, current setting tools are complex, heavy, of substantial axial length and expensive. The complexity and important functions served by setting tools has resulted in the need, primarily driven by economic and efficiency considerations, of a reusable setting tool. That is, the substantial number of expensive components and importance of 'knowing,' from an engineering perspective, exactly how a setting tool is going to operate under a particular set of circumstances, resulted in the need to reuse a setting tool a number of times. Thus, a typical setting tool is retrieved from the wellbore after use and 'reset' prior to its next run down the wellbore. Resetting a setting tool involves fairly laborious steps performed by a skilled operator to prepare, i.e., clean the used tool, replace the consumable parts and otherwise place the setting tool in 'usable' condition. Consumable parts in a setting tool may include the power charge, power charge initiating/boosting elements, elastomers, oil, burst discs and/or shear elements/screws. The combustible/explosive nature of the power charge as well as the initiating/booster elements present another set of issues regarding the need for a skilled operator/resetting.

Further, the power charge may include an initiating or booster element (collectively, "booster element") connected to the power charge, at a particular position on the power charge. The setting tool (or other wellbore tool) may include a detonator or other initiator for initiating the booster element. The booster element may enhance ignition of the power charge compared to the detonator or initiator alone. For example, the booster element may be capable of greater energy release than the detonator or initiator and may be in contact with a surface area of the power charge. The orientation of the power charge within the wellbore tool must therefore place the booster element in sufficient proximity to the detonator or initiator. However, many power charges are symmetrically shaped, and a user may erroneously position a power charge "backwards"—i.e., with the booster element positioned away from the detonator or initiator—within the wellbore tool.

In view of the disadvantages associated with currently available wellbore tools such as setting tools and power charges for use therein, there is a need in the wellbore industry for a safe, predictable, and economical setting tool that reduces the possibility of human error during assembly. Economy may be achieved with fewer parts operating in a simpler manner. The fewer/simpler parts may be fabricated from less expensive materials and subject to less stringent engineering tolerances though, nonetheless, operate as safely and predictably as current tools. The cost savings for this setting tool will make it economically feasible to render the tool single use, resulting in even greater cost savings from having to clean and reset the setting tool, eliminating the skilled work required to do so as well as the supply chain for consumable elements of the reusable setting tool.

BRIEF DESCRIPTION OF THE EXEMPLARY EMBODIMENTS

In an aspect, the disclosure relates to a single use setting tool for actuating a tool in a wellbore. The single use setting tool may include an inner piston having a piston proximal end, a piston distal end opposite the piston proximal end, and a piston annular wall. The piston annular wall may define a piston cavity. At least a portion of an initiator holder may be positioned within the piston cavity and the initiator holder may be configured for receiving and retaining an initiator within the piston proximal end. A gas-generating power charge may be positioned within the piston cavity, and the power charge may extend along a longitudinal axis from a proximal end of the power charge to a distal end of the power charge. Further, the power charge may have a first width at a first axial position and a second width at a second axial position, and the first width may be different than the second width. The piston cavity may be dimensioned complementarily to the power charge, for receiving the power charge including the first width and the second width within the piston cavity.

In an aspect, the disclosure relates to a single use setting tool for actuating a tool in a wellbore. The single use setting tool may include an inner piston having a piston proximal end, a piston distal end opposite the piston proximal end, and a piston inner wall. The piston proximal end may include a seal adapter portion and the piston inner wall may define a piston cavity. The single use setting tool may further include an outer sleeve having a sleeve proximal end, a sleeve distal end, and a sleeve central bore extending from the sleeve proximal end to the sleeve distal end. A portion of the inner piston including the piston cavity may be positioned within the sleeve central bore, a portion of the inner piston may extend beyond the sleeve distal end, and the inner piston and the outer sleeve may be configured for axially sliding relative to one another. The outer sleeve may include a shear element aperture extending from an outer surface of the outer sleeve to the sleeve central bore and the inner piston may include a shear element groove circumferentially extending in an outer surface of the inner piston. The shear element aperture and the shear element groove may together be configured for receiving a shear element extending between and positioned within each of the shear element aperture and the shear element groove, when the inner piston is at a first position relative to the outer sleeve.

In an aspect, the disclosure relates to a single use setting tool for actuating a tool in a wellbore. The single use setting tool may include an inner piston having a piston proximal end, a piston distal end opposite the piston proximal end, and a piston inner wall. The piston proximal end may include a seal adapter portion and the piston inner wall may define a piston cavity. The single use setting tool may further include an outer sleeve having a sleeve proximal end, a sleeve distal end, and a sleeve central bore extending from the sleeve proximal end to the sleeve distal end. A portion of the inner piston including the piston cavity may be positioned within the sleeve central bore, a portion of the inner piston may extend beyond the sleeve distal end, and the inner piston and the outer sleeve may be configured for axially sliding relative to one another. The single use setting tool may further include a piston extension connected to the piston distal end. At least a portion of the piston extension may be dimensioned to extend within the sleeve central bore when the inner piston slides relative to the outer sleeve at least a certain distance.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which:

FIG. 5B is a detailed, cross-sectional side view of the proximal end of the single use setting tool, according to an exemplary embodiment, subsequent to the melting/consumption of the initiator holder during operation of the setting tool thus disconnecting the igniter from the line in;

Figure 1A:
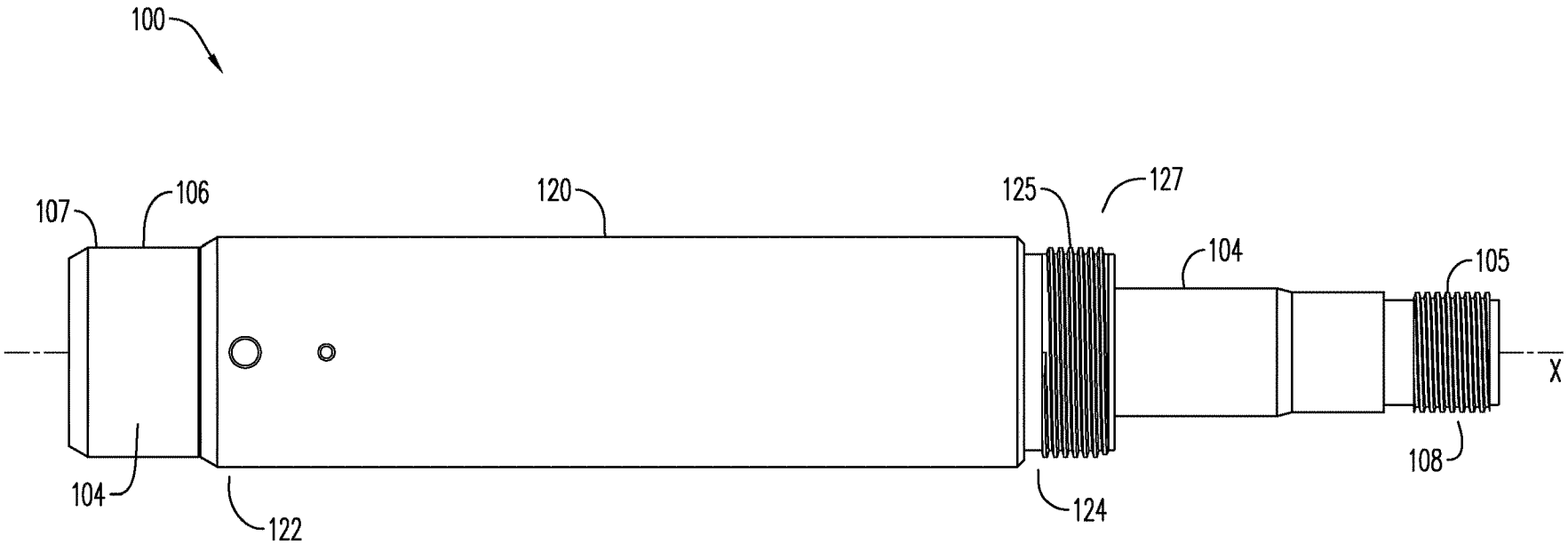
FIG. 1A is a plan view of a single use setting tool for actuating a tool in a wellbore, according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

In the description that follows, the terms "setting tool," "mandrel," "initiator," "power charge," "piston," "bore," "grooves," "apertures," "channels," and/or other like terms are to be interpreted and defined generically to mean any and all of such elements without limitation of industry usage. Such terms used with respect to embodiments in the drawings should not be understood to necessarily connote a particular orientation of components during use.

For purposes of illustrating features of the exemplary embodiments, examples will now be introduced and referenced throughout the disclosure. Those skilled in the art will recognize that these examples are illustrative and not limiting and is provided purely for explanatory purposes. In the illustrative examples and as seen in FIGS. 1-21, single use setting tools for actuating a tool in a wellbore are disclosed. The single use setting tools do not require a separate firing head or power charge, rather an ignition system and power charge are a part of the single use setting tools. A bulkhead seal and an electrical connector are connected within a proximal end of the single use setting tools for setting off the power charge. Further to the structure and usage of the initiator, U.S. Pat. No. 9,581,422, commonly owned by DynaEnergetics Europe GmbH, is incorporated herein by reference in its entirety. Although U.S. Pat. No. 9,581,422 describes a "detonator," this component is more accurately referred to as an initiator or igniter when used with a power charge because the power charge herein does not explode; rather, the power charge deflagrates, i.e., is consumed by combustion. The initiator 118 (FIG. 1B) presented herein may contain different energetic material than the detonator of U.S. Pat. No. 9,581,422 but is otherwise of the same structure.

Figure 1B:
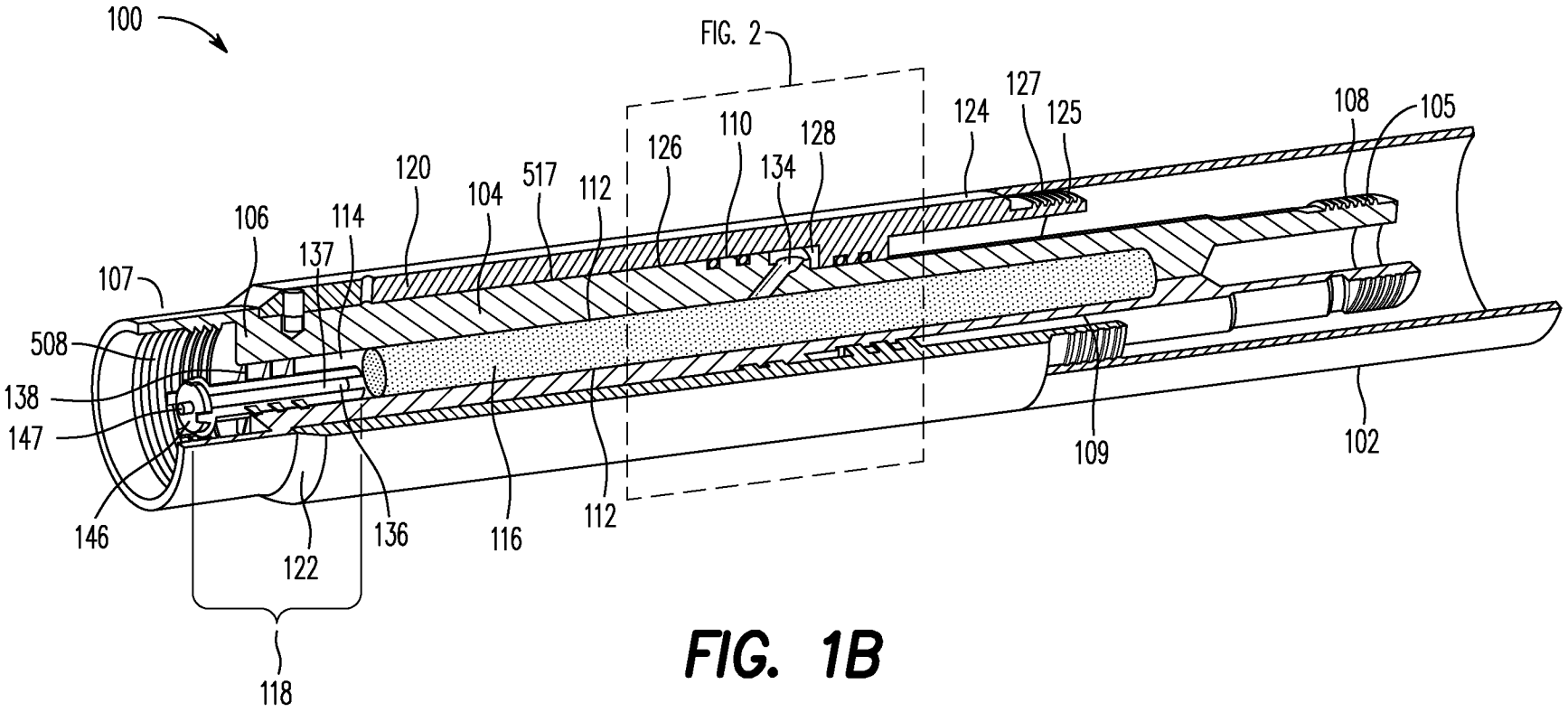
FIG. 1B is a perspective, quarter-sectional view of the single use setting tool of FIG. 1.

FIGS. 1A and 1B show an exemplary embodiment of a single use setting tool 100 according to this disclosure. The exemplary embodiment shown in FIGS. 1A and 1B includes, among other things and without limitation, an inner piston 104 and an outer sleeve 120. The inner piston 104 includes a proximal end 106 and a distal end 108 opposite the proximal end 106 and extends through a central bore 126 formed within the outer sleeve 120. In the exemplary embodiment, the inner piston 104 and the outer sleeve 120 are generally cylindrical and coaxially assembled about a center axis x. The proximal end 106 of the inner piston extends beyond a sleeve proximal end 122 of the outer sleeve 120. The distal end 108 of the inner piston 104 and a portion of a distal rod 109 of the inner piston 104 extend beyond a sleeve distal end 124 opposite the sleeve proximal end 122 of the outer sleeve 120.

Figure 5A:
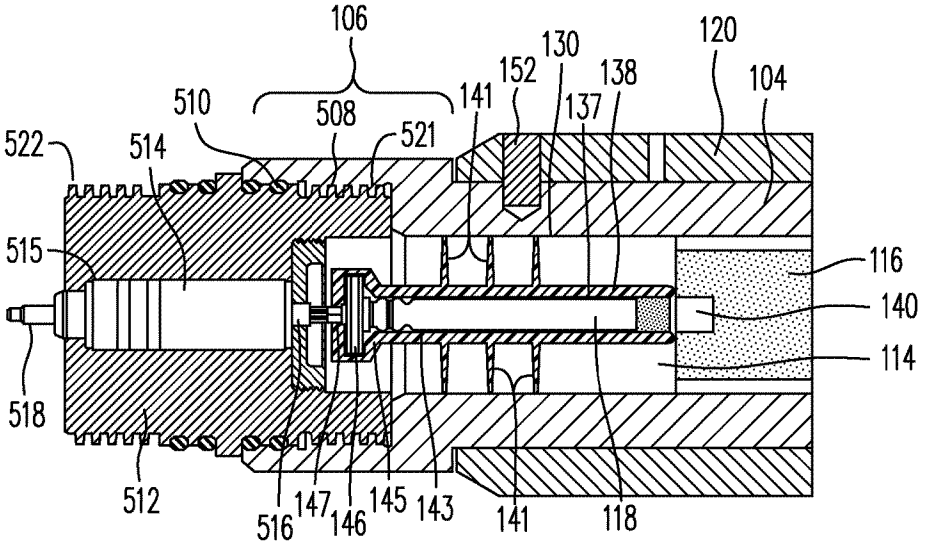
FIG. 5A is a detailed, cross-sectional side view of the proximal end of the single use setting tool, according to an exemplary embodiment.
Figure 5B:
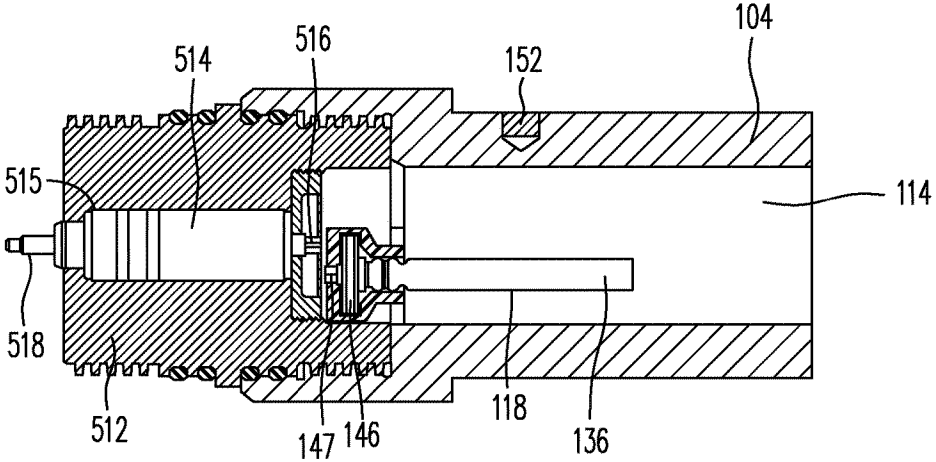

The proximal end 106 of the inner piston 104 includes and transitions into a seal adapter portion 107 of the inner piston 104. In the exemplary embodiment, the seal adapter portion 107 is an integral portion of the inner piston 104 formed as an area of increased diameter with an inner threaded portion 508 for receiving and connecting to a seal adapter (e.g., a "tandem seal adapter (TSA)") 512 (FIGS. 5A and 5B). For purposes of this disclosure, "integral" and "integrally" respectively mean a single piece and formed as a single piece. The distal end 108 of the inner piston 104 includes an external threaded portion 105 for connecting to a wellbore tool such as a plug setting sleeve 602 (FIG. 17) as discussed further below.

The sleeve distal end 124 of the outer sleeve 120 includes and transitions into a plug-setting sleeve connecting portion 127 of the outer sleeve 120. In the exemplary embodiment, the plug-setting sleeve connecting portion 127 is an integral portion of the outer sleeve 120 formed as an area of reduced diameter with an outer threaded portion 125 for being received within and connecting to a tool 102 such as a plug-setting sleeve 602 (FIG. 17) as discussed further below.

While the exemplary embodiments are being described for ease in understanding with reference to, e.g., connecting portions and connections between the single use setting tool 100 and particular wellbore tools such as the seal adapter 512 and the plug-setting sleeve 602, neither the use of the single use setting tool 100 nor the various connective components thereof is so limited. The single use setting tool 100 may be used or connected according to this disclosure with a variety of actuatable wellbore tools.

For purposes of this disclosure, relative terms such as "proximal end", "distal end", "portion" or "section" (of a component), and the like as used throughout this disclosure are used for aiding in the description of the various components and configurations of the exemplary embodiments and without limitation regarding, for example, points of delineation, separation, or arrangement or formation.

FIG. 1B illustrates a perspective, partial quarter-sectional view of the single use setting tool 100 for actuating the tool 102 in a wellbore. The inner piston 104 includes an intermediate section 110 positioned between the proximal end 106 and the distal rod 109 which extends to the distal end 108. The distal rod 109 is a portion of the inner piston 104 having an outer diameter D2 (FIG. 6) that is less than an outer diameter D4 (FIG. 6) of the intermediate section 110, as explained further below. The inner piston 104 may be formed as an integral component. The intermediate section 110 of the inner piston 104 has an annular wall 112 enclosing a cavity 114. The cavity 114 is configured to receive a power charge 116 therein. An initiator 118 may be wholly positioned in the proximal end 106 of the inner piston 104 adjacent the power charge 116. The initiator 118 is used to initiate combustion of the power charge 116 to form a combustion gas pressure inside the cavity 114.

Figure 2:
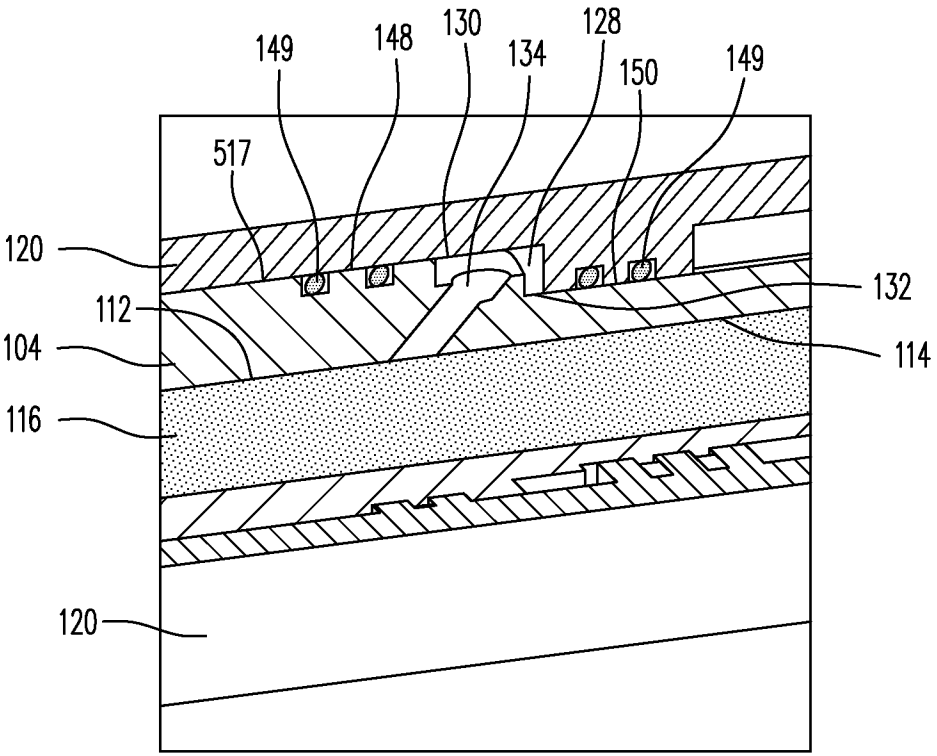
FIG. 2 is a detailed, quarter-sectional view of the single use setting tool of FIG. 1.

With continuing reference to FIGS. 1A and 1B, and further reference to FIG. 2, the outer sleeve 120 is configured to slideably receive the inner piston 104 within the central bore 126. A generally annular expansion chamber 128 may be defined by an inner portion 130 (FIG. 2) of the outer sleeve 120 and an outer portion 132 of the annular wall 112 of the inner piston 104. This generally annular expansion chamber 128 within the single use setting tool 100 is illustrated in greater detail in FIG. 2.

Turning once more to FIG. 2, a perspective, partial quarter-sectional detail view of a portion of the single use setting tool 100 is shown. The outer sleeve 120 is the outermost structure shown in FIG. 2 and the expansion chamber 128, according to an exemplary embodiment, is shown in detail. Also shown in detail in FIG. 2 is a gas diverter channel 134 extending through the annular wall 112 of the inner piston 104. The gas diverter channel 134 is configured to allow gas pressure communication between the cavity 114 containing the power charge 116 and the expansion chamber 128. Accordingly, in the circumstance where the combusting portion of the power charge 116 has an unimpeded gas pressure path to channel 134, the combustion gas will pass through the gas diverter channel 134 and into the expansion chamber 128. Increasing amounts of gaseous combustion products will increase the pressure in the cavity 114, the gas diverter channel 134 and the expansion chamber 128. The expansion chamber 128 is so named because it is adapted to expand in volume as a result of axial movement of the outer sleeve 120 relative to the inner piston 104. The increasing gas pressure in the expansion chamber 128 will exert an axial force on outer sleeve 120 and the inner piston 104, resulting in the outer sleeve 120 sliding axially toward the tool 102 and the expansion chamber 128 increasing in volume.

Referring again to FIG. 1B, the initiator 118 is configured for positioning in an initiator holder 138. Initiator 118 may be of the type described in U.S. Pat. No. 9,581,422 (previously mentioned), which is incorporated herein by reference in its entirety, and comprise an initiator head 146 and an initiator shell 136. The initiator shell 136 may contain an electronic circuit board (not shown) and, ignition element, e.g., a fuse head (not shown), capable of converting an electrical signal into a deflagration, pyrotechnical flame, or combustion, and an ignitable material (not shown) for being ignited by the ignition element. With reference to FIG. 5A showing an exemplary arrangement of the initiator 118 and the initiator holder 138 that may be provided in the exemplary embodiment of a single use setting tool 100 as shown in FIG. 1B, the initiator holder 138 includes an axial body portion 143 that defines a channel 137 extending axially through the initiator holder 138 and is configured for receiving the initiator shell 136 therein. The initiator holder 138 further includes an initiator holder head portion 145 which receives the initiator head portion 146 when the initiator 118 is inserted into the initiator holder 138. The initiator head 146 includes an electrically contactable line-in portion 147 through which electrical signals may be conveyed to the electronic circuit board of initiator 118.

The initiator holder 138 may be configured for positioning the initiator shell 136, and more particularly the ignitable material therein, adjacent the power charge 116 within the inner piston cavity 114. In an aspect, the initiator holder 138 may include fins 141 extending radially away from the axial body 143 of the initiator holder 138. The fins 141 secure and/or orient the initiator holder 138 within the inner piston cavity 114 by abutting the annular wall 112, and in certain exemplary embodiments the fins 141 may be fit within corresponding grooves or retaining structures (not shown) on the inner portion 130 of the outer sleeve 120. The energetic portion of initiator 118 is positioned sufficiently close to power charge 116 so as ignition thereof will initiate combustion of power charge 116. The material used to fabricate the initiator holder 138 may be a material, e.g., a polymer or a low-melting point solid material, that will be consumed, melted, fragmented, disintegrated, or otherwise degraded by initiation of the initiator 118 and/or combustion of power charge 116. In such an exemplary embodiment, combustion of the power charge 116 will consume, melt or otherwise degrade initiator holder 138 sufficiently such that initiator holder 138 will, essentially, be consumed during combustion of the power charge 116.

FIGS. 5A and 5B are cross-sectional, side views of proximal end 106 of inner piston 104 containing initiator 118 and initiator holder 138 prior to and after combustion of the power charge, respectively. The proximal end 106 of piston 104 is adapted, e.g., utilizing threads 508 and/or press fit/o-rings 510, to receive or otherwise have connected thereto the seal adapter 512 containing a bulkhead assembly 514. Seal adapter 512 is not a firing head because it does not house an igniter/initiator. Bulkhead assembly 514 may be of the type described in U.S. Pat. No. 9,605,937 and/or U.S. Patent Publication No. 2020/0032626 A1, each of which is commonly owned by DynaEnergetics Europe GmbH, which are incorporated herein by reference in their entirety. A proximal contact pin 518 of the bulkhead assembly 514 is adapted to receive electrical signals from the surface (or an upstream tool as the case may be), which signals are conveyed through the bulkhead assembly 514 to a distal contact pin 516. Once the seal adapter 512 is connected to the proximal end 106 of the setting tool 100, nothing may enter the setting tool 100 from the proximal end 106 other than the electrical signal conveyed by the bulkhead assembly 514. Thus, the bulkhead assembly 514 effectively isolates (e.g., from gas pressure, fluid, and the like) the setting tool 100 from an upstream gun or tool. The bulkhead assembly 514 also functions to align its distal contact pin 516 with the line-in electrical contact 147 of the initiator 118, thus conveying electrical signals from the surface (or upstream tool) to the initiator 118.

It should be noted that currently available setting tools have a separate firing head or firing head adapter in the position occupied in the present embodiment by the seal adapter 512 and the bulkhead assembly 514. A firing head is a device which includes a housing enclosing a variable configuration of elements for detonating an explosive charge. In the context of a setting tool, the 'explosive charge' may or may not really be explosive and, for that reason, is more likely to be referred to as a "power charge." The housing of a firing head for use with a setting tool would either be connected directly to a mandrel or connected to the mandrel via a firing head adapter. Either way, the firing head housing is connected in such a way that the element that begins the detonation is sufficiently close to the power charge. In an exemplary embodiment, the setting tool 100 does not require a firing head.

The differences between FIG. 5A and FIG. 5B illustrate a shot confirmation operation of the single use setting tool 100, in an exemplary embodiment. As illustrated in FIG. 5A, initiator holder 138 is present in the proximal end 106 of the single use setting tool 100 before initiation of power charge 116 and distal contact pin 516 of the bulkhead assembly 514 is in electrical contact with the line-in electrical contact 147 of initiator 118. FIG. 5B illustrates in a highly stylized fashion the proximal end 106 after initiation and combustion of the power charge 116. After initiation and during combustion of power charge 116, initiator holder 138 is degraded and substantially vanishes, allowing initiator 118 to drop to the bottom of the cavity 114 in inner piston 104. That is, the initiator 118 is no longer in electrical contact with the distal contact pin 516 of bulkhead assembly 514.

In an exemplary embodiment, the single use setting tool 100 may allow shot confirmation based on the initiator 118 having electrically disconnected from the distal contact pin 516 of the bulkhead 514. Absence of the connection between the initiator 118 and the distal contact pin 516 of the bulkhead 514 may indicate that initiation of the initiator 118 and/or combustion of the power charge 116 has successfully occurred. In current setting tools, the igniter may be destroyed to one extent or another by initiation of the igniter and/or the combustion of the power charge. However, an electronic circuit board of the igniter sometimes survives the ignition/burn and remains functional. Thus, electrical signals from the surface may be received and acknowledged by the circuitry of a spent igniter in current setting tools even after an effective ignition and/or combustion of its power charge. This circumstance presents a potentially dangerous misunderstanding and/or expensive false signal regarding whether or not the setting tool has actuated and whether a retrieved setting tool still has a live initiator. In the embodiment illustrated in FIGS. 5A and 5B, the disengagement of the distal contact pin 516 of the bulkhead 514 from the line-in portion 147 of initiator head 146 physically disconnects the electronic circuit board contained in initiator shell 136 completely from the electronic signals originating at the surface and relayed through the bulkhead 514 to the initiator 118. Thus, regardless of whether or not the electronic circuit board survives the initiation of the initiator 118 and/or combustion of the power charge 116, a false signal would not be detected at the surface controls. This is a shot confirmation operation that solves certain shortcomings in conventional setting tools. The shot confirmation is achieved by both electrical and mechanical disconnections.

Figure 3A:
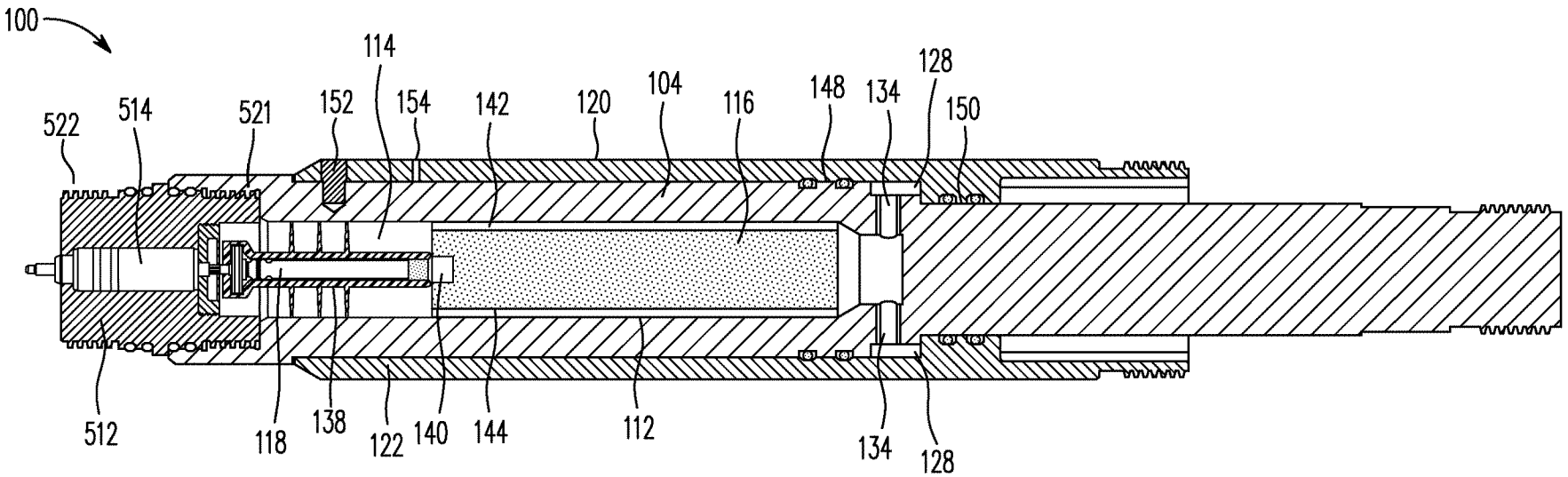
FIG. 3A is a side, cross-sectional view of the single use setting tool, according to an exemplary embodiment.

FIG. 3A is a side cross-sectional view of the single use setting tool 100, according to an exemplary embodiment. The single use setting tool 100 may also include one or more gas flow paths 142 (see also FIG. 16) disposed between an exterior surface 144 of the power charge 116 and the annular wall 112 of the inner piston 104 in a radial direction of the single use setting tool 100. The gas flow paths 142 may be embodied as a groove(s) formed in the exterior surface 144 of the power charge 116 (FIG. 3B), or as a groove(s) formed in the annular wall 112 (FIG. 3A) of the inner piston 104, or a combination of both. The one or more gas flow paths 142 may extend axially along a substantial length of the power charge 116. The gas flow path 142 is configured to allow gas pressure communication along an axial length of the power charge 116 and with the gas diverter channel 134. Typically, the power charge 116 combusts from the proximal end 116*a* (FIG. 7), adjacent the initiator 118, toward the distal end 116*b* (FIG. 7 and FIG. 7B), adjacent the gas diverter channel 134. However, the combustion of the power charge 116 is not limited directionally—for example, the power charge 116 may combust from the distal end 116*b* toward the proximal end 116*a*, such as described in U.S. Provisional Patent Application No. 62/853,824 file May 29, 2019, which is commonly owned by DynaEnergetics Europe GmbH and incorporated herein by reference, in its entirety.

In typical setting tools, no gas pressure path exists for the combustion gas produced from combustion of the power charge to reach the gas diverter channel. A time delay occurs before the combustion of the power charge opens up such a gas pressure path. The pressure built up in the chamber prior to access to the gas diverter channel being opened is delivered in a single pulse. Thus, current setting tools often have problems delivering a "slow set" or steady setting motion, i.e., a setting tool configured to provide force over a period of a few seconds instead of a few milliseconds. Thus, the favorable setting characteristics achievable with a slow set may be difficult or impossible to achieve with currently available setting tools.

In an exemplary embodiment, the gas flow path 142 provides an immediate or far earlier gas pressure path from the combusting proximal end of power charge 116 to the gas diverter channel 134. The gas flow path 142 prevents a large build-up of gas pressure in the cavity 114 that is blocked from reaching the gas diverter channel 134 by the unburned power charge 116. Thus, the current problem of pressure build-up being delivered as a single pulse may be avoided with the gas flow path 142. Rather, depending almost entirely on the combustion rate of the power charge 116, the axial force exerted on outer sleeve 120 may be increased relatively gradually, over the course of seconds, thus enabling a simple and economical means of achieving slow set delivery of force by the single use setting tool 100 on tool 102 (FIG. 1B).

Figure 3B:
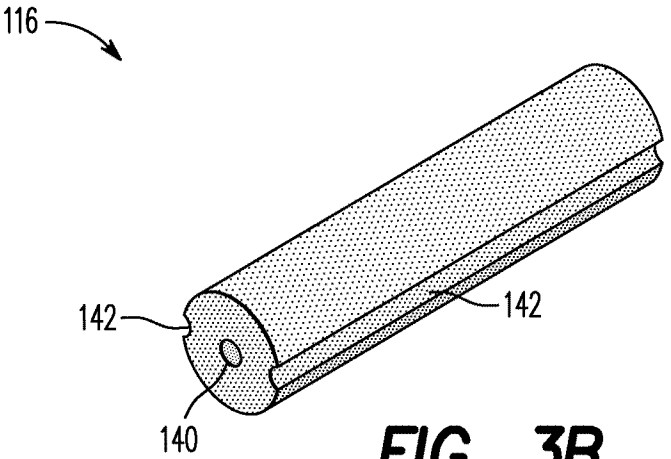
FIG. 3B is a perspective view of a power charge for use in the single use setting tool.

As illustrated in FIGS. 3A and 3B, the power charge 116 may include an indentation 140 adjacent the initiator 118 and/or initiator holder 138. By providing a slight offset between initiator 118 and the surface of power charge 116, the indentation 140 is configured to increase the reliability that the initiator 118 initiates the combustion of the power charge 116. Further, indentation 140 may be filled or lined with a booster charge (not shown), the chemical makeup of the booster charge being more sensitive to initiation than the chemical makeup of the power charge 116.

FIG. 3B is a perspective view illustrating the power charge 116, the gas flow path 142, and the indentation 140, according to an exemplary embodiment. As stated, the indentation or cylindrical recess 140 in the power charge 116 may provide igniter room to build a flame. In an exemplary embodiment, if there is not enough distance/stand-off between the igniter and the compound, the flame from the igniter may not have the opportunity to achieve a threshold level to initiate combustion of the power charge 116. In addition, the surface area increase resulting from the indentation 140 may aid ignition of the power charge 116.

The power charge of currently available reusable setting tools must be a separate unit, provided separately from the setting tool to enable the resetting of a 'spent' setting tool. According to an exemplary embodiment, the power charge 116 may be configured to be integral with and non-removable from the single use setting tool 100. This configuration has the potential to achieve cost savings in the construction and supply chain for setting tool 100.

The power charge 116 may include a combustible material selected from the following materials: black powder and a black powder substitute. The combustible material may also be selected from the following materials: Pyrodex, Goex Clear Shot, binding agents, wheat flour, potassium nitrate, sodium nitrate, epoxy resin, graphite powder, and Triple Seven.

In an exemplary embodiment, the initiator 118 may be configured to be inserted into the single use setting tool 100 at a wellsite immediately prior to the single use setting tool 100 being inserted into the wellbore.

Referring again to FIG. 2 and in an exemplary embodiment, a first seal 148 and a second seal 150 positioned at opposite ends of the expansion chamber 128 function to seal the expansion chamber 128. The first seal 148 and the second seal 150 may be configured for ensuring that the expansion chamber 128 remains gastight but without impairing the ability of the outer sleeve 120 to slide axially relative to the inner piston 104. In the exemplary embodiment shown in FIG. 2, the first seal 148 is positioned relative to the intermediate section 110 of the inner piston 104 and the inner portion 130 of the outer sleeve 120 and the second seal 150 is positioned relative to a sealing section 524 (FIG. 6) of the outer sleeve 120 and the distal rod 109 of the inner piston 104. Each of the first seal 148 and the second seal 150 may include one or more O-rings 149.

In an exemplary embodiment illustrated in FIG. 3A, the single use setting tool 100 may include a shear element 152 connected to the inner piston 104 and the outer sleeve 120. The shear element 152 may be configured to prevent premature axial sliding of the outer sleeve 120 relative to the inner piston 104. Shearing of the shear element 152 allows the axial sliding of the outer sleeve 120 relative to the inner piston 104 subsequent to the formation of the combustion gas in the expansion chamber 128 exceeding a threshold pressure. That is, once the gas pressure in expansion chamber 128 reaches a threshold pressure, the force pushing axially against outer sleeve 120 will cause the shear pin 152 to shear. The outer sleeve 120 will then be free to move axially relative to inner piston 104.

The single use setting tool 100, in an exemplary embodiment, may also include a pressure vent 154 as illustrated in FIG. 3A. The pressure vent 154 may extend through the outer sleeve 120 adjacent the piston proximal end 122. The pressure vent 154 may be configured to release the combustion gas pressure in the expansion chamber 128 subsequent to the axial sliding of the outer sleeve 120 along a sufficient axial distance relative to the inner piston 104. The sufficient axial distance may include a distance sufficient for outer sleeve 120 to exert a desired force on the tool 102 in the wellbore over a desired distance. For example, movement of the outer sleeve 120 a particular distance results in the pressure vent 154 passing over the first seal 148 portion. Once the pressure vent 154 moves past the first seal 148, the gas pressure in the expansion chamber 128 may escape therefrom through the pressure vent 154. The venting of the gas pressure in the expansion chamber 128 quickly eliminates the axial force being exerted on the outer sleeve 120. Optionally, a bung (not shown) may be disposed in the pressure vent 154 to the prevent pressure vent 154 from being a route for contaminants to enter the single use setting tool 100. The bung would be removed automatically by the pressure exerted through the pressure vent 154 when first exposed to the expansion chamber 128.

Figure 4:
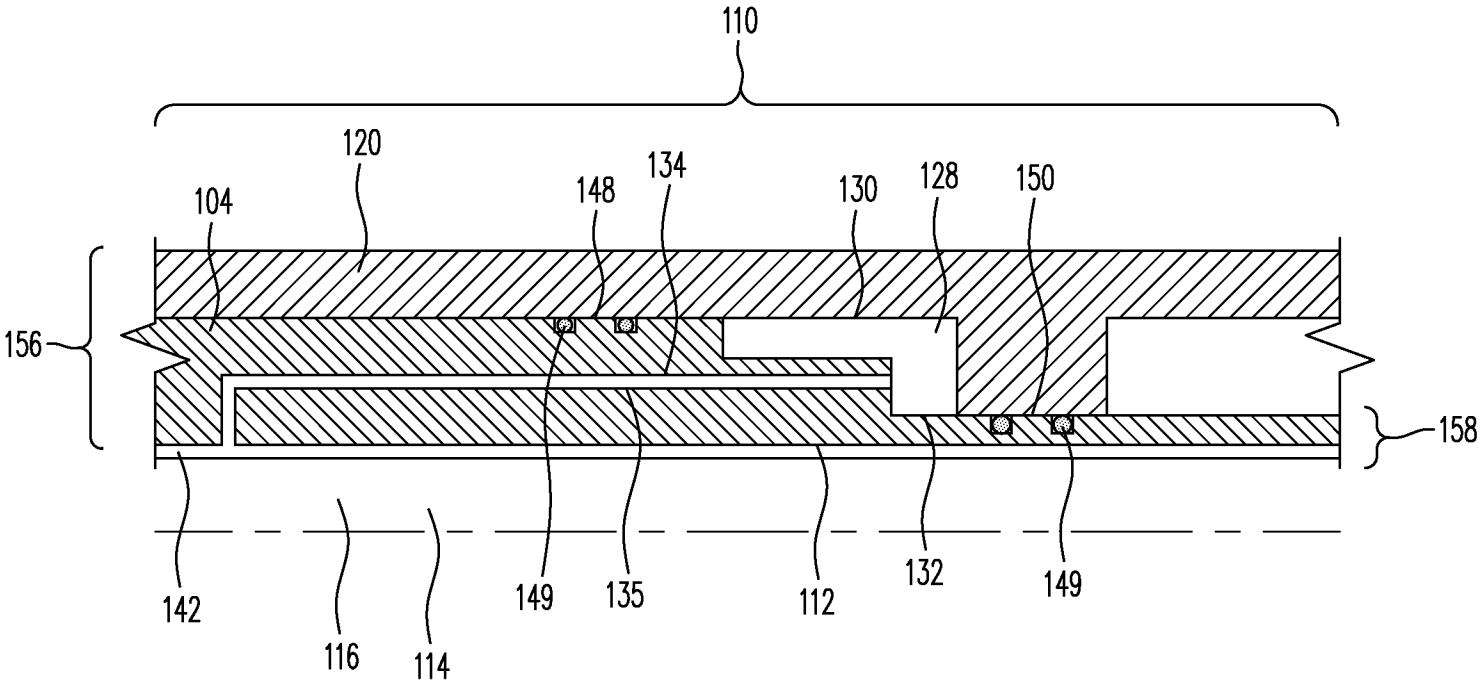
FIG. 4 is a detailed, cross-sectional view of a portion of the single use setting tool, according to an exemplary embodiment.

FIG. 4 is a cross-sectional, partial, magnified view of an expansion chamber 128 according to an exemplary embodiment. As with the expansion chamber 128 shown in FIG. 1 and FIG. 2, the expansion chamber 128 of FIG. 4 is generally annular and may be defined by the inner portion 130 of the outer sleeve 120 and the outer portion 132 of the annular wall 112 of the inner piston 104. Further, the assembly may also include a first seal 148 and a second seal 150 positioned at opposite ends of the expansion chamber 128 and augmented by O-rings 149. The gas diverter channel 135 extends a substantial distance along an axial direction of the inner piston 104 of the single use setting tool 100. The effect of one or more such axially extending gas diverter channels 135 is very similar to the effect of the gas flow path 142 in FIG. 3A. That is, the pressurized gas developed by the combustion of the power charge 116 is provided with a gas pressure path to the gas diverter channel 135 much earlier than in available setting tools. Thus, the current problem of pressure build-up being delivered as a single pulse may be avoided with the axially extending gas diverter channels 135. Rather, depending almost entirely of the combustion rate of the power charge 116, the axial force exerted on the outer sleeve 120 may be increased relatively gradually, over the course of seconds, thus enabling a simple and economical means of achieving slow set delivery of force by the outer sleeve 120 on the tool 102.

The single use setting tool 100 embodiment shown in FIG. 4 includes the inner piston intermediate section 110 that includes the annular wall 112, and the distal rod 109. In the exemplary embodiments shown in FIGS. 1B and 4, it is understood that the annular wall 112 of the inner piston 104 is an annular wall of both the intermediate section 110 and the distal rod 109 (see FIG. 1B) in the integral inner piston 104 piece. Accordingly, a portion of each of the cavity 114 and the power charge 116 may be enclosed by the annular wall 112 with respect to both the intermediate section 110 and the distal rod 109. The intermediate section 110 has a greater outside diameter D4 (FIG. 6) than the outside diameter D2 of the distal rod 109.

In an exemplary embodiment, the setting tool is single use. The choice of materials to be used in the setting tool is completely altered by the fact that the setting tool is for one-time use. Little to no consideration is given to wear and tear issues. Also, any engineering needed as part of resetting, i.e., re-dressing and refilling with consumed parts, is not required. Further, the setting device has fewer and simpler parts, i.e., going from tens of highly precise machined parts of high quality materials that need to function over and over again (in existing setting tools) to a one time use item of significantly fewer and less highly engineered parts. These factors result in a substantial reduction in unit cost. In addition, there is no requirement for maintenance and training as to reuse/re-dressing/refilling. The single use setting tool as disclosed herein is, compared to currently available setting tools, simpler, comprising fewer parts, far less expensive, works without a firing head, is single use and provides shot confirmation.

Figure 6:
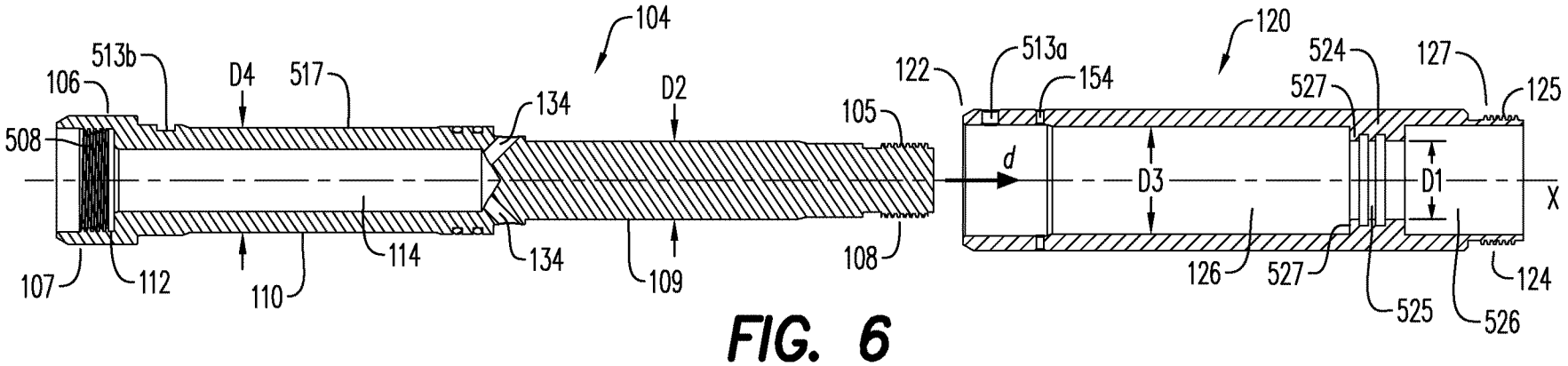
FIG. 6 is a breakout view of the two-piece, single use setting tool according to an exemplary embodiment.

With reference now to FIG. 6, the simplified two-piece design of an exemplary single use setting tool according to the disclosure, such as the single use setting tool 100 shown in FIGS. 1A and 1B, is shown in break-out fashion. For purposes of this disclosure, "two-piece design" refers generally to the inner piston 104 and the outer sleeve 120 (as shown in FIG. 6) being the two major structural components of the exemplary single use setting tool. Exemplary embodiments of a single use setting tool according to the disclosure obviate the need for a firing head and therefore allow the inner piston 104 to connect directly to a seal adapter 512, eliminating not only a firing head mechanism but adapters that many conventional setting tools require for connecting to a firing head.

The inner piston 104 and the outer sleeve 120 shown in FIG. 6 are substantially similar to the exemplary embodiments shown and described with reference to FIGS. 1A-2. However, the exemplary embodiment of the inner piston 104 shown in FIG. 6 includes first and second gas diverter channels 134 in communication with a free volume portion 523 (FIG. 7) of the cavity 114 within the inner piston 104, as described further below.

While not necessarily indicative or limiting of a method for manufacturing or assembling a single use setting tool according to this disclosure and to aid in understanding the relationship between components, inner piston 104 may be inserted distal end 108 first in a direction d into the central bore 126 of the outer sleeve 120. As previously discussed, the inner piston 104 and the outer sleeve 120 including the central bore 126 are, in an exemplary embodiment, cylindrically shaped and configured to fit together coaxially about an axis x. Accordingly, a passage 525 through the sealing section 524 of the outer sleeve 120 may have a diameter D1 that is sufficient for allowing the distal end 108 and the distal rod 109, having a diameter D2, to be received through the passage 525 from the central bore 126 to a distal bore 526 of the outer sleeve 120 while still forming the second seal 150. The central bore 126 of the outer sleeve 120 may have a diameter D3 for receiving the intermediate section 110, having a diameter D4, of the inner piston 104 while still forming the first seal 148. The diameter D3 of the central bore 126 and the diameter D4 of the intermediate section 110 of the inner piston 104 are each greater than the diameter D1 of the passage 525 through the sealing section 524, due to a protrusive shoulder 527 that extends inward from the inner portion 130 of the outer sleeve 120 as part of the sealing section 524. This configuration in certain exemplary embodiments, for example as shown and described with respect to FIG. 2, defines in part the expansion chamber 128 of the setting tool 100.

The outer sleeve 120 includes a shear element aperture 513*a* extending from an outer surface 125 of the outer sleeve 120 to the central bore 126 and the inner piston 104 includes a shear element notch 513*b* in an outer surface 517 of the inner piston 104. The shear element aperture 513*a* is aligned with the shear element notch 513*b* when the inner piston 104 is positioned within the central bore 126. The shear element aperture 513*a* and the seal element notch 513*b* are together configured for receiving the shear element 152 that extends between and is positioned within each of the shear element aperture 513*a* and the shear element notch 513*b* to secure the inner piston 104 within the central bore 126.

Figure 7:
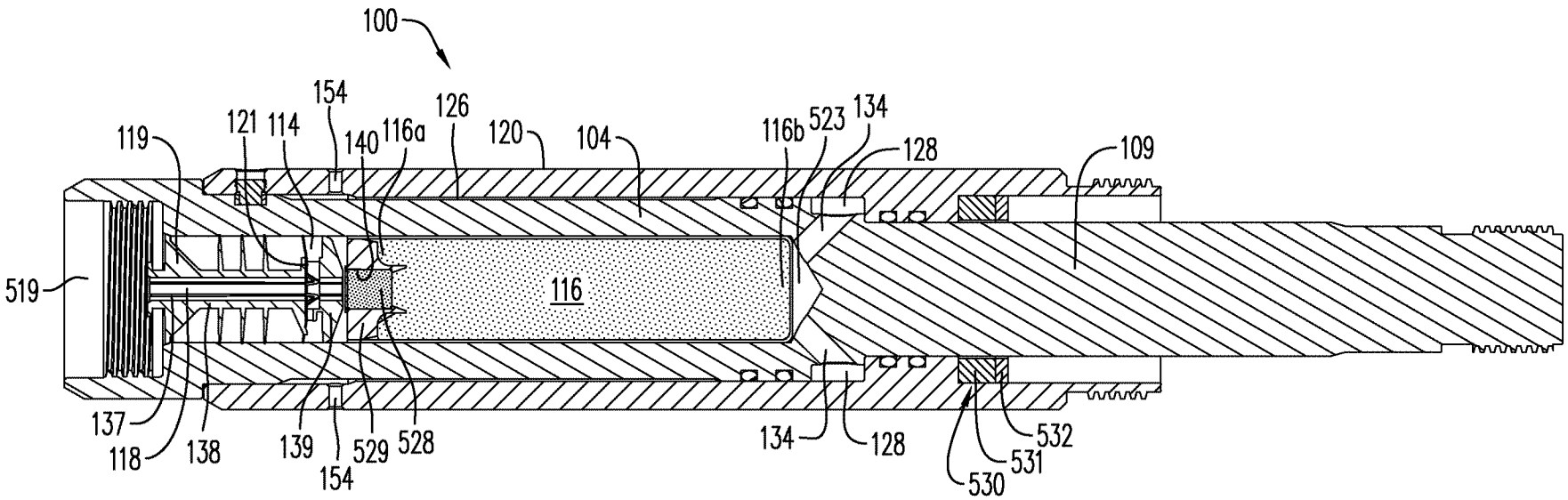
FIG. 7 is a cross sectional view of a single use setting tool including a shock absorbing assembly according to an exemplary embodiment.
Figure 7A:
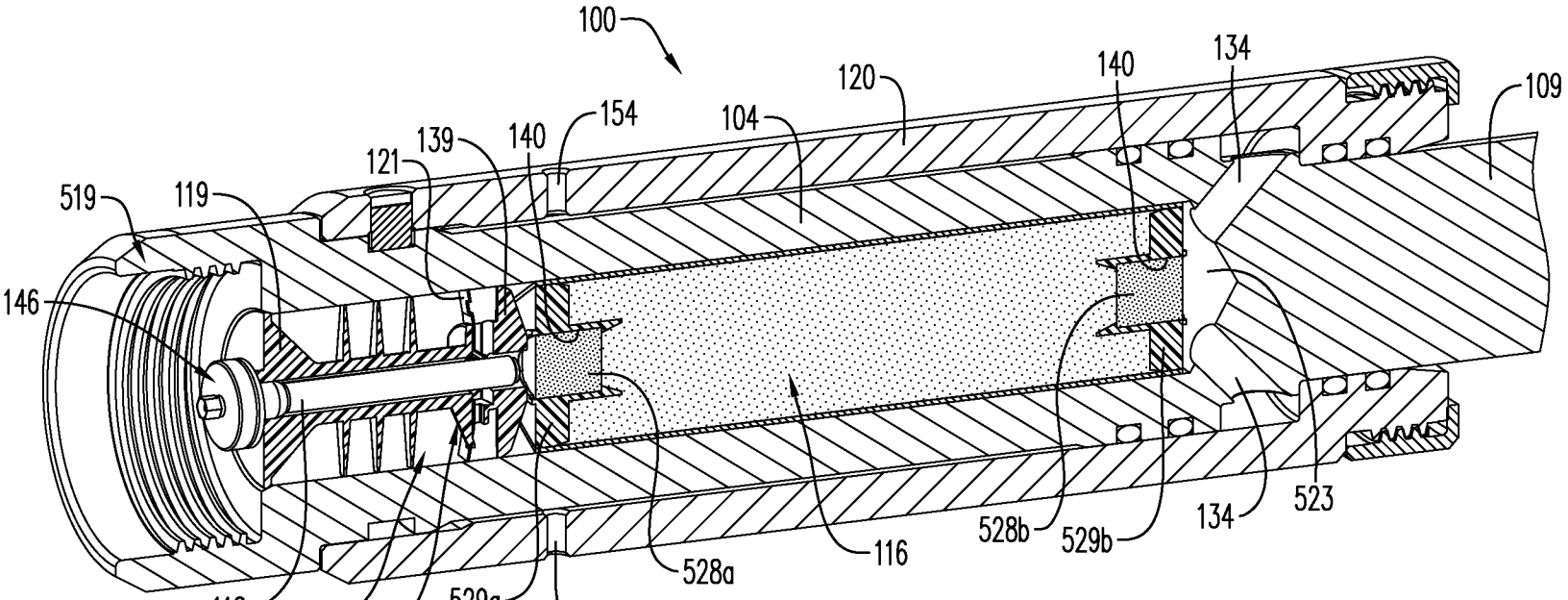
FIG. 7A is a cross sectional view of a single use setting tool including a bi-directional gas-generating power charge, according to an exemplary embodiment.

With reference now to FIG. 7 and FIG. 7A, an exemplary embodiment of a single use setting tool 100 according to the disclosure may include a configuration substantially as previously described with respect to FIGS. 1A-2, including an outer sleeve 120 and an inner piston 104 positioned within central bore 126 of the outer sleeve 120. The inner piston 104 may include a cavity 114 and a power charge 116 positioned within the cavity 114 as previously discussed. First and second pressure vents 154 extend through the outer sleeve 120 into the inner bore 126 for venting excess pressure from consumption of the power charge 116, as previously discussed. In the exemplary embodiment that FIG. 7 shows, a free volume portion 523 exists within the cavity 114 between a distal end 116*b* of the power charge 116 and the first and second gas diverter channels 134, which are open to each of the cavity 114 and a gas expansion chamber 128 for actuating the outer sleeve 120 and the inner piston 104 to slide axially relative to one another.

The initiator holder 138 is positioned at least in part within the inner piston cavity 114 and receives and retains the initiator 118 therein. The initiator holder 138 is positioned to receive and retain the initiator 118 substantially coaxially with the seal adapter portion 107 and the inner piston cavity 114. In an exemplary embodiment, such as shown in FIG. 7 and FIG. 7A and with reference back to FIGS. 5A and 5B, the initiator 118 and/or the initiator holder 138 may be positioned such that a portion of the initiator 118 and/or the initiator holder 138, such as the initiator head 146 and/or the line-in portion 147 of the initiator 118, may extend into the seal adapter portion 107 of the inner piston 104; in particular, an open interior area 519 of the seal adapter portion 107. In other exemplary embodiments, the initiator 118 and the initiator holder 138 may be positioned entirely within the inner piston cavity 114.

The initiator holder 138 may include a coupling end 139 adjacent to the power charge 116, for robustly securing the initiator 118 in position for initiating the power charge 116 and keeping pressure contained between the coupling end 139 and the gas diverter channels 134 during consumption of the power charge 116, for example after the initiator holder 138 has been degraded according to embodiments including a shot confirmation as previously discussed. The initiator holder 138 may include a fluted section 119 opposite the coupling end 139. The fluted section 119 may provide both a wider profile for helping to orient and center the initiator holder 138 within the inner piston cavity 114 and an enlarged surface against which the seal adapter 512 may abut when it is inserted in the seal adapter portion 107.

In a further aspect, the initiator holder 138 may include a ground bar connection 121 that may electrically contact and ground, e.g., the shell 136 of the initiator 118 to the annular wall 112 of the inner piston 104.

The exemplary embodiment that FIG. 7 shows includes a shock absorbing assembly 530. The shock absorbing assembly 530 dampens shock that may be generated upon actuation of a wellbore tool by the single use setting tool 100. In particular, but without limitation, when the single use setting tool 100 is used with the plug setting sleeve 602 and the plug 603 (as discussed below), separation of the plug 603 from the plug setting sleeve 602 results in a substantial amount of shock, as explained further below, that may damage or reduce the lifetime of the reusable setting sleeve 602 and/or a setting sleeve mandrel 610 (FIG. 18) component thereof. Excessive shock is known to occur when single use setting tools are used, because single use setting tools do not contain, e.g., oil cushions that are provided but must be refilled/replaced in reusable setting tools.

The shock absorbing assembly 530 in the exemplary embodiment of FIG. 7 includes a shock dampener 531 and a rigid retainer 532. The shock dampener 531 in the exemplary embodiment is a cushioning component that may be formed from, without limitation, a polymer or plastic. In an aspect, the shock dampener 531 may be cylindrical pad. The rigid retainer 532 holds the shock dampener 531 in place and is also a stabilizing and shock-distributing component that may be formed from metal or any known material consistent with this disclosure. In an aspect, the rigid retainer 532 may be, without limitation, a retaining ring such as a steel ring, a c-clip, or the like. Each of the shock dampener 531 and the rigid retainer 532 in the exemplary embodiment is formed such that the distal rod 109 of the inner piston 104 may pass through them—for example, the shock dampener 531 and the rigid retainer 532 may be annular elements through which the distal rod 109 passes.

Figure 7B:
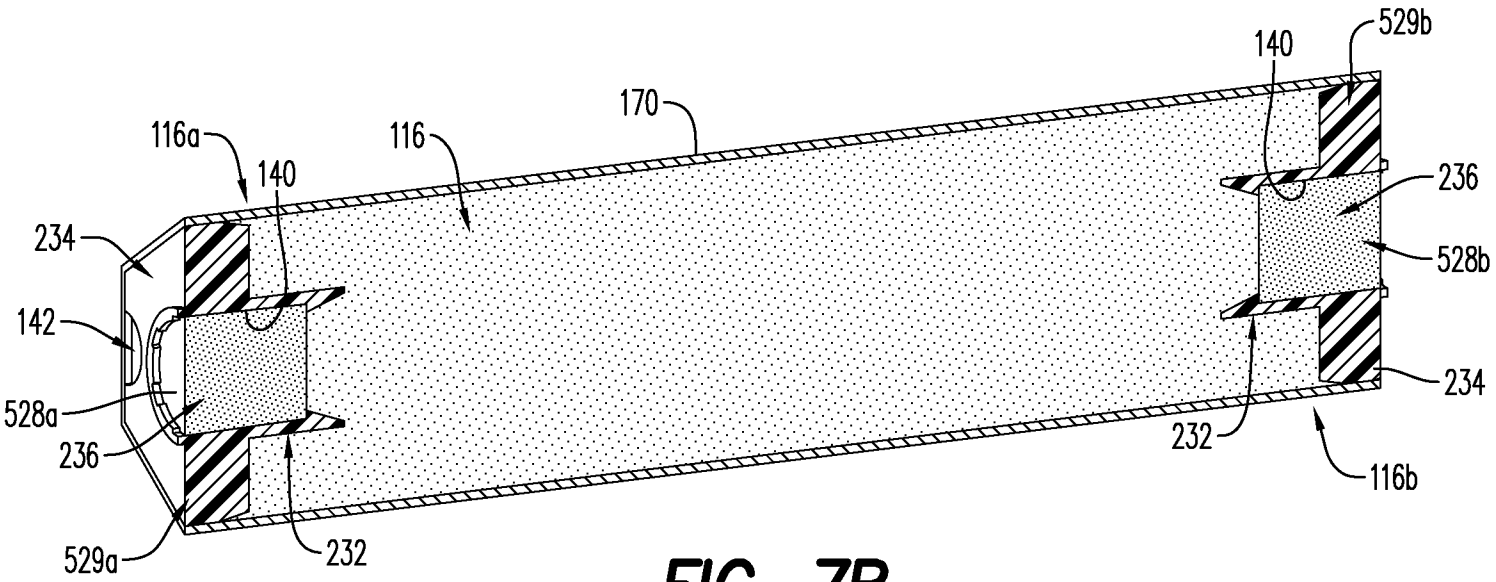
FIG. 7B is a cross-sectional view of the bi-directional gas-generating power charge of FIG. 7A
Figure 7C:
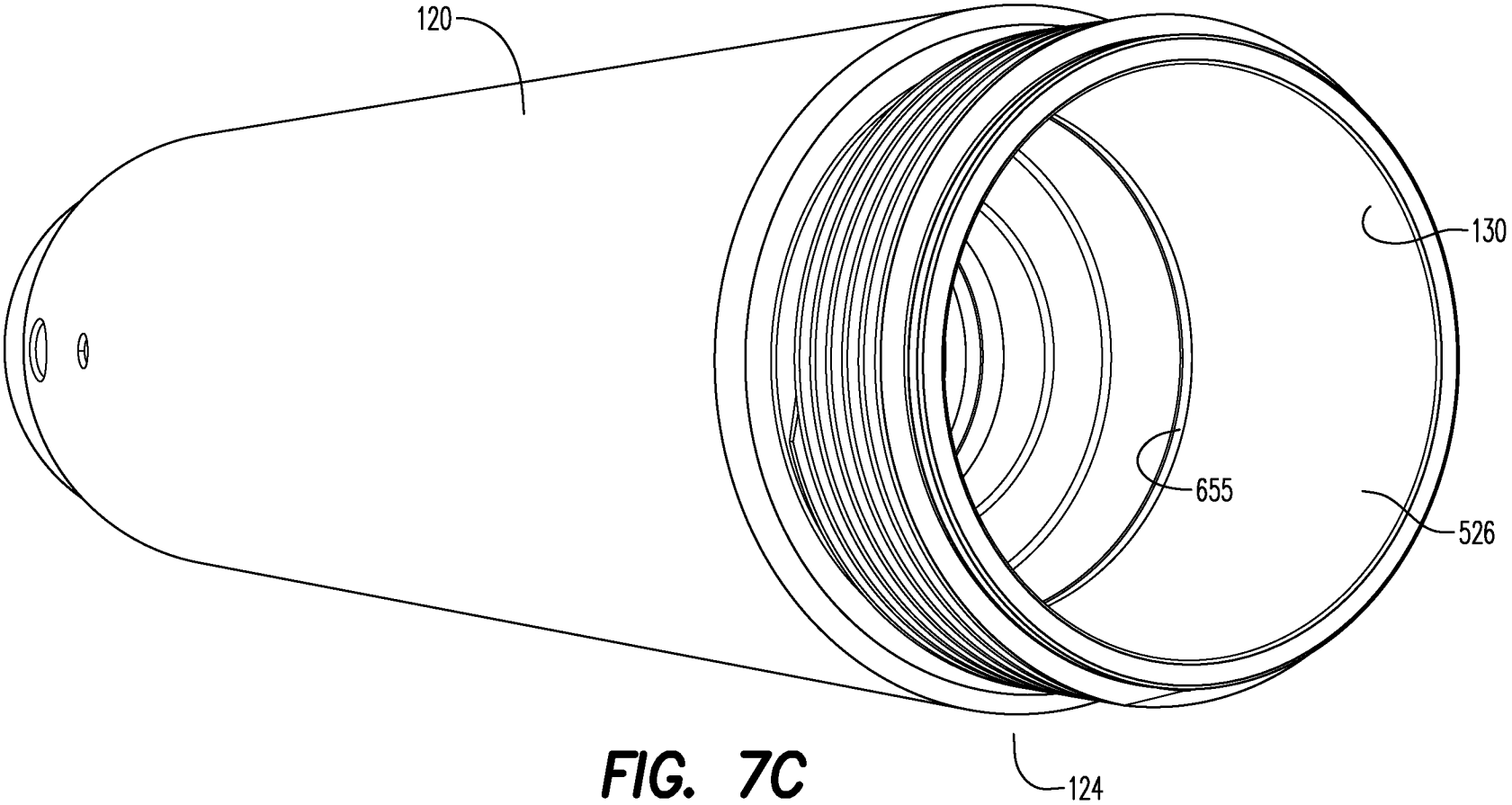
FIG. 7C is a perspective view of an outer sleeve for a single use setting tool according to an exemplary embodiment.
Figure 8:
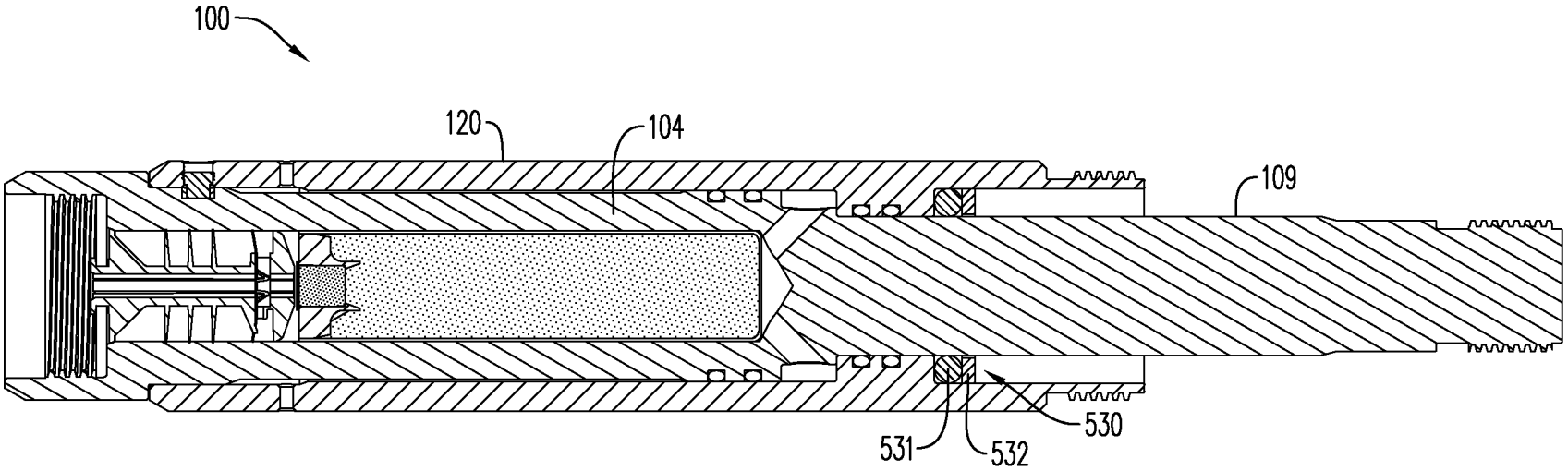
FIG. 8 is a cross sectional view of a single use setting tool including a shock absorbing assembly according to an exemplary embodiment.

With reference now to FIG. 7C, a perspective view of an exemplary outer sleeve 120 for use with a single use setting tool 100 according to, e.g., the exemplary embodiments shown in FIGS. 7 and 8 is shown from the distal end 124 of the outer sleeve 120. In an aspect, the exemplary outer sleeve 120 may include a retaining ring groove 655 formed in the inner portion 130 of the outer sleeve 120 and positioned within the distal bore 526 of the outer sleeve 120. The retaining ring groove 655 may position and hold the rigid retainer 532 in place. Accordingly, the shock absorber assembly 530 will remain in place relative to the outer sleeve 120 as the outer sleeve 120 strokes over the inner piston 104.

With reference now to FIG. 8, the exemplary single use setting tool 100 as described with respect to FIG. 7 is shown with an alternative exemplary embodiment of the shock absorbing assembly 530. In the exemplary embodiment shown in FIG. 8, the shock dampener 531 is an o-ring and the rigid retainer is a steel ring 532 according to the same purposes and principles as described with respect to FIG. 7.

The shock absorbing assembly 530 has been described according to certain exemplary embodiments but is not limited thereto and may include various materials, components, and configurations consistent with the disclosure.

Figure 9:
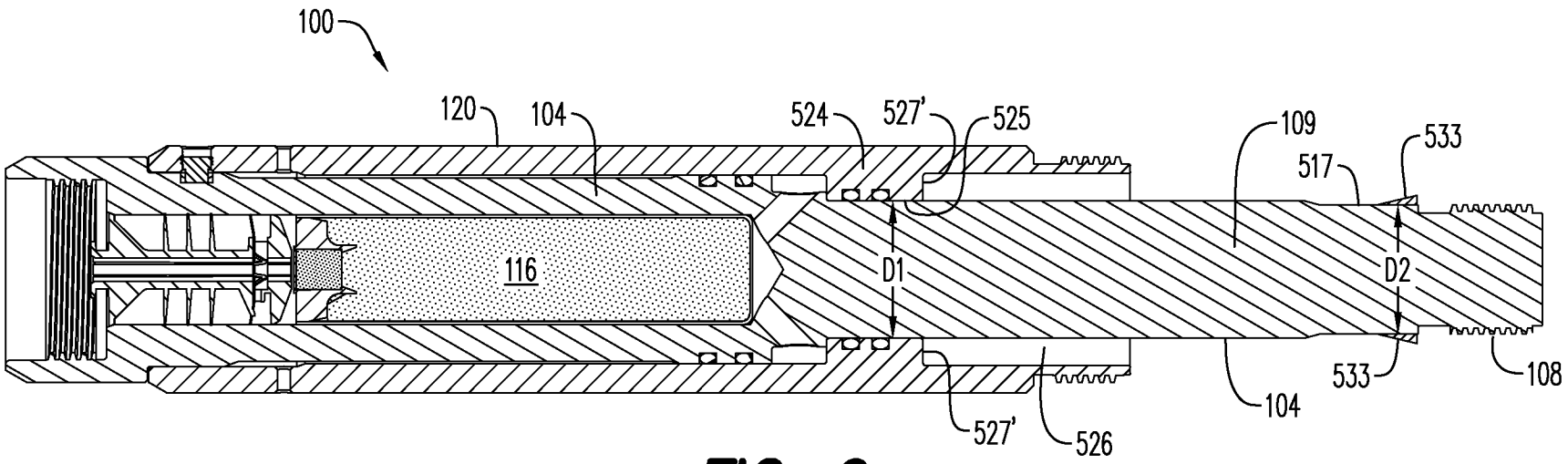
FIG. 9 is a cross sectional view of a single use setting tool including a stroke limiting wedge according to an exemplary embodiment.

With reference now to FIG. 9, the exemplary single use setting tool 100 as described with respect to FIG. 7 is shown excepting the shock absorbing assembly 530. In the exemplary embodiment shown in FIG. 9, the distal rod 109 portion of the inner piston 104 includes one or more wedges 533 that may be, without limitation, discrete features on the outer surface 517 of the inner piston 104 or a continuous feature about its periphery. The one or more wedges 533 may be integrally formed or machined as part of the inner piston 104 or may be formed or attached thereto according to any known technique consistent with this disclosure. The wedge 533 may be made from any material consistent with a particular application. In certain exemplary embodiments, the wedge 533 may be made from a relatively soft material such as, without limitation, plastic, composite, and the like, to serve as a brake and a shock absorber for the outer sleeve 120 in use as it strokes over the inner piston 104 as explained further below. For ease of reference in the disclosure, the singular term wedge 533 may include the one more wedges as described.

In the exemplary embodiment of FIG. 9, the wedge 533 is an annular and wedge-shaped attachment that is attached to the distal rod 109 portion of the inner piston 104. The wedge 533 in the exemplary embodiment may be made of plastic and/or composite. The wedge 533 extends away from the outer surface 517 of the inner piston 104, e.g., at a position on the distal rod 109, such that the diameter D2 of the distal rod 109 at the position of the wedge 533, plus the length to which the wedge 533 extends away from the outer surface 517 of the distal rod 109, is greater than the diameter D1 of the passage 525 through the sealing section 524 of the outer sleeve 120. Accordingly, when outer sleeve 120 slides axially relative to the inner piston 104 during use as discussed above and explained further below, wedge 533 will contact a protrusive shoulder 527' of the sealing section 524 of the outer sleeve 120 and prevent further movement of the outer sleeve 120 relative to the inner piston 104. This limits the stroke length of the outer sleeve 120 to a length at which the wedge 533 engages the shoulder 527' and prevents further movement of the outer sleeve 120. Reducing the stroke length of the outer sleeve 120 may be beneficial for reducing the amount of shock generated during detachment of the actuated tool because reducing the stroke length reduces the amount of distance along which the inner piston 104 can relatively accelerate into the distal bore 526 of the outer sleeve 120 (FIGS. 9A and 9B).

Figure 9B:
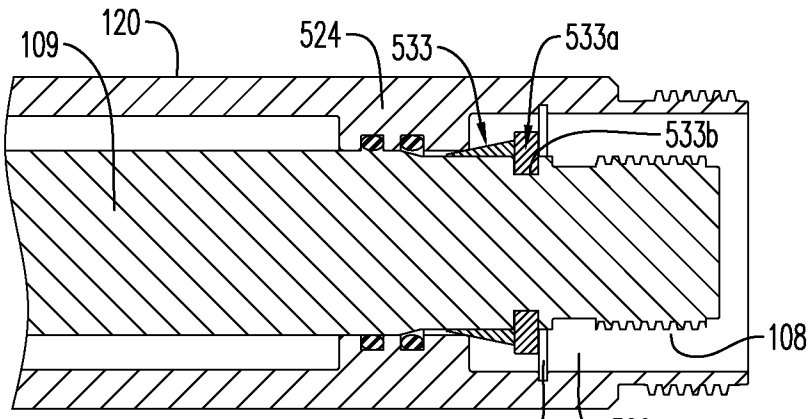
FIG. 9B is a cross sectional view of a single use setting tool at end of stroke including a stroke limiting wedge with retainer according to an exemplary embodiment.
Figure 9A:
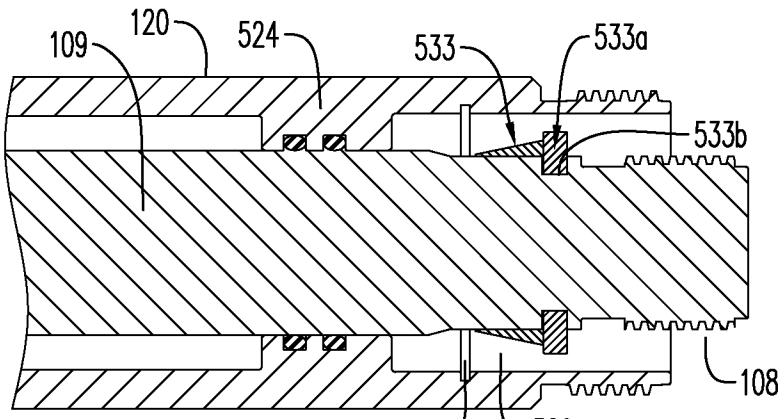
FIG. 9A is a cross sectional view of a single use setting tool at mid-stroke including a stroke limiting wedge with retainer according to an exemplary embodiment.
Figure 10:
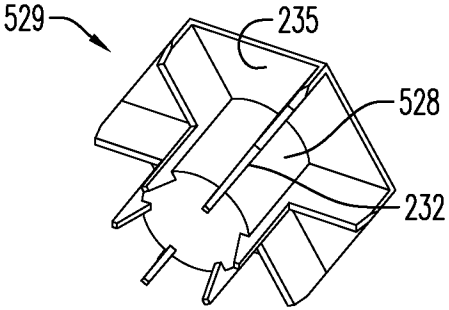
FIG. 10 is a bottom perspective view of a booster holder according to an exemplary embodiment.
Figure 11:
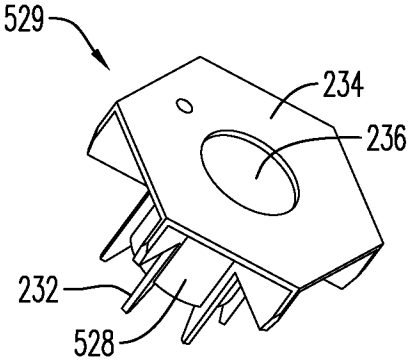
FIG. 11 is a top perspective view of the booster holder of FIG. 10.
Figure 12:
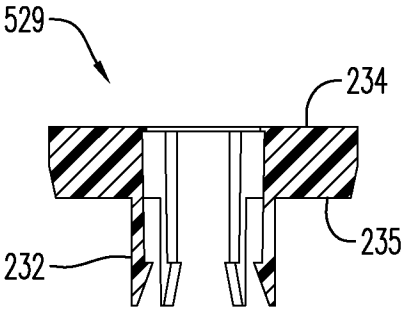
FIG. 12 is a side view of the booster holder of FIG. 10.
Figure 13:
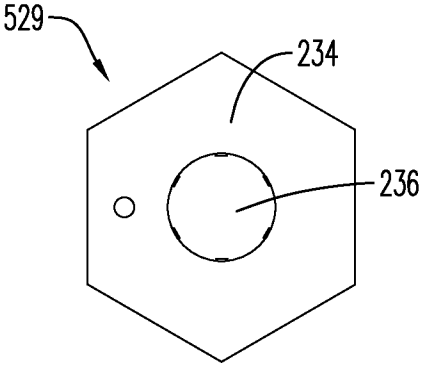
FIG. 13 is a top plan view of the booster holder of FIG. 10.

With reference now to FIGS. 9A and 9B, cross sectional views around the sealing section 524 of the outer sleeve 120 of an exemplary single use setting tool 100 similar to that shown in FIG. 9 are shown as when the outer sleeve 120 is in mid-stroke (FIG. 9A) and at the end of the stroke (FIG. 9B). In mid-stroke, the wedge 533 has not yet contacted the protrusive shoulder 527' and the outer sleeve 120 continues to stroke. At the end of the stroke, the wedge 533 has contacted the protrusive shoulder 527' and a portion of the wedge 533 is compressed between the inner piston 104 and the sealing section 524, within the passage 525 through the sealing section 524.

In addition to the features shown in FIG. 9, the exemplary embodiments shown in FIGS. 9A and 9B include a wedge retaining ring 533*a* for keeping the wedge 533 from sliding off of the inner piston 104, particularly after the wedge 533 contacts the protrusive shoulder 527'. The wedge retaining ring 533*a* is retained in a wedge retaining ring groove 533*b* that is formed in the outer surface 517 of the inner piston 104. FIGS. 9A and 9B also show the retaining ring groove 655 for the retaining ring 532 portion of the shock absorber assembly 530 shown and described with respect to FIGS. 7 and 8. The exemplary embodiments shown in FIGS. 9-9B may be used in conjunction with the shock absorbing assembly 530. In such embodiments, the wedge 533 will prevent further stroking of the outer sleeve 120 when it jams against the shock absorbing assembly 530.

With reference again to FIG. 7, FIG. 7A and FIG. 7B, the power charge 116 in the exemplary embodiment shown in FIG. 7, FIG. 7A, and FIG. 7B includes the indentation 140 at a proximal end 116*a* of the power charge 116. A booster 528, 528*a*, 528*b* is positioned within the indentation 140 in sufficient proximity to the initiator 118 such that initiation of the initiator 118 will initiate the booster 528, 528*a*, 528*b* to release additional energy. Boosters are well-known in the art and the booster 528, 528*a*, 528*b* may be any known booster, including charges, energetic materials, or chemically reactive materials. The booster 528, 528*a*, 528*b* may be larger and release more energy than an ignition source in the initiator 118. The booster 528, 528*a*, 528*b* may improve the efficiency and/or reliability of igniting the power charge by providing an additional energy source against additional surface area of the power charge 116.

In certain exemplary embodiments, the booster 528, 528*a*, 528*b* is a booster pellet made from energetic material.

In the exemplary embodiments of FIG. 7 and FIG. 7A, the booster 528, 528*a*, 528*b* is positioned and held in place by a booster holder 529, 529*a*, 529*b*. The booster holder 529, 529*a*, 529*b* is positioned between the initiator 118 and the power charge 116 and is configured for receiving and positioning the booster 528, 528*a*, 528*b* within the indentation 140 of the power charge 116.

According to an aspect and as illustrated in FIG. 7A and FIG. 7B, the booster 528*a* is a first booster and the booster holder 529*a* is a first booster holder. The power charge 116 includes a second booster 528*b*, which may be configured substantially as described hereinabove and illustrated in FIG. 7, thus for purposes of convenience and not limitation, the details of the second booster 528*b* are not repeated hereinbelow.

As illustrated in FIG. 7A, the first and second boosters 528*a*, 528*b*, and their corresponding booster holders 529*a*, 529*b*, may be positioned within the cavity 114 of the inner piston 104, such that it is in frictional engagement with a container 170 (described in further detail hereinbelow) (FIG. 7B and FIGS. 14-15) housed in the annular wall 112 of the cavity 114. The second booster 528*b* is positioned toward the distal end 116*b* of the power charge 116 and is spaced apart from the first booster 528*a* (positioned at the proximal end 116*a* of the power charge 116). As described hereinabove, the second booster 528*b* may be configured to release more energy than the ignition source in the initiator 118 and may improve the efficiency and/or reliability of igniting the power charge 116 by providing an additional energy source against additional surface area of the power charge 116. The second booster 528*b* is secured in the second booster holder 529*b* and positioned such that it is in line with the free volume portion 523 of the cavity 114 within the inner piston 104.

The exemplary power charge 116 including the first booster 528*a* and the second booster 528*b* as shown in FIGS. 7A and 7B can be installed in either direction within the cavity 114 of the inner piston 104. A booster 528*a*, 528*b* will be adjacent the initiator 118 whether the power charge 116 is inserted into the cavity 114 proximal-end 116*a* first (i.e., nearest to the gas diverter channels 134) or the distal-end 116*b* first. This prevents installing a power charge in the wrong direction (i.e., "backwards"), that is, with a single booster adjacent only the distal end 116*b* and no booster adjacent the initiator 118. Accordingly, the exemplary power charge 116 including the first booster 528*a* and the second booster 528*b* as shown in FIGS. 7A and 7B may be positioned within the cavity 114 by, among other things, inserting, first, either the proximal end 116*a* or the distal end 116*b* of the power charge 116, into the cavity 114.

While the exemplary power charge 116 shown in FIGS. 7A and 7B (i.e., "bi-directional power charge 116") has been shown and described in exemplary use with a disposable setting tool, the disclosure is not so limited and the exemplary bi-directional power charge 116 including a first booster 528*a* and a second booster 528*b* positioned on opposite ends 116*a*, 116*b* of the power charge 116 may be similarly used with any known wellbore tools consistent with this disclosure. Further, the exemplary bi-directional power charge 116 is not limited to the shape, configuration, assembly of components, particular features, etc. as disclosed for use with the exemplary disposable setting tool 100, or otherwise. Variations to the exemplary bi-directional power charge 116 are possible within the spirit of this disclosure.

With reference to FIGS. 10-13, exemplary embodiments of the booster holders 529*a*, 529*b* (collectively referred to herein as booster holder 529) may include a booster receiver 232, a booster holder top 234 and an opening 236 in the booster holder top 234. The booster receiver 232 may extend from an underside 235 of booster holder top 234. The booster receiver 232 is sized to receive and retain a booster 528 of the type previously discussed—for example, a booster pellet in certain exemplary embodiments. The booster 528 may be of a material in which it is easier to begin deflagration/energetic release than the material in the power charge 116. Deflagration of the booster 528 releases sufficient energy sufficiently close to a portion of the power charge 116 that the energetic material of the power 116 begins a self-sustaining deflagration or consumption that causes generation of gas pressure according to the operation of the single use setting tool 100 as described throughout this disclosure. In an aspect, the power charge 116 may be disposed in a container 170 (FIG. 14) that protects and holds together the power charge 116.

Figure 15:
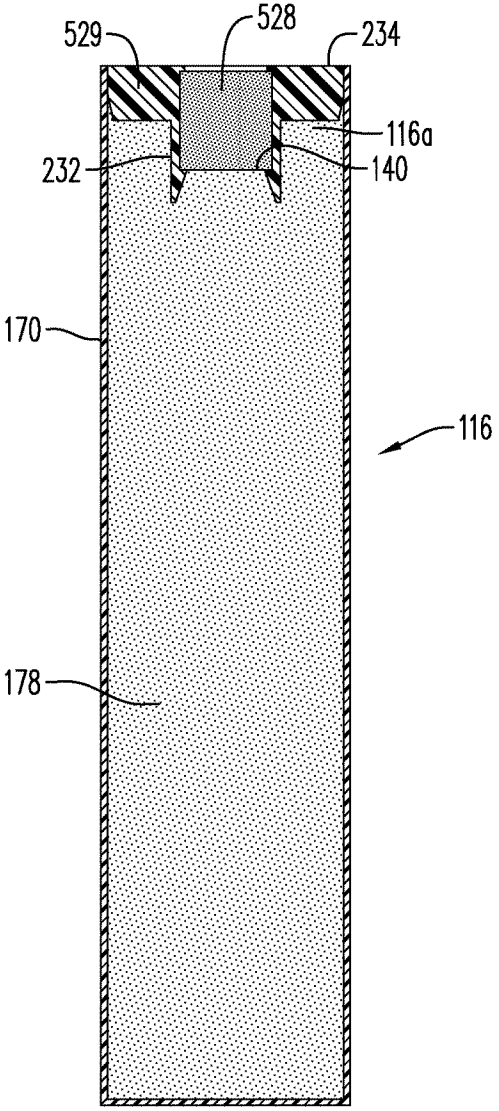
FIG. 15 is a cross sectional view of a power charge with a booster holder and booster pellet inserted therein, according to an exemplary embodiment.
Figure 14:
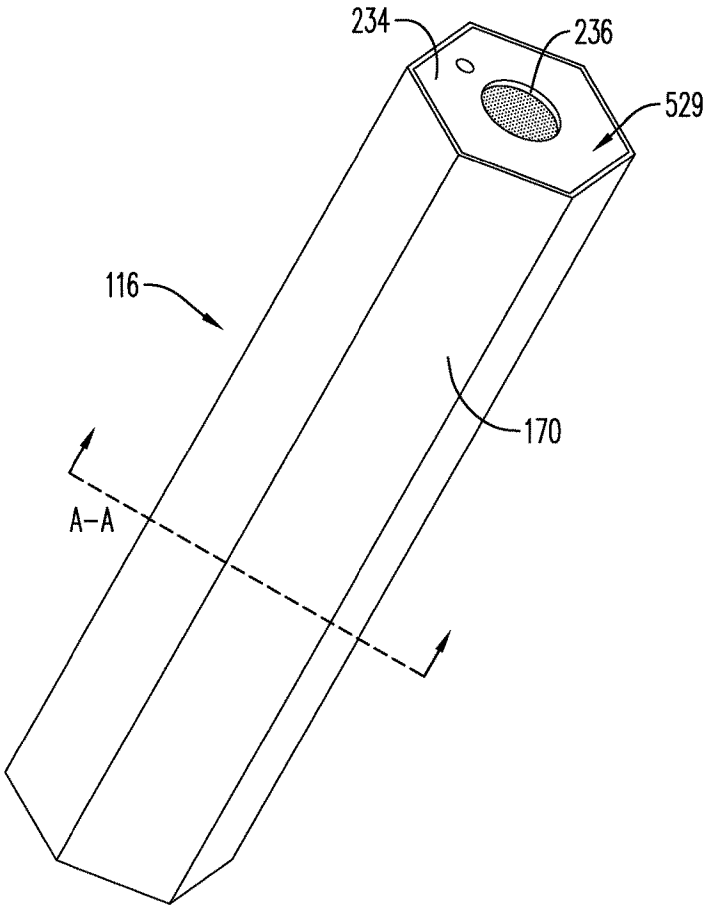
FIG. 14 is a perspective view of a hexagonally shaped power charge and container according to an exemplary embodiment.

With reference now to FIGS. 10-13, 14, and 15, in an exemplary embodiment the power charge 116 may be positioned within the container 170 and the booster holder 529 may be inserted into the power charge 116, e.g., within a body 178 of the power charge 116. In an aspect of the exemplary embodiment as shown in FIG. 15, the booster holder 529 may be completely surrounded, but for the booster holder top 234, by the energetic material of the power charge body 178. The booster holder 529 may be retained in place by engaging the power charge body 178 and/or the power charge container 170. In an exemplary embodiment and as shown in FIGS. 14 and 15, the booster holder top 234 may function as the top of the power charge container 170.

The material for the power charge container 170 may be rigid or semi-rigid so as to retain the desired power charge shape. Many polymers would be an appropriate choice for the container 170. Exemplary materials may be polypropylene (for standard applications) and polyamide (for high temperature applications). The material and dimensions of the container 170 are selected such that the container 170 will melt or otherwise break-down quickly when exposed to the energy (heat and pressure) generated by combustion of the power charge 116. Thus, the container 170 will not impede pressurized gas generated by the power charge 116 from accessing the gas diverter channels 134.

The booster holder 529 functions to retain the booster 528 in close proximity to the power charge body 178, i.e., the energetic material, at a proximal end 116*a* of the power charge 116. In an aspect of the exemplary embodiments, the power charge 116 having a booster holder 529 according to FIGS. 14 and 15 may be positioned in the cavity 114 of the inner piston 104 of the single use setting tool 100 such that the initiator 118 is adjacent the booster holder 529. Specifically, the ignition source of the initiator 118 may be adjacent and/or aligned with the opening 236 through the booster holder top 234 and thereby with the booster 528 in the booster receiver 232 of the booster holder 529. The exemplary arrangement may enhance reliability and efficiency for causing deflagration (i.e., ignition) of the power charge 116.

Figure 16:
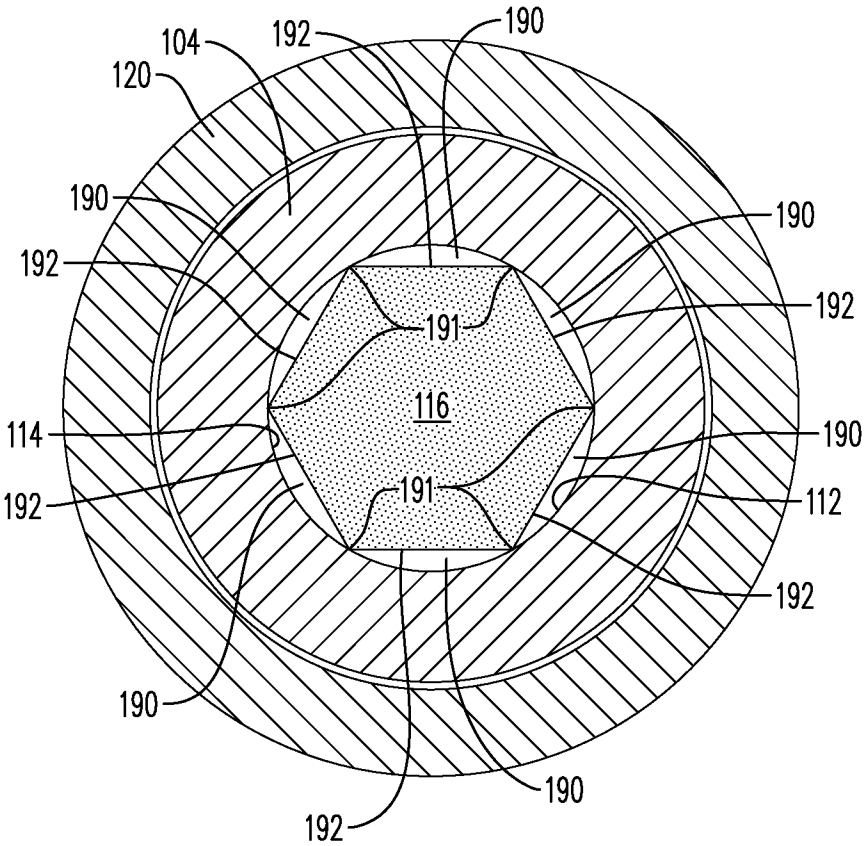
FIG. 16 is a cross-sectional view of a hexagonally shaped power charge positioned within a cavity of an inner piston of a single use setting tool according to an exemplary embodiment.

With continuing reference to FIGS. 14 and 15, and further reference to FIG. 16, in an aspect of the exemplary embodiments, the power charge 116 (and the container 170 in embodiments including the container 170) has, without limitation, a hexagonally-shaped transverse cross-section along, e.g., line A-A in FIG. 14. For the purposes of this disclosure, the phrase "hexagonally-shaped power charge" may refer to a power charge having a hexagonally-shaped transverse cross-section. In FIG. 16, the cross-sectional view of the hexagonally-shaped power charge 116 is shown as it would be received in the cavity 114 of the inner piston 104 according to the exemplary embodiments.

While FIG. 16 shows a hexagonally-shaped power charge 116, it will be understood that the power charge 116 is not limited to having a hexagonally-shaped transverse cross-section. The power charge 116 in various exemplary embodiments may have a cross-section according to any shape or configuration including, without limitation, polygonal, circular, symmetric or asymmetric, and the like, consistent with the disclosure.

As shown in FIG. 16, the power charge 116 is sized and shaped such that vertices 191 of the hexagonally-shaped power charge 116 within the cavity of the inner piston 104 are positioned to abut or contact the annular wall 112 of the cavity 114 to provide a secure fit of the power charge 116 within the cavity 114. Flat sides 192 of the hexagonally-shaped power charge 116 (i.e., radial outer surfaces of the hexagonally-shaped power charge) are thereby spaced apart from the annular wall 112, creating gas flow channels 190 that extend axially along the length of the cavity 114. Expanding combustion gas resulting from the combustion of the power charge 116 is able to flow into and axially through these gas flow channels 190 to the gas diverter channels 134 and the expansion chamber 128 of the single use setting tool 100, especially during early stages of combusting the power charge 116. The size, shaped, and configuration of the power charge 116 may be varied to provide gas flow channels 190 with a particular volume for achieving a desired speed at which axial movement between the outer sleeve 120 and the inner piston 104 occurs and progresses, based on the speed and volume at which the combustion gases will reach the expansion chamber 128. For example, slow-set setting tools in which the setting takes place relatively gradually as opposed to abruptly may be preferable for actuating a tool against a resistance created by the tool, or generally reducing the amount of shock created during actuation and/or separation of the tool.

In an aspect, the gas flow channel 190 and the gas flow path 142 discussed with respect to FIGS. 3A and 3B are similar in form and function.

Figure 17:
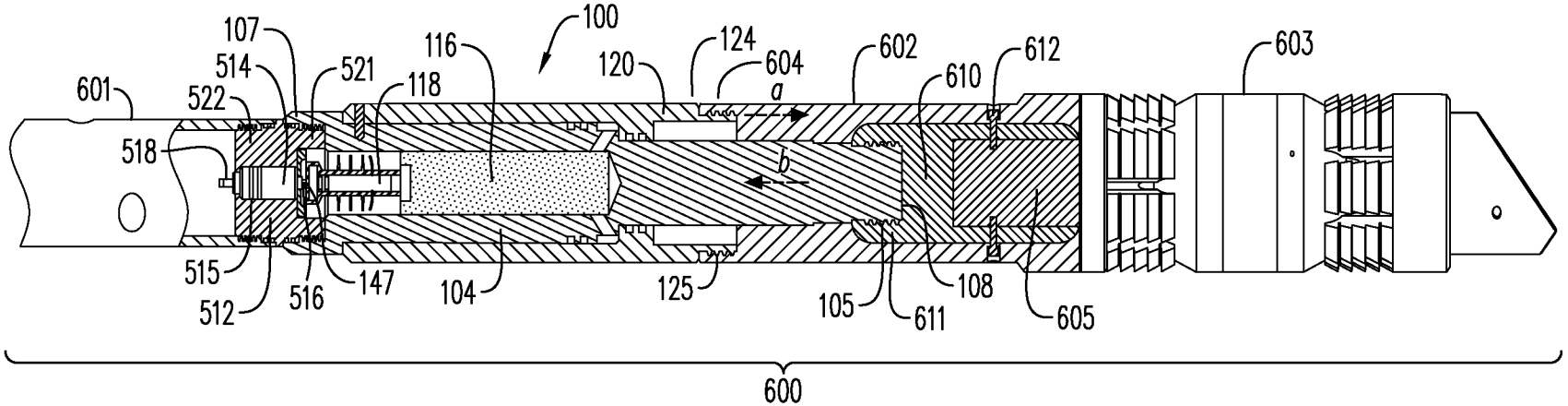
FIG. 17 shows a single use setting tool as part of a wellbore tool string according to an exemplary embodiment.

With reference now to FIG. 17, an exemplary arrangement of a tool string 600 including a single use setting tool 100 according to the disclosure may include a perforating gun 601 (which may be the last in a string of perforating guns or other wellbore tools above, i.e., upstream, of the single use setting tool 100), the seal adapter 512, the single use setting tool 100, a plug setting sleeve 602, and a plug 603. In the exemplary tool string 600 that FIG. 17 shows, the perforating gun 601 is connected to the second connecting portion 522 of the seal adapter 512 and the seal adapter portion 107 of the inner piston 104 is connected to the first connecting portion 521 of the seal adapter 512. The bulkhead 514 is positioned within the bore 515 through the seal adapter 512 and relays an electrical signal from an electrical connector (not shown) in the perforating gun 601 to the line-in portion 147 of the initiator 118. Accordingly, for purposes of this disclosure, "bulkhead 514" and "electrical feedthrough bulkhead 514" and variations thereof, such as "electrical feedthrough bulkhead assembly 514," may be used interchangeably. The proximal contact pin 518 of the bulkhead 514 is in electrical contact with the electrical connector in the perforating gun 601 and, within the bulkhead, the distal contact pin 516 of the bulkhead 514. The proximal contact pin 518 relays the electrical signal from the electrical connector in the perforating gun 601 to the line-in portion 147 of the initiator head 146, via the distal contact pin 516 which is in electrical contact with the line-in portion 147. The electrical signal may be a signal for triggering initiation of the initiator 118.

The single use setting tool 100 may connect to the plug setting sleeve 602 by, without limitation, a threaded connection between the external threads 125 of the outer sleeve distal end 124 and complementary threading on a connecting portion 604 of the plug setting sleeve 602. In addition, the inner piston 104 may connect to a setting sleeve mandrel 610 of the plug setting sleeve 602 as are known in the art. For example, the external threads 105 on the distal end 108 of the inner piston 104 may threadingly connect to a complementary threaded portion on a connecting portion 611 of the setting sleeve mandrel 610.

In another aspect, the plug setting sleeve 602 includes a plurality of shear studs 612 that connect the plug setting sleeve 602 to a plug mandrel 605 of the plug 603, thereby mounting the setting sleeve 602 to the plug 603. As previously mentioned, releasing the plug 603 from the setting sleeve 602 is an abrupt and shock-generating event because release occurs when the outer sleeve 120 has put enough pressure on the plug setting sleeve 602 to break the shear studs 612. The requisite pressure is generated by the inner piston 104 and the outer sleeve 120 exerting respective, opposing forces according to the operation of the single use setting tool 100 as described herein. The inner piston 104 is exerting a pulling force in a direction 'b' on the setting sleeve mandrel 610 while the outer sleeve 120 and the plug setting sleeve 602 are stroking in a direction 'a' over the inner piston 104 and the setting sleeve mandrel 610. When the shear studs 612 break and the plug 603 is released, the sudden removal of resistance against the stroke of the outer sleeve 120 causes rapid acceleration of the outer sleeve 120 in the direction 'a' and corresponding relative acceleration of the inner piston 104 and the setting sleeve mandrel 610 in the direction 'b'. When the outer sleeve 120 reaches the end of its stroke length and comes to an abrupt halt, substantial shock is generated by, for example, sudden impact between or stress or forces on the connection between the setting sleeve 602 and the setting sleeve mandrel 610 and impact between portions of the outer sleeve 120 and/or the inner piston 104 and the setting sleeve mandrel 610 and/or the end 613 of the setting sleeve mandrel 610. This shock may damage, deform, or simply reduce the useful life of both the plug setting sleeve 602 and the setting sleeve mandrel 610, both of which may be reusable components although the single use setting tool 100 is not.

Upon initiation of the initiator 118 which may be, for example, in response to receiving the electrical signal, the power charge 116 is consumed and the outer sleeve 120 is slid axially, relative to the inner piston 104 as previously described, in a direction 'a'. Accordingly, the outer sleeve 120 pushes the plug setting sleeve 602 in the direction 'a' and thereby creates compression forces on the plug 603 which causes the plug 603 to expand and set.

Figure 18:
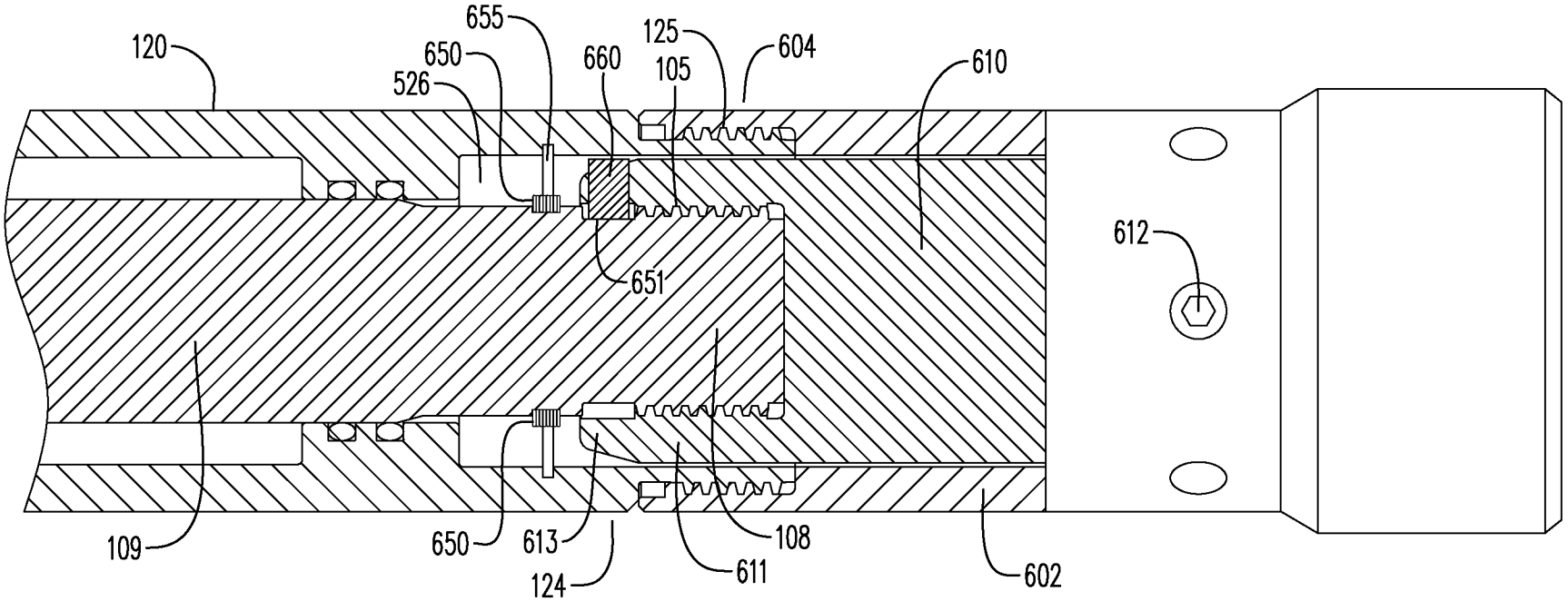
FIG. 18 shows a piston connection to a setting sleeve mandrel according to an exemplary embodiment.

With reference now to FIG. 18, an isolated view of the connection between the inner piston 104 and the plug setting sleeve 602 is shown according to an exemplary embodiment. It should be noted that the view shown in FIG. 18 represents the state of the single use setting tool 100 and plug setting sleeve 602 after the plug 603 has been released—i.e., after the outer sleeve 120 has finished its stroke and the shear studs 612 have broken between the setting sleeve 602 and the plug mandrel 605. As shown in FIG. 18, the inner piston 104 and the connecting portion 611 of the setting sleeve mandrel 610 have been retracted into the distal bore 526 at the outer sleeve distal end 124.

FIG. 18 also shows in further detail the threaded connections between the external threads 125 of the outer sleeve distal end 124 and complementary threading on the connecting portion 604 of the plug setting sleeve 602 and the external threads 105 of the distal end 108 of the inner piston 104 and the complementary threaded portion on the connecting portion 611 of the setting sleeve mandrel 610.

Figure 19:
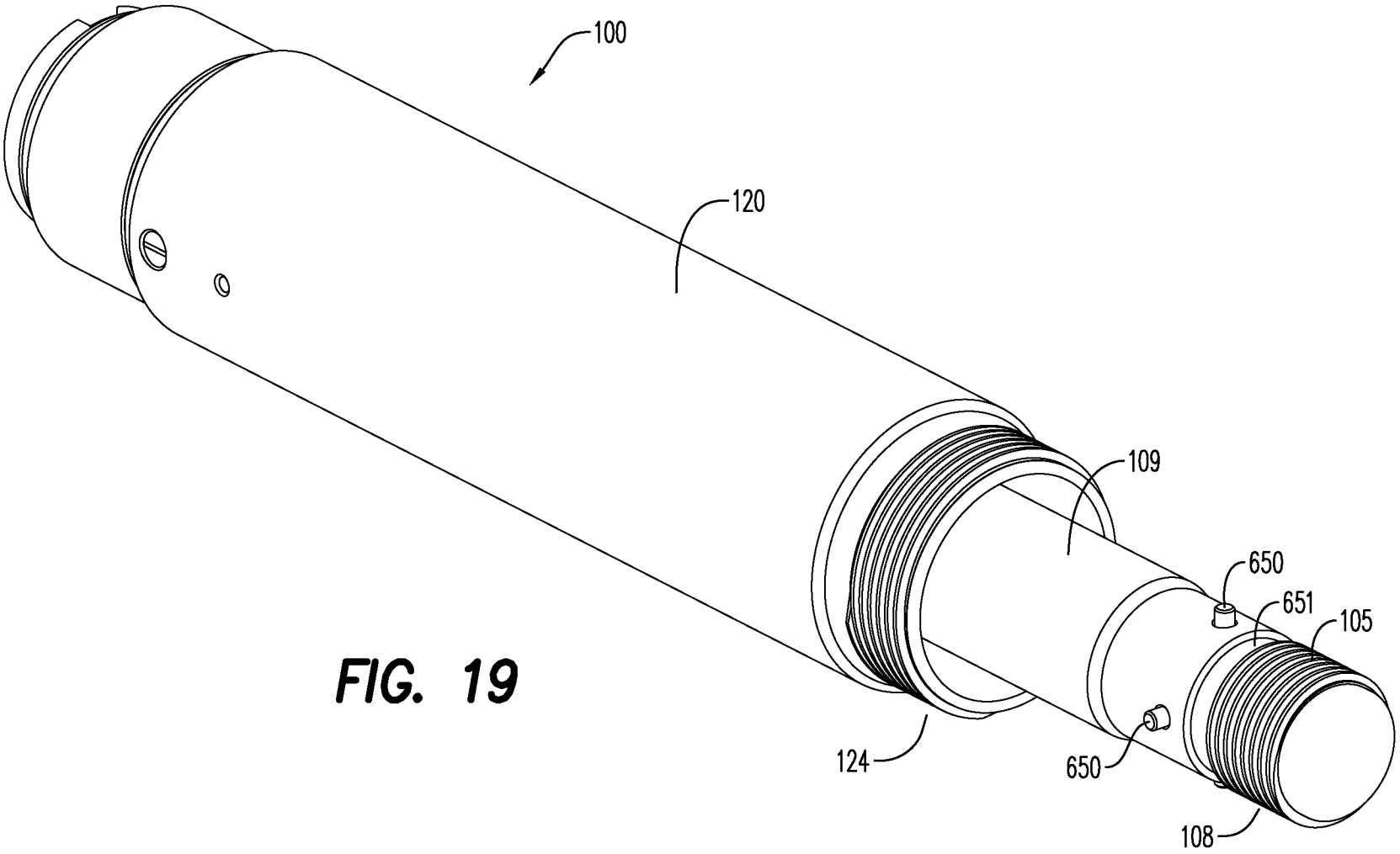
FIG. 19 shows a perspective view of a single use setting tool with a shock blocking structure according to an exemplary embodiment.

With continuing reference to FIG. 18, an exemplary embodiment of a single use setting tool 100 may include a shock blocking structure 650 such as shock blocking pins 650 as will be further explained with respect to FIG. 19. As shown in FIG. 18, the shock blocking pins 650 are positioned adjacent to an end 613 of the mandrel 610 in relatively close proximity, especially when compared with the shock absorbing assemblies 530 discussed with respect to FIGS. 7 and 8. Positioning the shock blocking structures 650 (i.e., shock blocking pins 650) closer to the mandrel 610 enhances dissipation of the shock generated during separation of the plug 603 by impacts between, e.g., the outer sleeve 120 and the inner piston 104 and/or the setting sleeve mandrel 610, and the distal end 108 of the inner piston 104 and the connecting portion 611 of the setting sleeve mandrel 610, within which the distal end 108 of the inner piston 104 is received. The shock blocking pins 650 absorb and dissipate the shock at a position adjacent to the end 613 of the setting sleeve mandrel 610 and thereby reduce damaging propagation of the shock forces. However, the disclosure is not limited to any particular spacing or relationship between a shock blocking structure and a mandrel and includes any such configurations consistent with the principle and purpose of the exemplary embodiments.

In another exemplary embodiment, a single use setting tool 100 including a shock blocking structure 650 as shown in FIG. 18 and discussed further below with respect to FIGS. 19 and 20 may include, in addition to the shock blocking structure 650, a shock absorbing assembly 530 such as shown and described with respect to FIGS. 7, 8, 9A, and 9B. Accordingly, in an aspect of the exemplary embodiment the retaining ring groove 655 may be formed in the inner portion 130 of the outer sleeve 120 as previously discussed with respect to FIG. 7C.

With reference now to FIG. 19, a full depiction of the exemplary single use setting tool 100 with shock blocking pins 650 is shown. The single use setting tool 100 shown in FIG. 19 includes generally the same components and configurations as have been previously described with respect to the exemplary embodiments of a single use setting tool 100 throughout the disclosure and such description will not be repeated here. In relevant part, the single use setting tool 100 shown in FIG. 19 includes shock blocking pins 650 arranged on the distal rod 109 at a position towards the distal end 108 of the inner piston 104. As mentioned with respect to FIG. 18, positioning the shock blocking structures 650 as close to the end 613 of the setting sleeve mandrel 610 when the setting sleeve mandrel 610 is connected to the distal end 108 of the inner piston 104 may provide enhanced shock dissipating benefits. However, plug setting adapters (i.e., plug setting sleeves) from different manufacturers may have mandrel connections that vary by a degree of tolerance such that they are non-standardized. In particular, mandrels (e.g., mandrel 610) on plug setting adapters frequently have a set screw 660 to clamp down on a piston to which they are attached and thereby provide a more robust connection than through, e.g., threaded connections alone. The set screw 660 may seat within a recessed band on the piston, such as the recessed band 651 on the inner piston 104. It may be beneficial to make the recessed band 651 especially wide in a direction from the distal end 108 to the proximal end 106 of the inner piston, to accommodate different positions of the set screw(s) 660 on mandrels from various manufacturers for use with the shock blocking pins 650.

Figure 20:
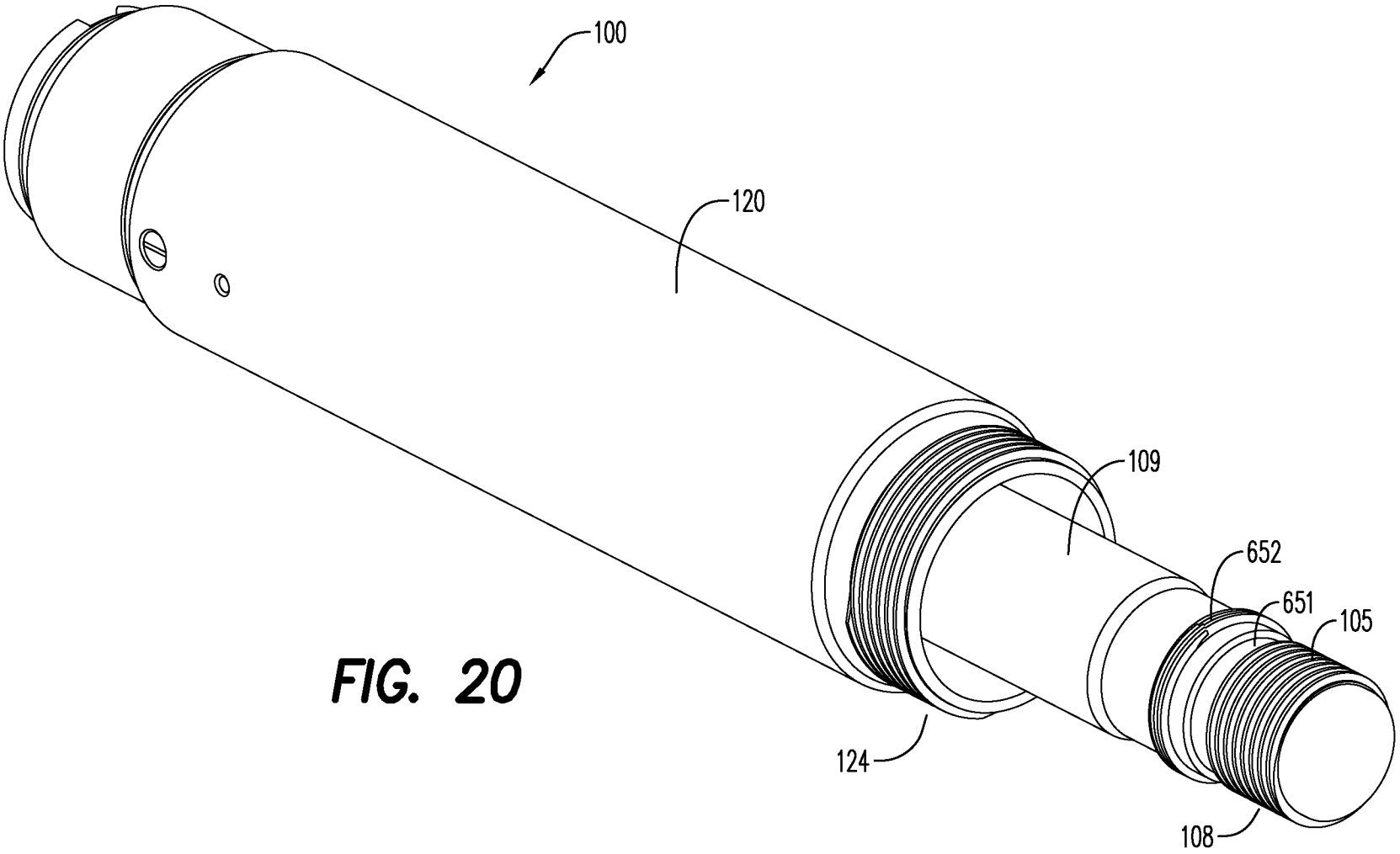
FIG. 20 shows a perspective view of a single use setting tool with a shock blocking structure according to an exemplary embodiment.

With reference now to FIG. 20, an exemplary embodiment of a single use setting tool 100 including a shock blocking ring 652 is shown. The configuration, principles, and purpose of the exemplary embodiment that FIG. 20 shows are the same as discussed with respect to FIG. 19. However, the shock blocking structure of the exemplary embodiment that FIG. 20 shows is a shock blocking ring 652 extending circumferentially around the inner piston 104 at a position on the distal rod 109 as previously discussed with respect to FIG. 19. The shock blocking ring 652 may be a ring of solid material, a spring ring, a coil ring, or other known components consistent with the disclosure. The shock blocking ring may be one shock blocking ring 652 or a plurality of shock blocking rings 652 stacked together or spaced at intervals along the distal rod 109.

In the exemplary embodiments as shown and described with respect to FIGS. 19 and 20, the shock blocking structures 650, 652 may be made from metal, for example stainless steel, carbon steel, and the like. Other known materials may be substituted without departing from the principles and purpose of the disclosure. In addition, the exemplary shock blocking structures 650, 652—i.e., pins, rings, spring rings, coil springs—are by way of example and not limitation. Any configuration, shape, number of structures, orientation, etc. of shock blocking structures 650, 652 may be used consistent with this disclosure.

In a further aspect of an exemplary embodiment, the initiator holder 138 may be formed from a material that is destructible upon initiation of the initiator 118, and the initiator 118 and the initiator holder 138 together are positioned such that the initiator 118 will move out of electrical communication with the distal contact 516 and thereby provide a shot confirmation—i.e., confirmation that the initiator 118 has been initiated and a live initiator is no longer present in the setting tool.

The disclosure also relates to a method of actuating the wellbore tool 102 with the single use setting tool 100. For example, an exemplary method may include connecting the single use setting tool 100 to the wellbore tool 102, which may occur either before or after the single use setting tool 100 and the wellbore tool 102 has arrived at the well site. The single use setting tool 100 may be according to an exemplary embodiment disclosed herein. Attaching the single use setting tool 100 to the wellbore tool 102 may include attaching the threaded portion 105 of the distal end 108 of the inner piston 104 and the threaded portion 125 of the outer sleeve distal end 124 respectively to complimentary connectors on the wellbore tool 102. Once the single use setting tool 100 is connected to the wellbore tool 102, and the assembly is present at the wellbore site, the initiator 118 may be inserted into the initiator holder 138, which is accessible through the proximal end 106 of the inner piston 104.

In the case where the single use setting tool 100 and the wellbore tool 102 are components in a tool string, after the initiator 118 is inserted the seal adapter portion 107 of the inner piston 104 may be connected to the first connecting portion 521 of the seal adapter 512. An upstream wellbore tool, wireline connector, or other components as are known in the art may then be connected to the second connecting portion 522 of the seal adapter 512. When the full tool string 600 is assembled it is deployed into the wellbore. At an appropriate time as determined by elapsed time, measured distance, located position, or by other techniques as are known in the art, the single use setting tool 100 may be initiated by relaying an electrical signal through the tool string 600 to the single use setting tool 100, ultimately via the bulkhead 514 in the seal adapter 512 as previously described. The initiator 118 may initiate in response to receiving the electrical signal, and in certain embodiments the method further includes confirming, after initiating the initiator, that the electrical communication between the first electrical connection of the electrical feedthrough bulkhead assembly and the initiator has been terminated. The confirmation may be provided by, for example and as discussed above, disintegration of the initiator holder 138 causing the initiator 118 to fall from a first position in which the line-in portion 147 of the initiator head is in contact with the distal contact pin 516 of the bulkhead 514 to a second position in which the line-in portion 147 of the initiator head 146 is not in contact with the distal contact pin 516 of the bulkhead 514.

In an exemplary embodiment, a method of actuating the wellbore tool 102 with a single use setting tool 100 according to the exemplary embodiments presented throughout the disclosure may include connecting the single use setting tool 100 to the wellbore tool 102, for example as shown and described with respect to FIG. 18, connecting the piston distal end 108 to a wellbore tool connection such as the mandrel connecting portion 611 via a complementary threaded connection to the external threads 105 of the distal end 108 of the inner piston 104, and connecting the outer sleeve distal end 124 to a plug setting sleeve connecting portion 604 via a complimentary threaded connection to the external threads 125 of the sleeve distal end 124. In an aspect, the single use setting tool 100 will be provided with the power charge 116 and the initiator holder 138 already in place within the inner piston cavity 114. Accordingly, the initiator 118 may be inserted by, e.g., pushing the initiator 118 into the initiator holder 138.

Upon inserting the initiator 118, the first connecting portion 521 of the seal adapter 512 may be connected to the seal adapter portion 107 of the inner piston 104. The seal adapter 512 may include the electrical feedthrough bulkhead 514 positioned within the bore 515 of the seal adapter 512, as previously described. Upon connecting the first connecting portion 521 of the seal adapter 512 to the seal adapter portion 107, the distal contact pin 516 of the bulkhead 514 is automatically placed in electrical communication with the line-in portion 147 of the initiator 118, due to the coaxial alignment of the seal adapter 512, the bulkhead 514, and the initiator 118, in particular the line-in portion 147 of the initiator 118 (as positioned by the initiator holder 138). In the case of use with a further wellbore tool string, the second connecting portion 522 of the seal adapter 512 may then be connected to an upstream wellbore tool, and, upon connecting the second connecting portion 522 of the seal adapter 512 to the upstream wellbore tool, the proximal contact pin 518 of the bulkhead 514 is placed in electrical communication with an electrical relay of the upstream wellbore tool, again by an alignment between the electrical relay and the bulkhead 514/seal adapter 512. When the tool string including the upstream wellbore tool(s), the single use setting tool 100, the wellbore tool 602, and any other components is assembled, the tool string may be deployed into the wellbore. Upon reaching the desired position for actuating the wellbore tool 602, the method includes relaying an electrical signal from the surface or other component within the tool string, through the electrical relay of the upstream wellbore tool, to the initiator 118 via the electrical feedthrough bulkhead 514. The initiator 118 is initiated in response to receiving the electrical signal from the distal contact pin 516 of the electrical feedthrough bulkhead 514 at the line-in portion 147 of the initiator 118.

In an aspect, an exemplary method may further include inserting the power charge 116 and the initiator holder 138, if they are not already present, into the inner piston cavity 114 by, e.g., inserting through the open proximal end 106 of the inner piston 104—i.e., through the inner area 519 of the seal adapter portion 107.

In an aspect, an exemplary method may further include confirming, after initiating the initiator 118, that the electrical communication between the distal contact pin 516 of the electrical feedthrough bulkhead 514 and the initiator 118 has been terminated.

In further aspects of the disclosure, the power charge composition (by weight percent (wt. %)) may include, without limitation: $NaNO_3$ (Sodium Nitrate) (40%-75%) or $KNO_3$ (Potassium Nitrate) (40%-75%) as 1 to 1 alternatives; Pyrodex (0%-10%); Wheat Flower (15% to 45%); and, Epoxy Binder (10% to 30%). The booster material (i.e., fast burning material) may include, without limitation: Pyrodex or black powder (50%-100%) and $KNO_3$ (Potassium Nitrate) (0%-50%).

Figure 21:
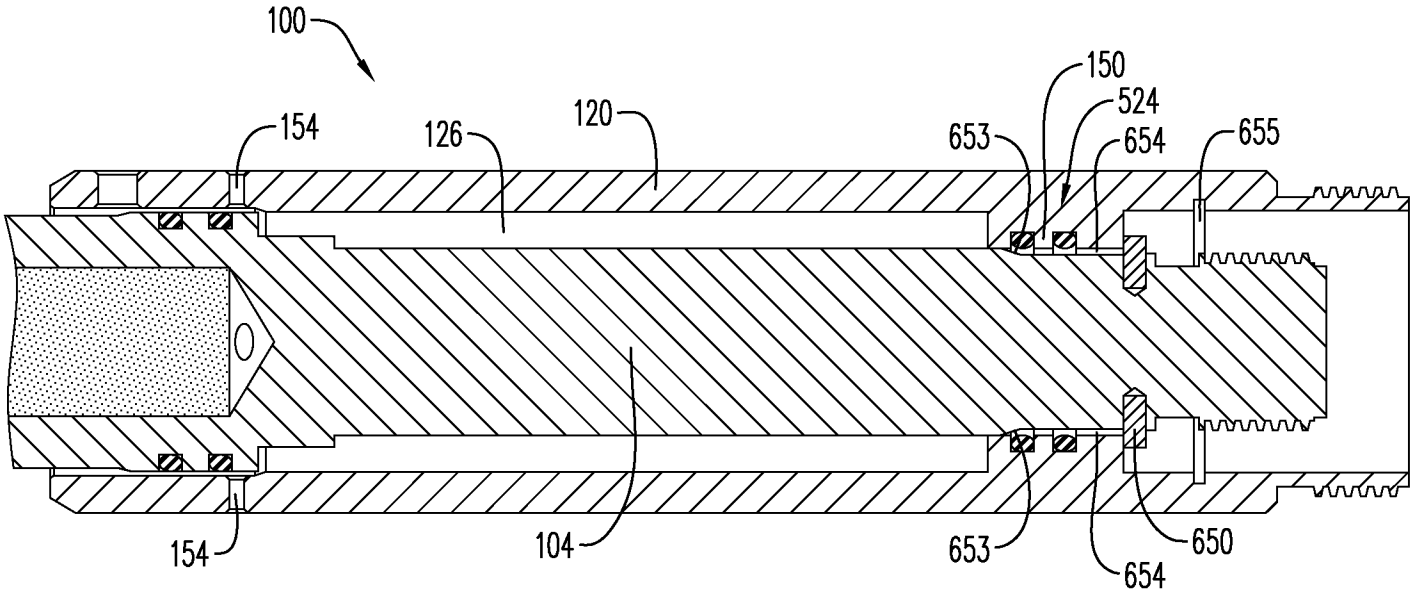
FIG. 21 shows a cross-sectional view of a single use setting tool with an axial vent according to an exemplary embodiment.

With reference now to FIG. 21, a cross-sectional view of an exemplary embodiment of a single use setting tool 100 according the exemplary embodiments shown and described with respect to FIGS. 18-20 is shown. FIG. 21 illustrates, similar to FIG. 18, the outer sleeve 120 and a portion of the inner piston 104 after the plug 603 has been released and the inner piston 104 is retracted within the outer sleeve 120. As shown in FIG. 21, the exemplary embodiments according to the disclosure, individually or variously, may provide benefits such as dual pressure vents, which include pressure vents 154 and an axial pressure vent 654 formed as a gap that is created between the sealing section 254 of the outer sleeve 120, including the second seal 150, and a tapered region 653 of the distal rod 109. The axial pressure vent 654 is formed after the single use setting tool 100 has actuated the tool 102, such that in the retracted (post-actuation) position of the inner piston 104 relative to the outer sleeve 120 the tapered region 653 of the distal rod 109 is aligned with the sealing section 254 of the outer sleeve 120. The tapered region 653 of the distal rod 109 dips low enough below the sealing section 254 and the second seal 150 so as to create a gap, i.e., the axial pressure vent 654, therebetween. The axial pressure vent 654 is open to the central bore 126 within the outer sleeve 120 such that excess or remaining pressure in the central bore 126 may escape through the axial pressure vent 654. The dual pressure bleed allows more effective release of pressure from the spent single use setting tool 100, and the pressure bleed may be done at the surface of the wellbore because oil cushions and other components of a reusable setting tool, or additional components of a more complicated disposable setting tool, do not impede the pressure bleed. While the exemplary embodiment that FIG. 21 shows includes shock blocking structures 650 similar to the exemplary embodiments shown in FIGS. 18-20, the dual pressure bleed as described above is not limited thereto and forms an aspect of the various exemplary embodiments of a single use setting tool as presented throughout the disclosure.

The exemplary embodiments also do not require a firing head and may be assembled in a "plug and go" fashion due to the configuration of the electrically contactable initiator 118 (i.e., initiator 118 having the electrically connectable line-in portion 147) and the seal adapter 512 which puts the initiator 118 in electrical communication with the bulkhead 514 and, thereby, a relay for the electrical initiation signal. For example, when used with the exemplary embodiments of a single use setting tool 100 as presented throughout the disclosure, the modular initiator 118 and bulkhead assembly 514 as described herein and, as previously mentioned, with reference to U.S. Pat. Nos. 9,581,422 and 9,605,937, among others, allows the initiator 118 to be pushed into the initiator holder 138 through the open proximal end 106 of the inner piston 104, i.e., through the inner area 519 of the seal adapter portion 107. The initiator holder 138 positions the initiator 118 and the line-in portion 147 of the initiator head 146 coaxially with the seal adapter portion 107 such that when the seal adapter 512 including the exemplary electrical feedthrough bulkhead 514 is connected to the seal adapter portion 107, a first electrical contact (e.g., distal contact pin 516) is automatically placed in electrical contact with the electrically contactable line-in portion 147 of the initiator head portion 146. When the seal adapter 512 is connected on its opposite end to an upstream wellbore tool having a complementary electrical connection/relay, the second electrical contact (e.g., proximal contact pin 518) of the bulkhead 514 is automatically placed in electrical contact with that electrical connection/relay. The above assembly and benefits form various aspects of an exemplary single use setting tool 100 as presented throughout the disclosure, and a method for using the same.

In addition, the initiator holder 138 by the same aspects of the exemplary embodiments positions the initiator 118 coaxially with the inner piston cavity 114 and the ignition components (such as booster 528) and power charge 116 therein.

While the exemplary embodiments have been described according to the initiator holder 138 positioning the initiator 118 and/or electrically contactable line-in portion 147 of the detonator head 146 coaxially with the seal adapter portion 107 and/or inner piston cavity 114, the disclosure is not limited thereto. Operation of a "plug-and-go" system, e.g., with a push-in initiator, as explained above, includes alignments, shapes, and configurations according to those principles and consistent with this disclosure.

The aspects of the exemplary embodiments as presented above further allow the initiator 118 to initiate in response to receiving an electrical signal directly, via the bulkhead 514, from an upstream tool, in the absence of a firing head. The absence of a firing head and any necessary adapters for the firing head also helps to shorten the length of the single use setting tool 100.

Figure 22:
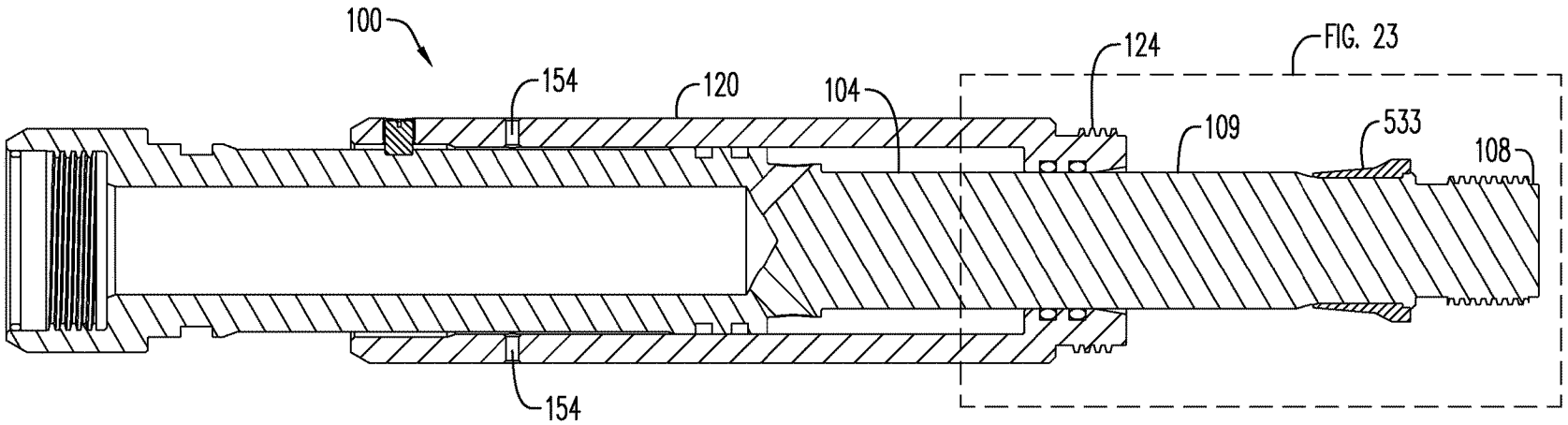
FIG. 22 shows a cross-sectional view of a single use setting tool with a brake according to an exemplary embodiment.

With reference now to FIG. 22, an exemplary embodiment of a single use setting tool 100 with a wedge 533 similar in concept to the wedge 533 shown in FIGS. 9-9B is shown. The single use setting tool 100 is substantially as described with respect to other exemplary embodiments and common features are not necessarily repeated hereinbelow.

The exemplary embodiment shown in FIG. 22 includes, in an aspect, a wedge 533 according to an exemplary embodiment. The wedge 533 uses a brake with a specialized brake design, discussed further below, to reduce the shock load of a metal surface against metal surface impact being transferred through the single use setting tool 100 to the tool string components above.

Figure 23:
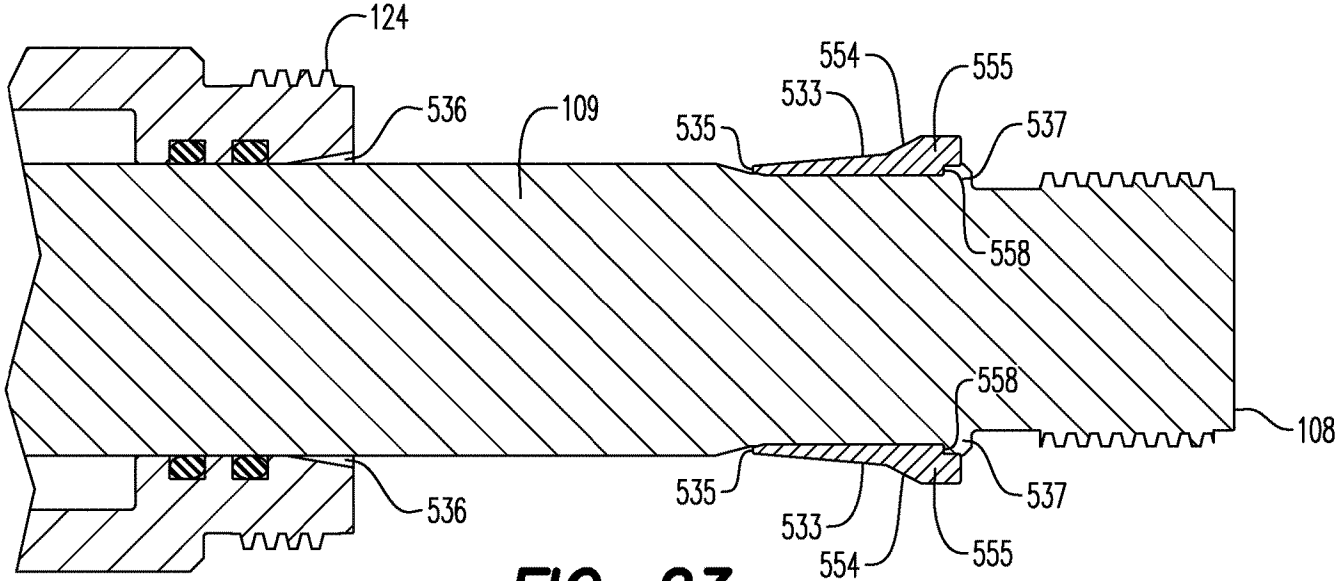
FIG. 23 is a blown-up view of a portion of the single use setting tool of FIG. 22.

FIG. 23 shows the dashed box portion of the single use setting tool 100 in additional detail. The wedge 533 is retained in a tapered portion 535 of the distal rod 109 portion of the inner piston 104. A wedge barrier 537 adjacent the tapered portion 535 on the distal rod 109 may be a retaining ring 533*a* as discussed with respect to FIGS. 9-9B or may be an integral projecting portion of the distal rod 109. The wedge barrier 537 may retain the wedge 533 in position and orientation.

In the exemplary embodiment(s) shown in FIG. 22 and FIG. 23, the outer sleeve 120 is configured to eliminate the distal bore 526 of the outer sleeve 120 as discussed with respect to, e.g., FIGS. 9-9B. A cutout 536 is formed in the distal end 124 of the outer sleeve 120. In the exemplary embodiment(s) shown in FIGS. 22 and 23, the cutout 536 is, without limitation, generally frustoconically-shaped. The frustoconical shape of the cutout 536 may correspond to a shape of the wedge 533 in the exemplary embodiment(s), as part of the specialized brake design of the brake including the wedge 533, for receiving the wedge 533 as discussed further below.

With continuing reference to FIG. 23 and further reference to FIGS. 24A-24D, the exemplary wedge 533 includes a first end 550 and a second end 552 (FIG. 24B) opposite the first end and is a generally annular structure with a body portion 553 defining a passage 562 (FIG. 24B) extending through the wedge 533 from the first end 550 to the second end 552, such that the wedge 533 may be connected around the circumference of the tapered portion 535 of the distal rod 109, with the distal rod 109 passing through the passage 562 of the wedge 533. The wedge 533 may have a tapered profile, narrowing in diameter in a direction from the second end 552 towards the first end 550 as shown, e.g., in FIG. 24A. The tapered profile of the wedge 533 corresponds generally to the frustoconically-shaped cutout 536 of the distal end 124 of the outer sleeve 120 in which the wedge 533 is received as part of the brake design as discussed further below.

The body portion 553 of the wedge 533 may include, in various aspects, alternating ribs 554 and channels 556 around the circumference of the body portion 553. The ribs 554 are slightly raised for contacting and frictionally engaging the frustoconically-shaped cutout 536 of the distal end of the outer sleeve 120 to brake the inner piston 104 and absorb the shock after the plug detaches. The channels 556 provide an open space that will allow communication for venting gas out of the cavity 114, around the wedge 533, after the piston 104 is retracted (after plug detachment) and the wedge 533 is lodged within the frustoconically-shaped cutout 536. The wedge 533 may also include a seam 560 extending through the body portion 553, from the first end 550 to the second end 552, such that the body portion 553 is not a continuous ring. The seam 560 may provide the wedge 533 with additional pliability to aid in installation, adjustment, removal, etc. of the wedge 533.

Figure 24A:
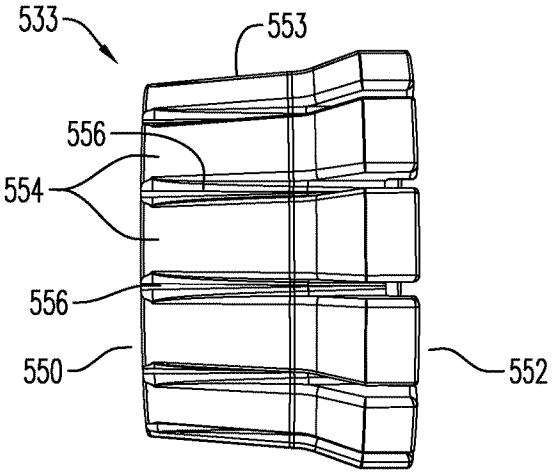
FIGS. 24A-24D show an exemplary shock absorbing wedge according to an exemplary embodiment.
Figure 24B:
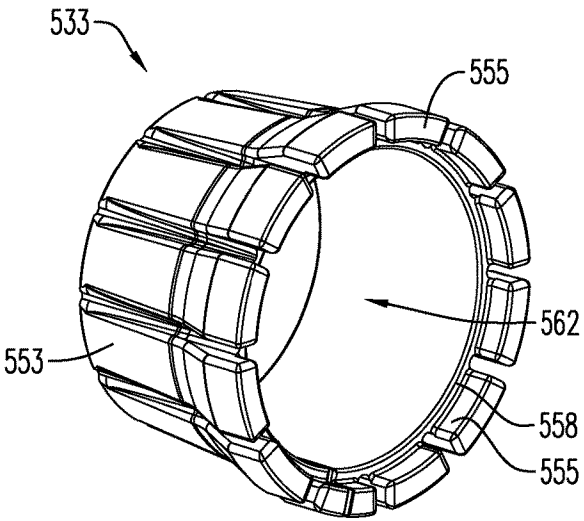
Figure 24C:
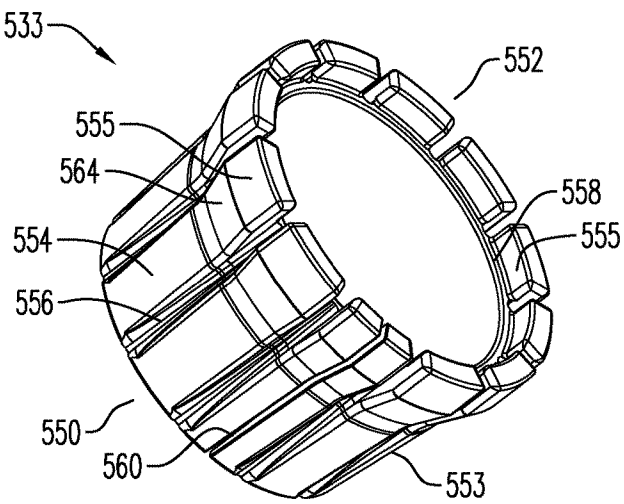
Figure 24D:
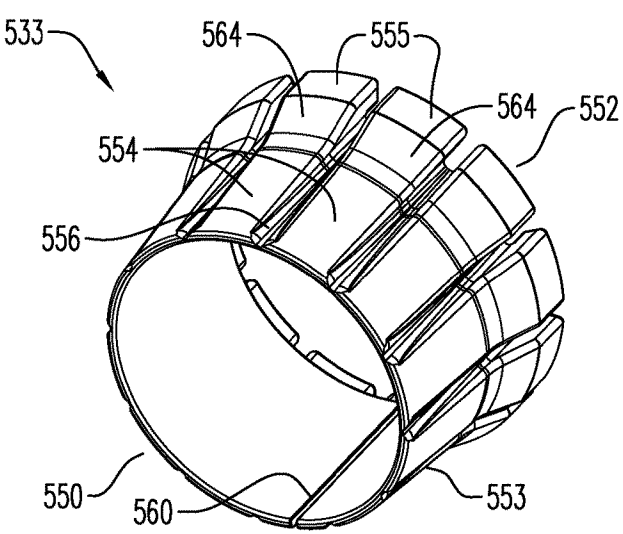
Figure 25:
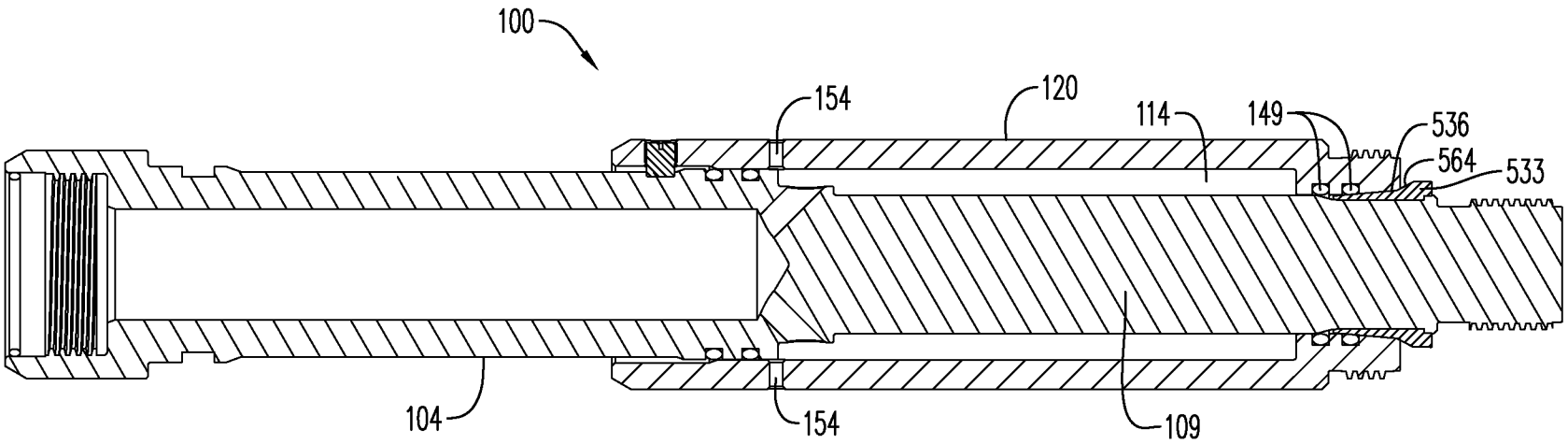
FIG. 25 shows the single use setting tool of FIG. 22 in the retracted position.

With continuing reference to FIGS. 24B-24D, and reference back to FIG. 23, and further reference to FIG. 25, each rib 554 of the wedge 533 may extend from the first end 550 to the second end 552 of the wedge 533 and terminate in an angled incline forming a ridge 564 that plateaus into a finger 555 of the rib 554. Each finger 555 may extend above an inner rim 558 of the body portion 553. When the exemplary wedge 533 is installed on the exemplary setting tool 100 shown in FIGS. 22 and 23, the body portion 553 will seat within the tapered portion 535 of the distal rod 109 with the inner rim 558 abutting the wedge barrier 537 on the distal rod 109. The wedge 533 may thereby be retained within the tapered portion 535 of the distal rod 109. The plurality of fingers 555 may extend, by virtue of the angled ridge 554, over the wedge barrier 537, and thereby maintain an orientation of the wedge 533.

With specific reference to FIG. 25, after the plug 603 detaches during use of the single use setting tool 100, the outer sleeve 120 and the inner piston 104 will accelerate relative to each other respectively in the a and b directions, as discussed with respect to FIG. 17, until the wedge 533 contacts and is received within the cutout 536 under the force of the acceleration. The ridge 564 may provide a barrier to stop further movement of the outer sleeve 120 and the inner piston 104 relative to one another. Once the wedge 533 is lodged in the cutout 536, the channels 556 in the body portion 553 of the wedge 533 may provide communication for gas to vent from the cavity 114 of the outer sleeve 120 to an outside of the single use setting tool 100. For example, the o-rings 149 originally sealed against the distal rod 109 will not seal against the wedge 533 so as to block gas flow through the channels 556. In other contemplated embodiments, the wedge 533 may be formed with, alternatively or in addition to the channels 556, holes through otherwise solid portions of the body portion 553, the holes acting in the same manner as the channels 556 with respect to forming gas vents.

Figure 26:
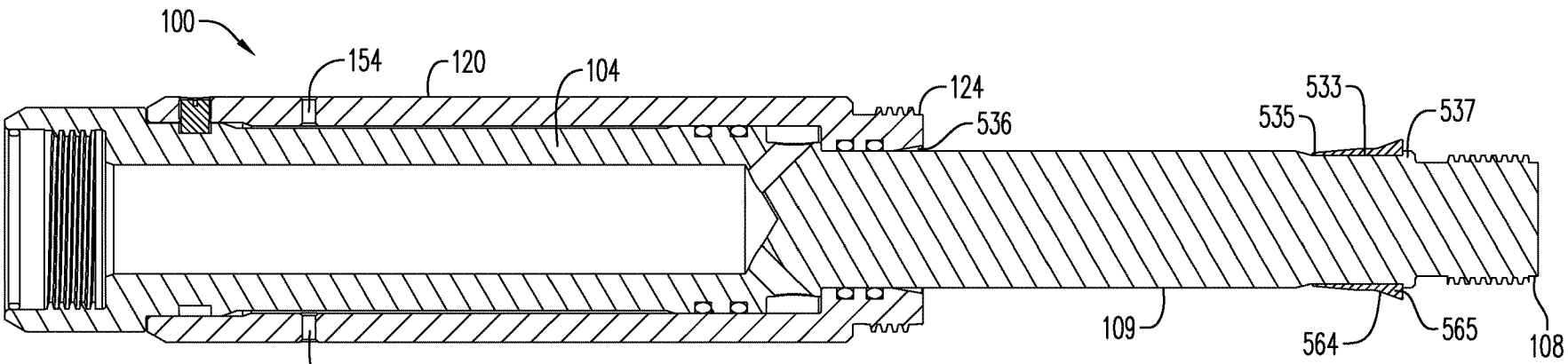
FIG. 26 shows a cross-sectional view of a single use setting tool with a brake according to an exemplary embodiment.
Figure 27B:
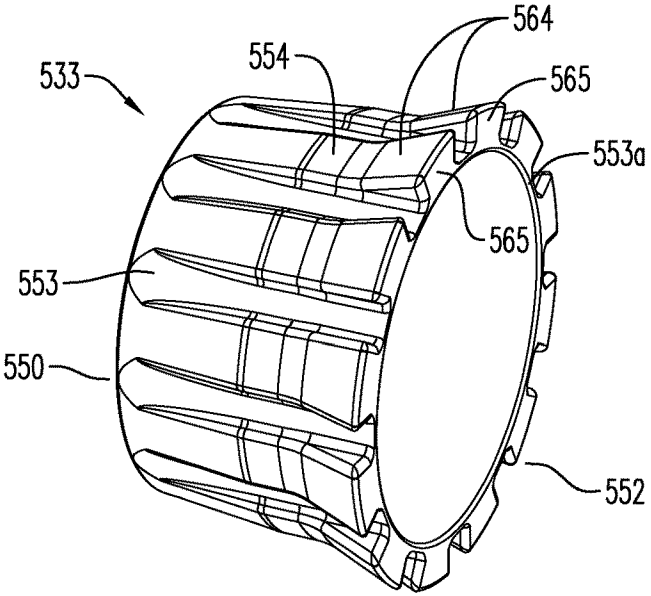
FIGS. 27A-27B show an exemplary shock absorbing wedge according to an exemplary embodiment.
Figure 27A:
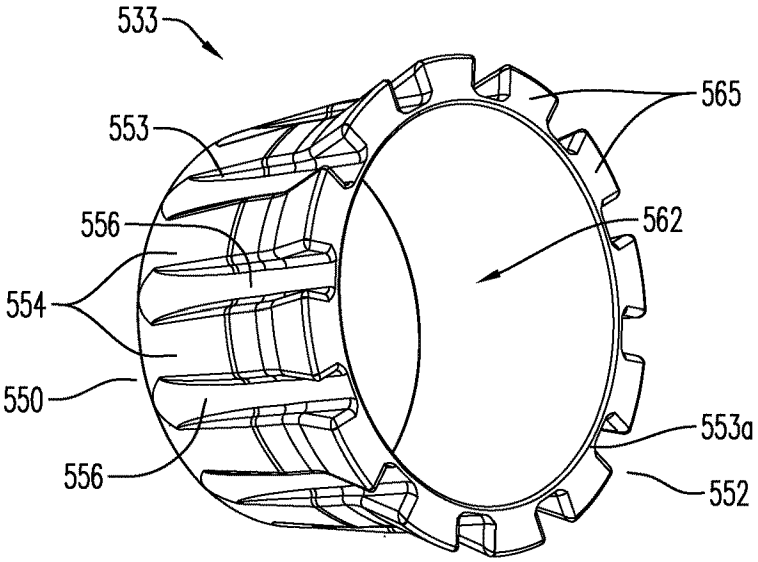

With reference now to FIGS. 26-27B, a wedge 533 according to a further exemplary embodiment is shown. The configuration of the exemplary single use setting tool 100 is substantially as described herein and with respect to FIGS. 22, 23, and 25. In the exemplary embodiment(s) shown in FIGS. 26-27B, the wedge 533 is also a generally annular structure with a first end 550, a second end 552 opposite the first end 550, a body portion 553 with a passage 562 formed therethrough, and a series of ribs 554 and channels 556 arranged around the body portion 553. The ribs 554 of the exemplary wedge 533 shown in detail in FIGS. 27A and 27B also respectively include angled ridge portions 564 adjacent the second end 552 of the body wedge 533. The angled ridge portions 564 each terminate in an outer face 565 of the rib 554. The plurality of outer faces 565 of the ribs 554 may be substantially coplanar with an end of the body portion 553*a* at the second end 552 of the wedge 533. Accordingly, the outer faces 565 of the ribs 554 will abut the wedge barrier 537 to retain the wedge 533 within the tapered portion 535 of the distal rod 109.

Figure 28:
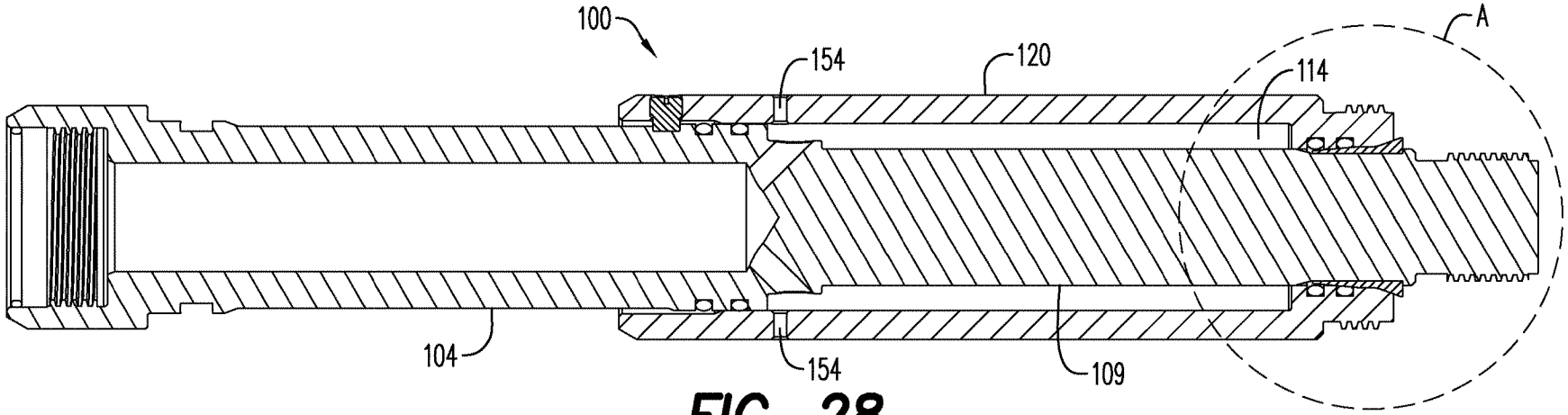
FIG. 28 shows the single use setting tool of FIG. 26 in the retracted position.
Figure 29:
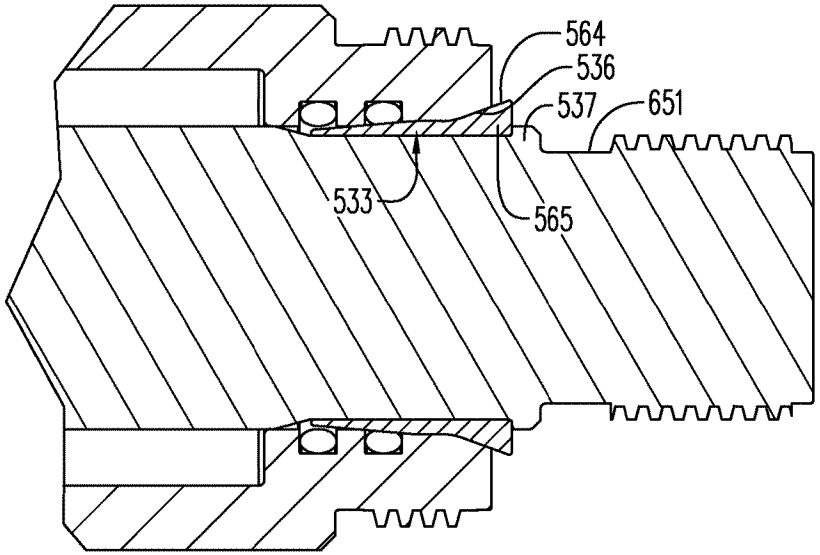
FIG. 29 is a blown-up view of a portion of the single use setting tool of FIG. 28.

FIG. 28 shows the exemplary single use setting tool 100 of FIG. 26 in the retracted position, after detachment of the plug 603 and braking of the inner piston 104 within the outer sleeve 120. FIG. 29 is a blown-up view of the circled 'A' portion indicated in FIG. 28. In similar concept as previously discussed with respect to the exemplary embodiments of FIGS. 22, 23, and 25, the exemplary wedge 533 shown in FIGS. 27A and 27B is set within a cutout 536 on the distal end 124 of the outer sleeve 120. The outer sleeve 120 has been stopped against the angled ridge portions 564 of the ribs 554 on the wedge 533. The braking design including the wedge 533 and the cutout 536 stops the movement of the outer sleeve 120 and the inner piston 104 relative to each other and absorbs the shock from the braking.

Figure 30:
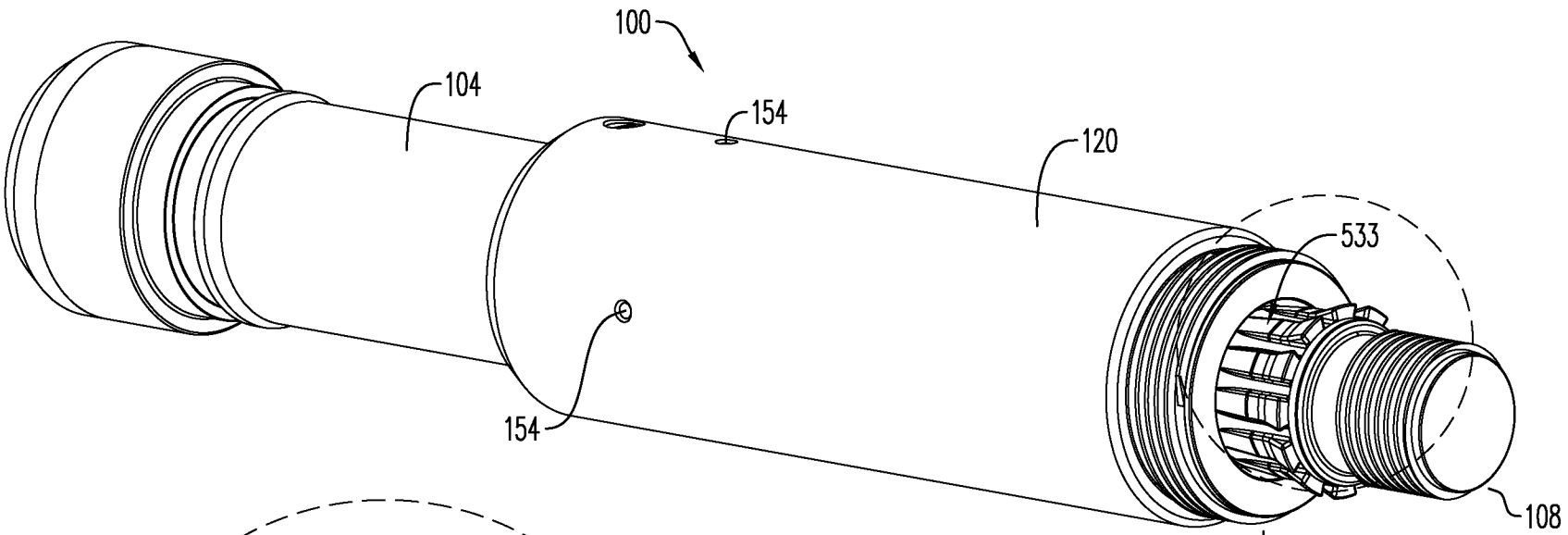
FIG. 30 is a non-cross-sectional view of the single use setting tool of FIG. 26 in a semi-retracted position.
Figure 31:
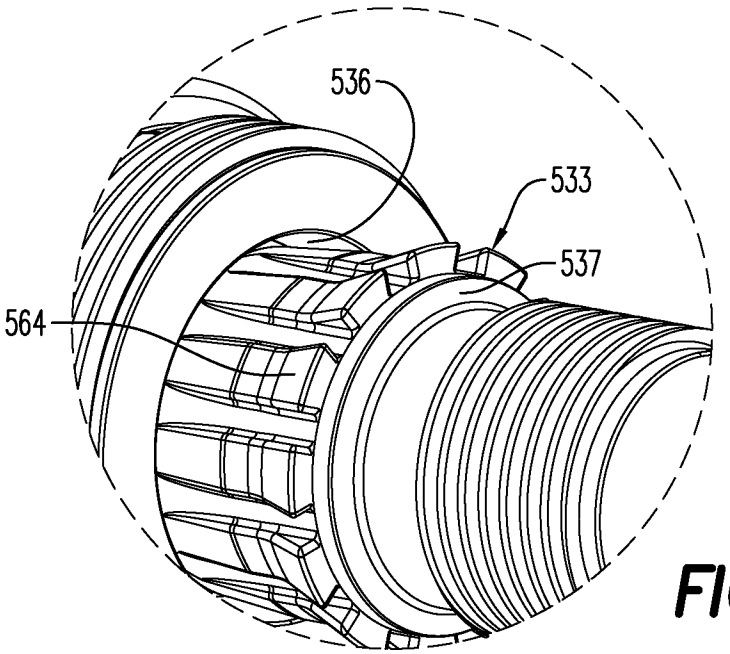
FIG. 31 is a blown-up view of a portion of the single use setting tool of FIG. 30.

With reference now to FIGS. 30 and 31, FIG. 30 shows a non-cross-sectional view of the single use setting tool 100 and wedge 533 according to the exemplary embodiment(s) shown in FIGS. 28 and 29 in a retracted or semi-retracted position. FIG. 31 shows a blown-up view of the area in the dashed circle of FIG. 30. With the inner piston 104 retracted after the plug 603 has detached, the wedge 533 is received within the cutout 536 formed inside an opening at the distal end 124 of the outer sleeve 120. As shown in FIGS. 30 and 31, the wedge 533 may not be received in the cutout 536 such that the angled ridge portion 564 abuts the outer sleeve 120—for example, when dimensional tolerances, thermal expansion of components, or other factors prevent the wedge 533 from being received to such point. FIGS. 30 and 31 may also represent a mid-state of retraction before the wedge 533 has been received up to the angled ridge portion 564. In either case, the concept and configuration of the braking design is the same and the wedge 533 will decelerate, stop, and absorb shock when it is received to any degree after contacting outer sleeve 120 within the cutout 536.

The wedge 533, as discussed above, may be a non-metallic material, for example a material that is softer than a metal, such as steel, used in the outer sleeve 120 and/or inner piston 104 including the distal rod 109 portion.

In further aspects, allowing the inner piston 104 to retract all the way up to wedge 533 and including a distance into which the wedge is received within the cutout 536 minimizes the need to limit the stroke of the outer sleeve 120 relative to the inner piston 104 because the braking and shock absorption provided by the brake design may compensate for even high degrees of shock from industry plug assemblies having the greatest kick upon detaching. This further increases the number of plug assemblies with which the single use setting tool 100 may be used, because the full stroke of the single use setting tool 100 may be sufficient even for plugs that require a relatively high minimum stroke. In other words, the exemplary embodiments of a single use setting tool 100 with a brake design including a cutout 536 and wedge 533 according to FIGS. 22-31 may have effective braking and shock absorption that reduces the need to reduce stroke as a compromise.

In a further aspect, the wedge barrier 537 may also serve as an end point where a plug/setting sleeve mandrel (generally, "plug setting mandrel") must stop even if a particular mandrel may have additional threads into which the external threads 105 of the inner piston 104 distal end 108 may advance. Accordingly, the single use setting tool 100 according to the exemplary embodiments, e.g., as shown in FIGS. 22 and 26, may standardize such connections to various plug assemblies from different manufacturers without compromising the available stroke length of the single use setting tool 100.

In a further aspect, the exemplary embodiments of a single use setting tool 100 as shown in FIGS. 22, 26, and 30 may include four pressure vents 154 formed through the outer sleeve 120, the pressure vents 154 placed at 90-degrees apart in a single plane around the outer sleeve 120. The pressure vents 154 may also be moved further towards the distal end 124 of the outer sleeve 120 such that the pressure vents 154 encounter the cavity 114 and begin venting gas, as previously discussed, earlier in the stroke of the single use setting tool 100.

Figure 32:
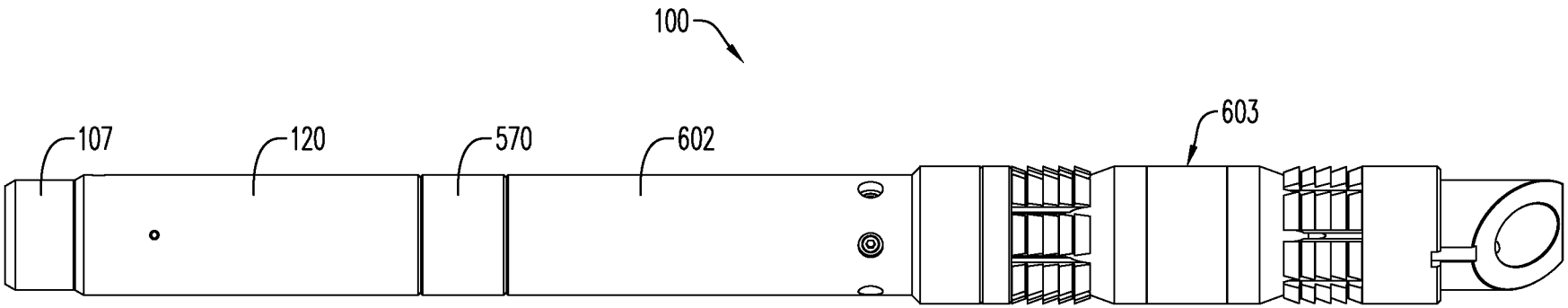
FIG. 32 shows a tool string with sleeve adapter according to an exemplary embodiment.
Figure 33:
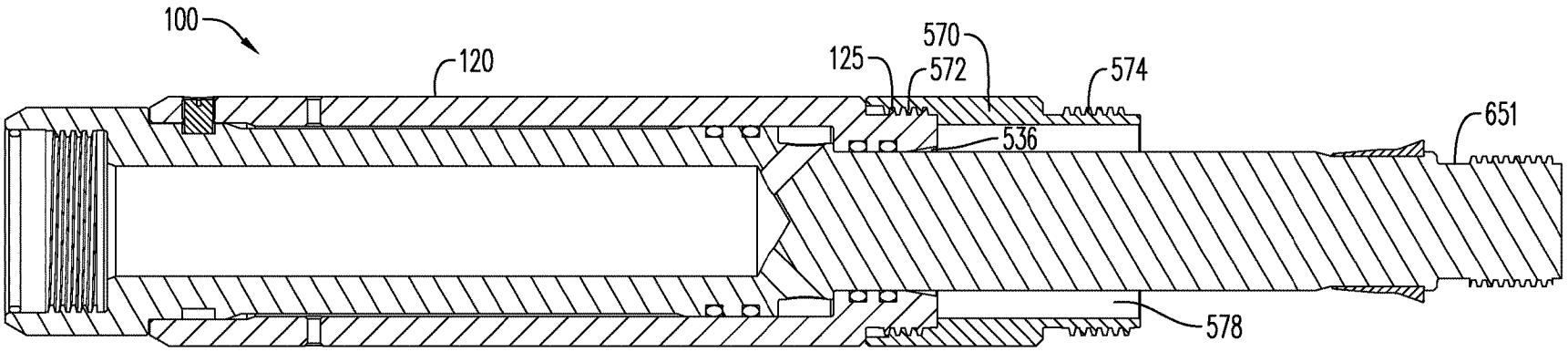
FIG. 33 shows a single use setting tool with sleeve adapter according to an exemplary embodiment.
Figure 34:
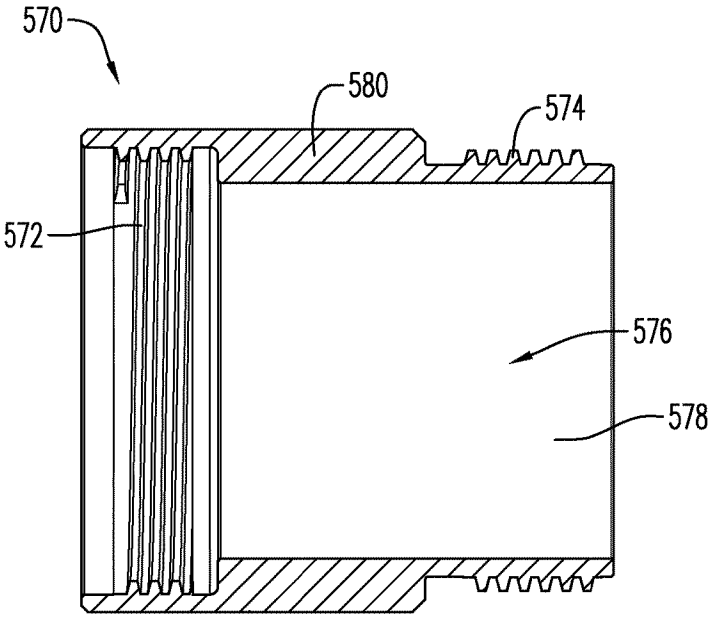
FIG. 34 shows a sleeve adapter according to an exemplary embodiment.

With reference now to FIGS. 32-34, the exemplary embodiments of a single use setting tool 100 according to, without limitation, FIGS. 22, 26, and 30, may incorporate a sleeve adapter 570. The sleeve adapter 570 may assist in disassembly of the single use setting tool 100 such that the plug setting mandrel 610 may be disconnected from the inner piston 104 and the reusable setting sleeve 602 separated for later use. For example, as discussed with respect to FIG. 18, plug setting mandrel 610 assemblies frequently include a set screw(s) 660 to clamp down on a piston (e.g., inner piston 104) which may also be attached by threads to the plug setting mandrel 610, and thereby provide a more robust connection. Operators must access and loosen the set screw 660 to detach the reusable setting sleeve 602 from the single use setting tool 100. However, once the wedge 533 is retracted into the cutout 536 of the outer sleeve 120, dislodging the wedge 533 so that the inner piston 104 may be pulled forward and the set screw accessed is nearly impossible to do without specialized machinery because of the force with which the wedge 533 is jammed into the cutout 536. Accordingly, one reason for eliminating the distal bore 526 of the outer sleeve 120 in the exemplary embodiments of FIGS. 22, 26, and 30 may be to prevent the set screw 660 from ending up within a portion the outer sleeve 120, and therefore difficult to access, once the inner piston 104 is in the retracted position and the wedge 533 is jammed in the cutout 536. However, the outer sleeve 120 in those embodiments may not have enough length to push the setting sleeve 602 far enough to actuate the plug 603.

Accordingly, and with reference now to FIG. 32, the exemplary single use setting tool 100 connection to the setting sleeve 602 and plug 603, as discussed with respect to, e.g., FIGS. 17 and 18, may, in an aspect, include the sleeve adapter 570. In an aspect, the sleeve adapter 570 may be reusable.

With reference to FIGS. 33 and 34, the sleeve adapter 570 may include an adapter body 580 with an internal threaded portion 572 for connecting on a first end to the external threads 125 on the distal end 124 of the outer sleeve 120 and an external threaded portion 574 for connecting on a second end, opposite the first end, to the plug setting sleeve connecting portion 604 of the plug setting sleeve 602, and a bore 576 passing all the way through the adapter body 580 and including a hollow interior portion 578 within the adapter body 580. Accordingly, the sleeve adapter 570 provides an effective removable extension of the outer sleeve 120. The sleeve adapter 570 provides the additional stroke length needed to take the setting sleeve 602 through the setting position but may be unscrewed from the outer sleeve 120 and moved away from the position, within the hollow interior portion 578 of the sleeve adapter 570, where the set screw 660 connection to the recessed band 651 (see also FIG. 29) will end up when the inner piston 104 is in the retracted position after setting the plug 603. Thus, the set screw 660 may be accessed and removed, and the reusable setting sleeve 602 thereby removed.

Figure 35:
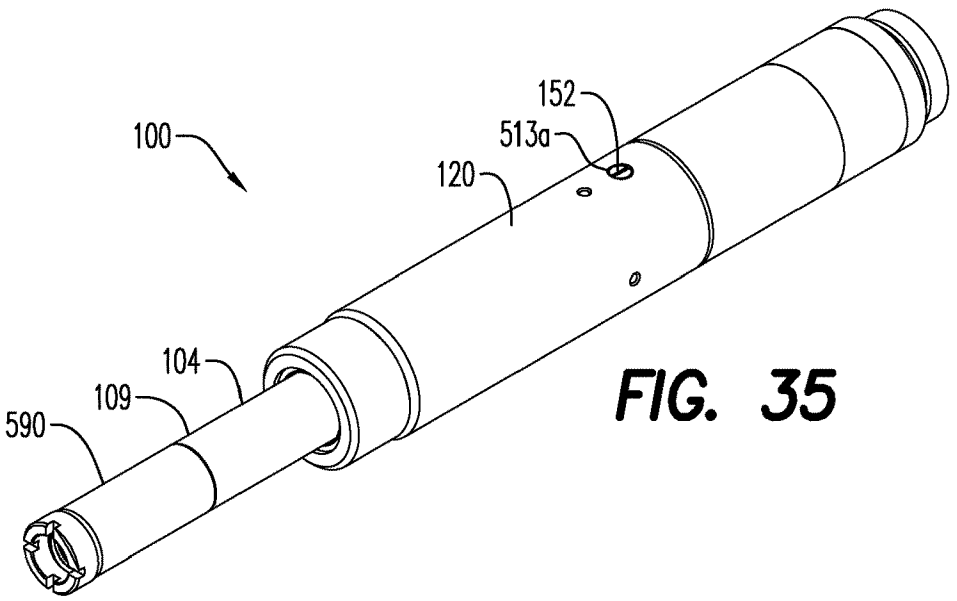
FIG. 35 is a perspective view of a single use setting tool according to an exemplary embodiment.
Figure 36:
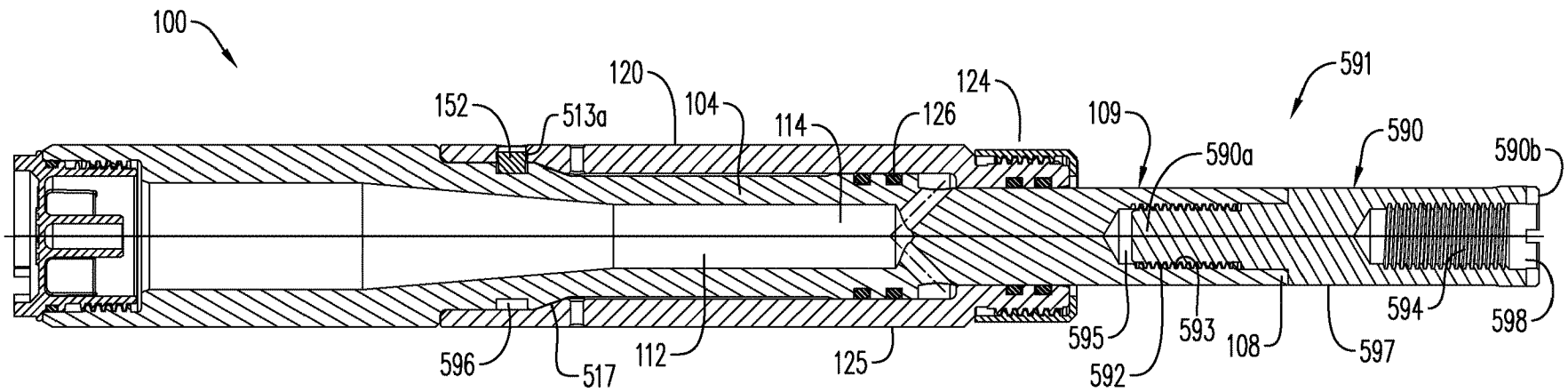
FIG. 36 is a cross sectional view of the single use setting tool shown in FIG. 35, according to an exemplary embodiment.
Figure 37:
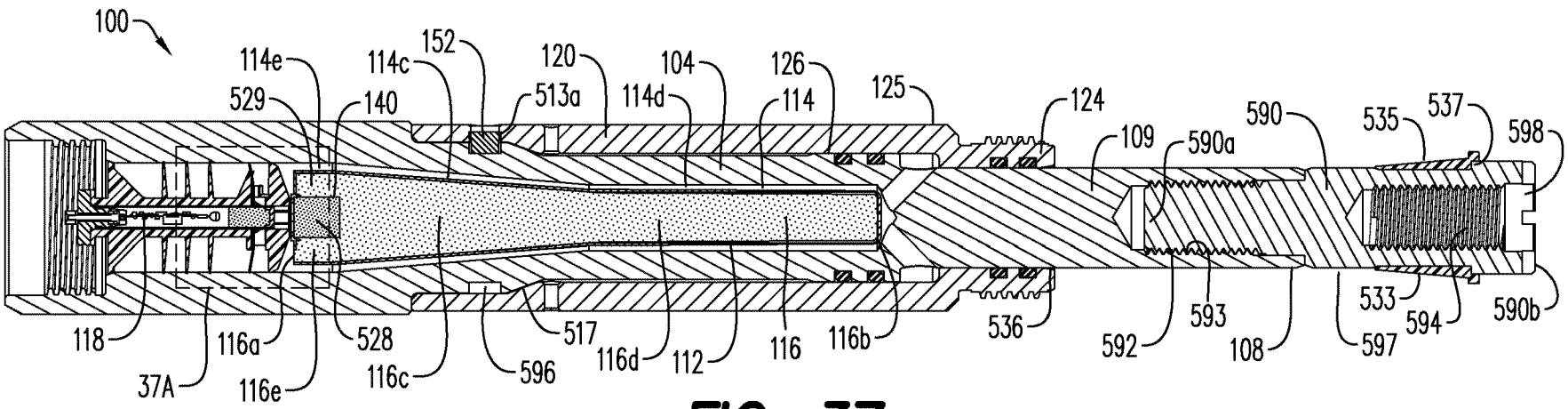
FIG. 37 shows the single use setting tool of FIG. 36 with a tapered power charge and a shock absorbing wedge, according to an exemplary embodiment.
Figure 37A:
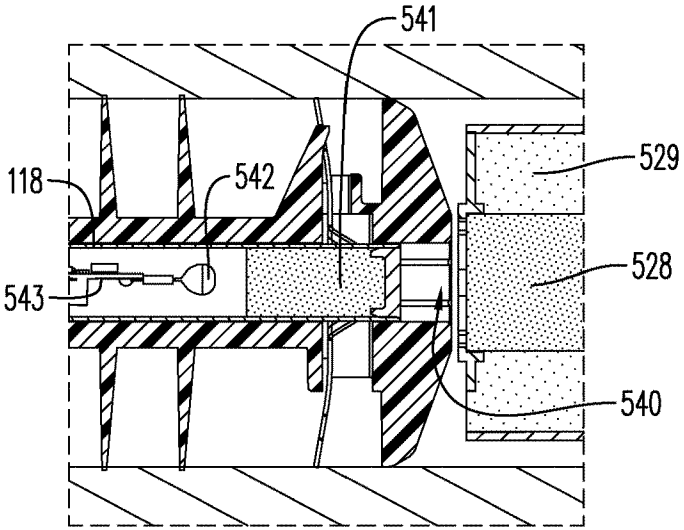
FIG. 37A shows an enlarged portion of FIG. 37 for illustrative purposes.

With reference now to FIGS. 35-37, an exemplary embodiment of a single use setting tool 100 is shown. The single use setting tool 100 is substantially as described with respect to other exemplary embodiments and common features are not necessarily repeated hereinbelow. The setting tool 100 includes an outer sleeve 120 and inner piston 104 that is configured to slide relative to the outer sleeve 120.

With reference to FIGS. 36-37, an annular wall 112 defines an inner piston cavity 114. In an aspect, at least a portion of the inner piston cavity 114 is tapered to receive a tapered power charge 116 (FIG. 37). With reference more specifically to FIG. 37, the single use setting tool 100 of FIGS. 35 and 36 is shown with the tapered power charge 116 positioned in the tapered inner piston cavity 114 of the inner piston 104. The power charge 116 extends longitudinally from a proximal end **116*a* to a distal end 116*b* and has a length therebetween. As used herein, "tapered power charge" means that at least a portion of the power charge 116, along its length, is tapered. For example, the tapered power charge 116 may have, as shown in FIG. 37, a tapered portion 116*c*, a distal non-tapered (constant diameter) portion 116*d* integrally joined and adjacent to the tapered portion 116*c*, and a proximal non-tapered (constant diameter) portion 116*e* integrally joined and adjacent to the tapered portion 116*c*. Thus, the tapered portion 116*c* of the embodiment of the power charge 116 shown in FIG. 37 is between the non-tapered portions 116*d* and 116*e*. The tapered inner piston cavity 114 in the exemplary embodiment shown in FIG. 37 includes a tapered portion 114*c* and non-tapered portions 114*d* and 114*e* corresponding to the tapered portion 116*c* and non-tapered portions 116*d* and 116*e* of the tapered power charge 116**.

In general, the tapered portion **116*c* is defined by at least two different diameters at two respective longitudinally spaced positions along the length of the tapered power charge 116, without limitation regarding the configuration of the tapered portion 116*c*. The power charge 116 may be linearly or non-linearly (e.g., in an arcuate or "fluted" configuration) tapered between the two longitudinally spaced positions. Additionally, while the tapered portion 116*c* shown in FIG. 37 is tapered toward the distal end 116*b* of the power charge 116, in other embodiments, the tapered portion 116*c* may be tapered toward the proximal end 116*a*** of the power charge 116. Moreover, while only one tapered portion 116*c* is shown in FIG. 37, the tapered power charge 116 may include multiple tapered portions 116*c*, which may be tapered in the same or different directions. Such multiple tapered portions 116*c* may adjoin or be longitudinally spaced from one another by a non-tapered portion. Also, the tapered portion 116*c* may extend from either of the proximal end 116*a* or the distal end 116*b* of the power charge 116—i.e., in the absence of a respective non-tapered portion between the tapered portion 116*c* and the proximal end 116*a* or the distal end 116*b*. Also, the tapered portion 116*c* may extend substantially the entire length of the power charge 116 from the proximal end 116*a* to the distal end 116*b*.

Figure 38B:
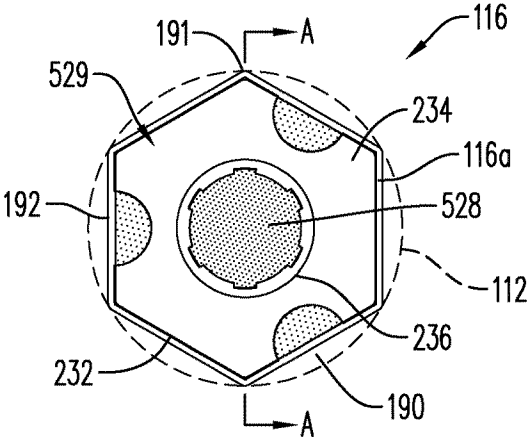
FIG. 38B is an elevation view of a proximal side of the power charge shown in FIG. 38A.
Figure 38A:
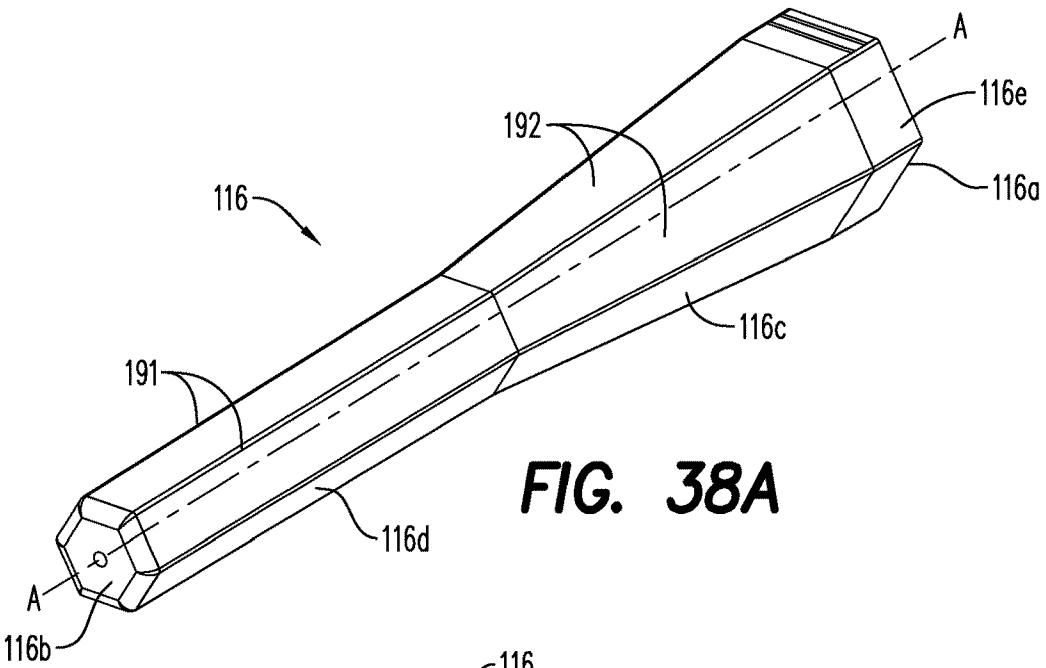
FIG. 38A is a perspective view of a tapered power charge according to an exemplary embodiment.

As shown in FIGS. 38A-38B, the tapered power charge 116 may have, without limitation, a hexagonally-shaped transverse cross-section at various positions along the axial direction of axis A-A (FIG. 38A), like the cross-section of the power charge 116 shown and described with reference to FIGS. 14-16. In the exemplary embodiment shown in FIGS. 38A and 38B, the power charge 116 has a hexagonal cross-section at all positions along the axis A-A of the power charge 116. The hexagonally-shaped transverse cross-section is defined by flat sides 192 extending between vertices 191. As shown in FIG. 38B, similar to the embodiment shown in FIG. 16, the tapered power charge 116, when inserted in the tapered inner piston cavity 114 as shown in FIG. 37, may be sized and shaped such that the vertices 191 of the tapered power charge 116 may abut or contact the annular wall 112 of the cavity 114 to provide a secure fit of the tapered power charge 116 within the tapered inner piston cavity 114. In an aspect, the non-tapered portions 114*d* and 114*e* of the tapered inner piston cavity 114 may be cylindrical and the tapered portion 114*c* may be frustoconical. Also, as shown in FIG. 38B, the flat sides 192 of the hexagonally-shaped tapered power charge 116 are thereby spaced apart from the annular wall 112, creating gas flow channels 190 that extend axially along the length of the tapered inner piston cavity 114. The gas flow channels 190 are configured to facilitate a slow set as described above.

While FIGS. 38A and 38B show a hexagonally-shaped tapered power charge 116, it will be understood that, as previously discussed, the tapered power charge 116 is not limited to having a hexagonally-shaped transverse cross-section. The tapered power charge 116 in various exemplary embodiments may have a cross-section according to any shape or configuration including, without limitation, polygonal, circular, symmetric or asymmetric, and the like, consistent with the disclosure. For example, in certain embodiments the sides may not be flat sides 192 but instead may be concave between vertices 191. In other embodiments, the flat sides 192 may instead be convex between vertices 191 such that the apexes of the convex sides abut or contact the annular wall 112 of the tapered inner piston cavity 114 and flow channels 190 are defined between the apexes of the convex sides.

Further, the exemplary tapered power charge 116 is not limited to the shape, configuration, assembly of components, particular features, etc. as disclosed for use with the exemplary disposable setting tool 100, or otherwise. Variations to the exemplary tapered power charge 116 are possible within the spirit of this disclosure.

In an aspect of the exemplary embodiments of a tapered power charge 116 and corresponding tapered inner piston cavity 114 within the inner piston 104, a width $w_1$ (FIG. 38C) of the tapered portion 116*c* of the tapered power charge 116 is greater than a width $w_2$ of the distal non-tapered portion 116*d*. In comparison to, for example, a comparable power charge and corresponding inner piston cavity having a constant width (or, e.g., diameter in the case of a cylindrical power charge/inner piston cavity) within an inner piston, the exemplary tapered power charge 116 may increase the volume of energetic material within the tapered inner piston cavity 114 without altering the length of the of the inner piston 104. A larger quantity of energetic material inside the inner piston 104 may also allow the setting tool 100 to do more work.

Similarly, the greater width $w_1$ of the tapered power charge 116 in the tapered portion 116*c* may allow the overall length of the tapered power charge 116 to be reduced while maintaining a constant quantity of energetic material. Consequently, a required length of the corresponding tapered inner piston cavity 114 of the inner piston 104 may be similarly reduced.

Also, the tapered inner piston cavity 114 within the inner piston 104 may reduce or eliminate weak points that exist in an inner piston with, e.g., a straight cylindrical (e.g., a right cylinder) inner piston cavity.

Figure 38C:
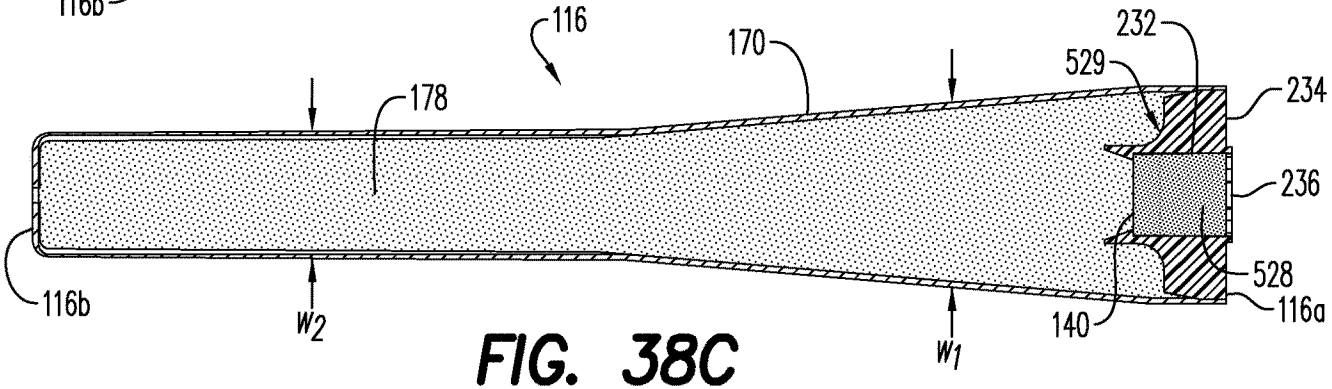
FIG. 38C is a cross sectional view of the power charge of FIG. 38A along section A-A in FIG. 38B.

The exemplary tapered power charge 116 shown in, e.g., FIGS. 37-38C, may have the same or similar construction as the power charge 116 described herein with reference to FIGS. 10-15. For example, in the exemplary embodiment shown in FIGS. 37 and 38C, the proximal end 116*a* includes an indentation 140 in which a booster 528 is positioned so that, when the tapered power charge 116 is positioned in the tapered inner piston cavity 114, the booster 528 is positioned within sufficient proximity to the initiator 118 such that initiation of the initiator 118 will initiate the booster 528 to release additional energy. In an aspect, as shown in the inset of FIG. 37, the initiator 118 may include an ignition material 541 at an end of the initiator 118 nearest the tapered power charge 116. The initiator 118 including the ignition material 541 is not in physical contact with the booster 528, but is separated (e.g., longitudinally) by an air gap 540 (also shown in FIG. 7A). The air gap 540 may allow a flame length of a flame generated by initiation of the ignition material 541 to increase between the initiator 118 and the booster 528. Increasing the flame length may enhance the reliability of initiating the booster 528 with the flame. In an aspect, the exemplary embodiments of a single use setting tool 100 discussed throughout this disclosure generally include an air gap 540 between the initiator 118 and the power charge 116 and/or a booster 528 of the power charge 116.

In an aspect, the ignition material 541 is initiated by an electrically actuated fuse 542 connected to a circuit board 543 within the initiator 118. In an aspect, the booster 528 is a booster pellet made from energetic material. In the exemplary embodiments of FIGS. 37 and 38B-38D, the booster 528 is positioned and held in place by a booster holder 529. The booster holder 529 is positioned between the initiator 118 and the tapered power charge 116 and is configured for receiving and positioning the booster 528 within the indentation 140 of the tapered power charge 116.

Figure 38D:
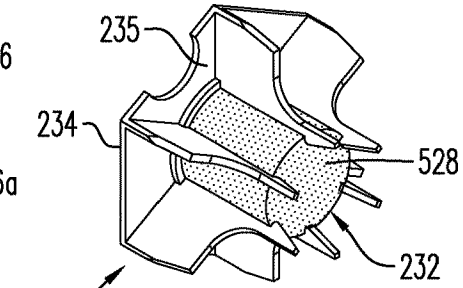
FIG. 38D is a perspective view of a booster holder according to an exemplary embodiment.

With reference to FIGS. 38B and 38D, exemplary embodiments of the booster holder 529 may include a booster receiver 232, a booster holder top 234 and an opening 236 in the booster holder top 234. The booster receiver 232 may extend from an underside 235 of the booster holder top 234. The booster receiver 232 is sized to receive and retain a booster 528 of the type previously discussed.

In an aspect, the tapered power charge 116 may be disposed in a container 170 (FIG. 38C) that protects and holds together the tapered power charge 116. The container 170 may have an inner shape conforming to the outer shape of the tapered power charge 116. Also, as shown in FIG. 38C, the container 170 may have an outer shape (i.e., tapered) corresponding to the outer shape of the tapered power charge 116. Also, with reference to FIG. 38C, in an exemplary embodiment, the tapered power charge 116 may be positioned within the container 170 and the booster holder 529 may be inserted into the power charge 116, e.g., within a body 178 of the power charge 116. In an aspect of the exemplary embodiment as shown in FIG. 38C, the booster holder 529 may be completely surrounded, but for the booster holder top 234, by the energetic material of the power charge body 178. The booster holder 529 may be retained in place by engaging the power charge body 178 and/or the power charge container 170. In an exemplary embodiment and as shown in FIG. 38C the booster holder top 234 may function as the top of the power charge container 170.

The exemplary embodiments shown in FIGS. 35-37 also include, in an aspect, the inner piston 104 including the distal rod 109 according to the exemplary embodiments, and a piston extension 590 that is connected to the distal rod 109 of the inner piston 104. The piston extension 590 and the distal rod 109 thread together forming, in an aspect, a two-piece piston shaft 591, external to the outer sleeve 120 before actuation, of the inner piston 104. Producing the inner piston 104 from smaller, assembled components may simplify and/or reduce the expense of manufacturing the inner piston 104 in comparison to machining a single monolithic piece of material, and may facilitate easier assembly and disassembly of the setting tool 100 on a tool string including the plug-setting sleeve 602. However, the configuration and production of the inner piston 104 is not limited to the exemplary embodiments or the two-piece piston shaft 591 in particular. The inner piston 104 may be formed from a monolithic piece of material or otherwise be a fully integrated assembly, with any configuration consistent with this disclosure.

In the exemplary embodiments shown in FIGS. 36 and 37, the distal rod 109 includes internal threads 593 formed within a cavity 595 extending inwardly from the distal end 108 of the inner piston 104. The cavity 595 is configured for receiving a complementarily dimensioned proximal end 590*a* of the piston extension 590. External threads 592 are formed on the proximal end 590*a* of the piston extension 590 and configured for threadingly connecting to the internal threads 593 within the cavity 595 of the distal rod 109. In an aspect, at least a portion 597 of the piston extension 590 has a diameter that is substantially the same as an outer diameter of the distal rod 109 or otherwise dimensioned to permit the portion 597 of the piston extension 590 to slide past the outer sleeve distal end 124, as shown for example with momentary reference to FIGS. 39C and 39D.

The piston extension 590 has a distal end 590*b* opposite the proximal end 590*a* and a distal cavity 598 extending inwardly from the distal end 590*b*. Internal threads 594 are formed within the distal cavity 598. The distal cavity 598 and the internal threads 594 of the piston extension 590 are configured to receive and connect to a setting sleeve mandrel 610 (FIG. 18). Because the internal threads 594 at the distal end 590*b* of the piston extension 590 are internal, a set screw 660 (FIG. 18) is not used for connecting to the setting sleeve mandrel 610.

In another aspect, the exemplary setting tool 100, as shown in FIG. 37, may include a wedge 533, like that shown and described with respect to, e.g., FIGS. 22-31, attached to the piston extension 590. Also, the piston extension 590 may have a tapered portion 535 of reduced diameter on which the wedge 533 is positioned, and a wedge barrier 537 adjacent the tapered portion 535 of the piston extension 590, like those features shown and described with respect to, e.g., FIGS. 23, 26, 29, and 31.

The exemplary embodiments shown in FIGS. 36-37 also include, in an aspect, a circumferential groove 596 formed in and extending circumferentially on an outer surface 517 of the inner piston 104. The outer sleeve 120 includes a shear element aperture 513*a* extending from an outer surface 125 of the outer sleeve 120 to the central bore 126 and aligned with the circumferential groove 596 of the inner piston 104 before actuation. A shear element 152 is received in the shear element aperture 513*a* and is configured to be received in the circumferential groove 596, to prevent axial movement of the inner piston 104. By forming the circumferential groove 596 circumferentially, the shear element 152 may be received in the circumferential groove 596 regardless of the relative rotational position between the outer sleeve 120 and the inner sleeve 104, which may facilitate and simplify assembly of the setting tool 100.

Figure 39A:
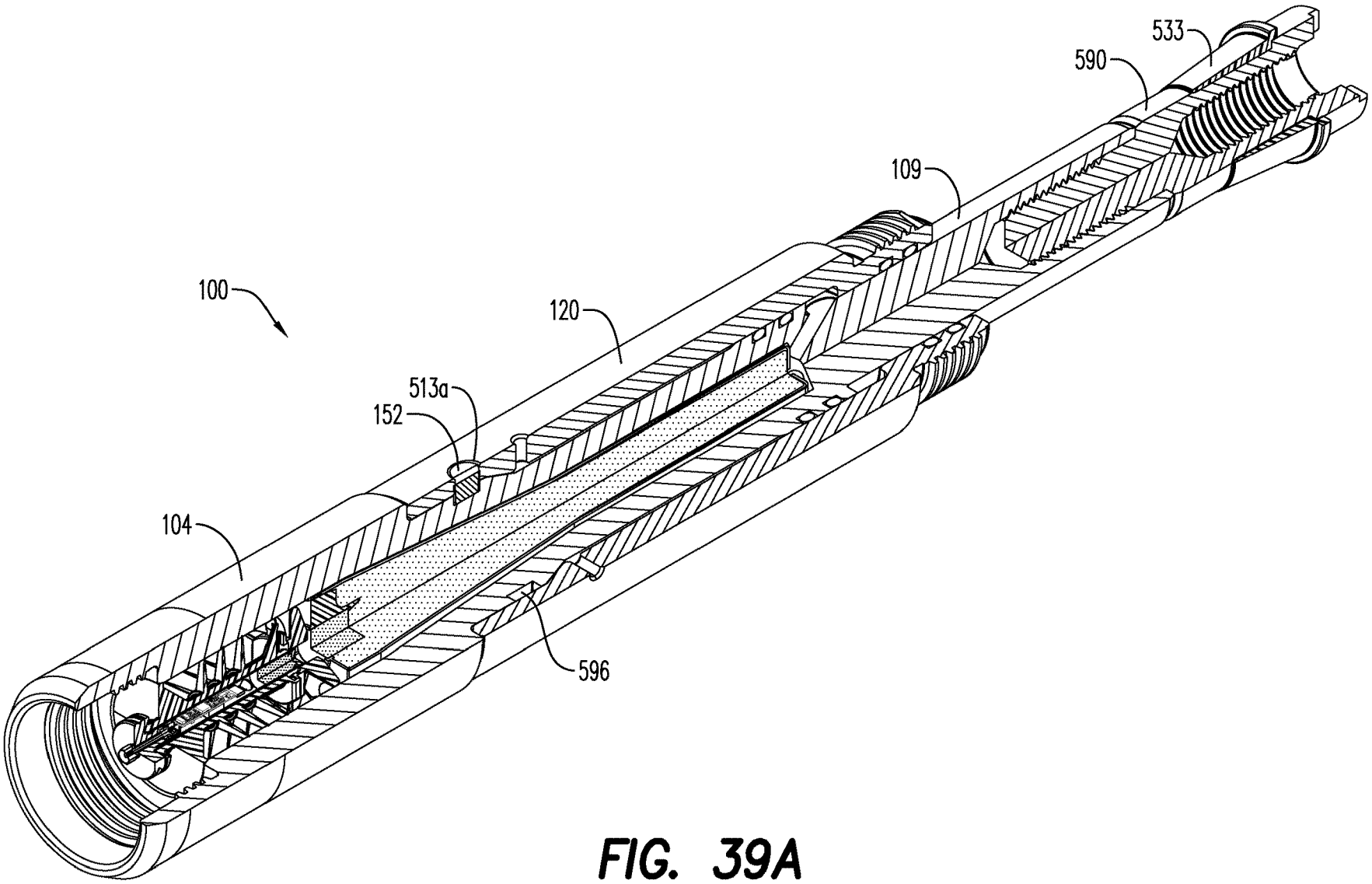
FIG. 39A is a quarter-sectional view of the single use setting tool of FIG. 37 with a piston in an unactuated position, according to an exemplary embodiment.
Figure 39B:
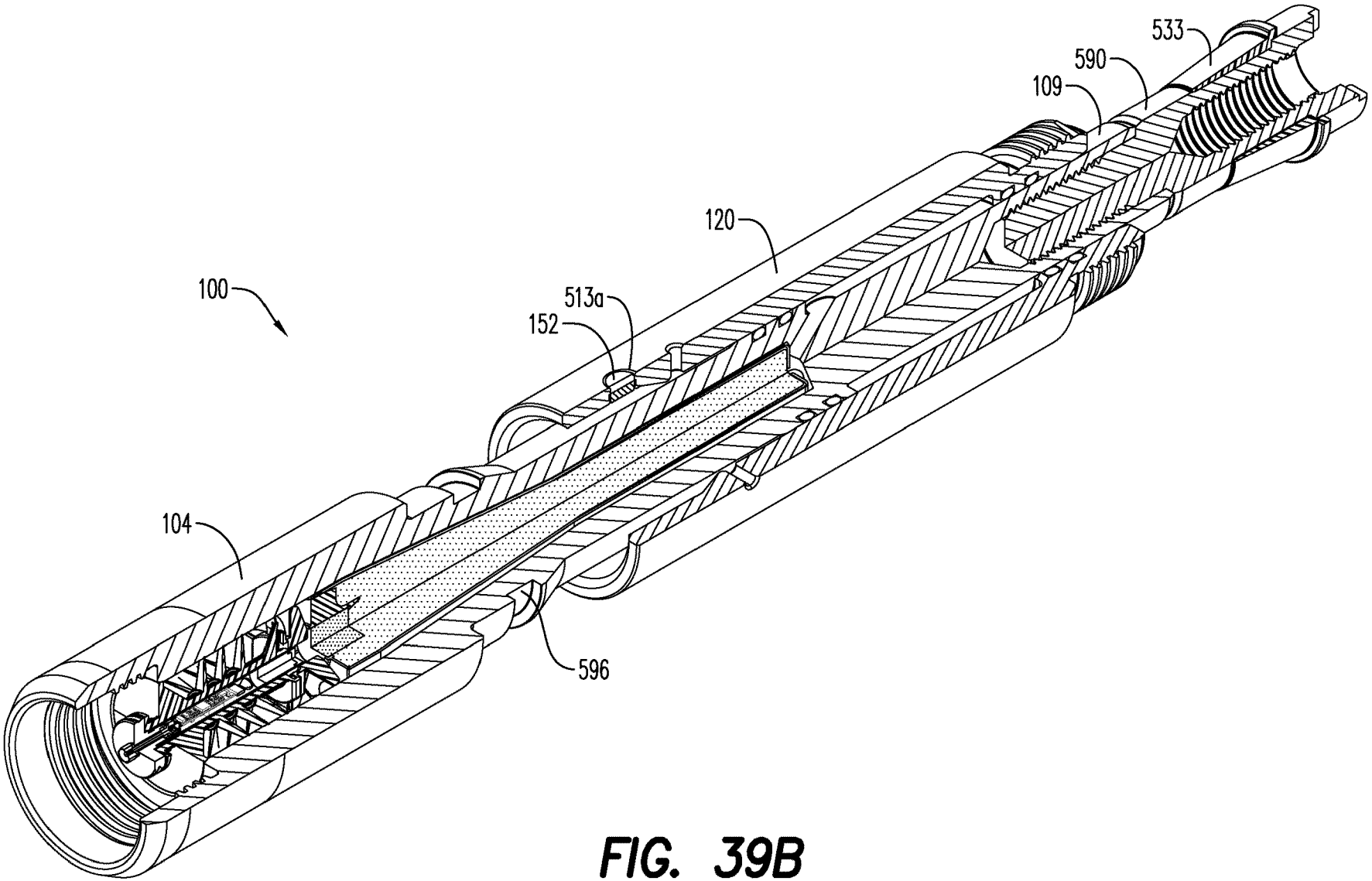
FIG. 39B is a quarter-sectional view of the single use setting tool of FIG. 37 with the piston in a mid-stroke position, according to an exemplary embodiment.

FIGS. 39A-39D show a stroke sequence of the exemplary embodiments shown in FIGS. 35-37. The operation of the exemplary embodiments as shown in FIGS. 39A-39D may be the same or similar to other exemplary embodiments of a setting tool 100 described throughout this disclosure and consistent therewith. FIG. 39A is a quarter section view through the setting tool 100 shown in FIG. 37 before actuation of the setting tool 100. As shown in FIG. 39A, shear element 152 is inserted into circumferential groove 596. FIG. 39B is a three-quarter section view through the setting tool 100 shown in FIG. 37 after actuation, with the inner piston 104 at an intermediate position of the stroke. As shown in FIG. 39B, the shear element 152 has sheared and is not in the circumferential groove 596.

Figure 39C:
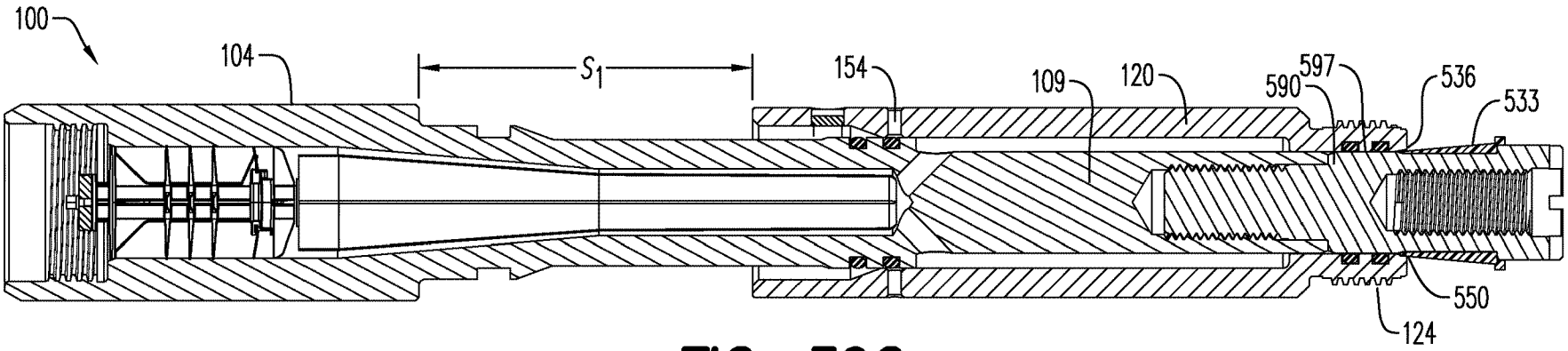
FIG. 39C is a cross-sectional view of the single use setting tool of FIG. 37 with the piston in a position where pressure begins to vent.

FIG. 39C shows the inner piston 104 at a position further along the stroke than the position shown in FIG. 39B and at which the first end 550 of the wedge 533 contacts the cutout 536 at the distal end 124 of the outer sleeve 120. In an exemplary embodiment, the position of the inner piston 104 as shown in FIG. 39C may be, without limitation, a stroke distance $S_1$ of 5.1 inches. At the stroke position shown in FIG. 39C, the pressure inside the setting tool 100 may start to bleed off or vent through the pressure vent 154.

Figure 39D:
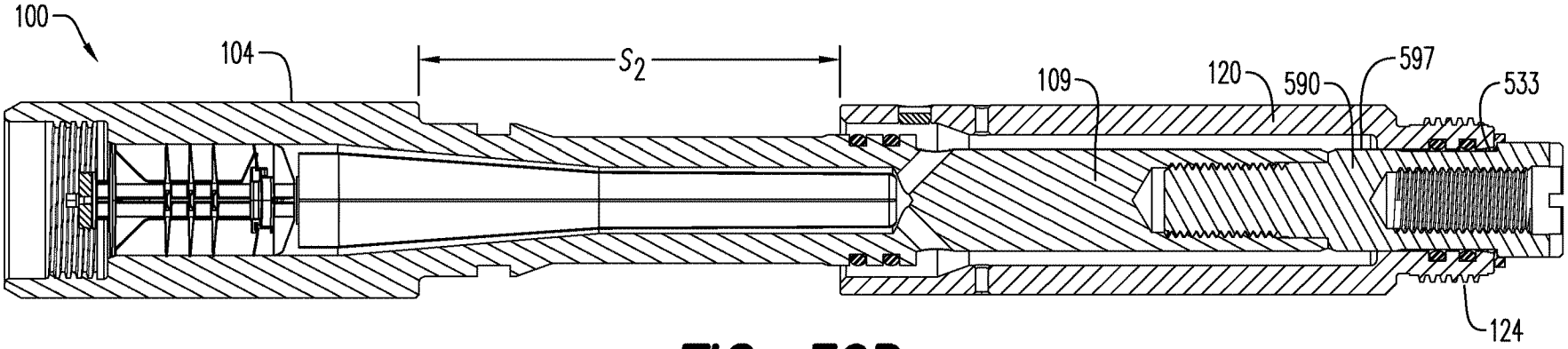
FIG. 39D is a cross-sectional view of the single use setting tool of FIG. 37 with the piston in a fully retracted position.

FIG. 39D shows the inner piston 104 fully retracted after actuation, after completing the stroke. In an aspect, the stroke may be completed when the entire wedge 533 has traveled (axially) into and/or past the cutout 536 and the wedge barrier 537 abuts the cutout 536, or when the wedge 533 has otherwise been sufficiently compressed in the cutout 536 to frictionally prevent further stroke. In an exemplary embodiment, the stroke distance $S_2$ of the inner piston 104 at the position shown in FIG. 39D may be, without limitation, 6.5 inches. While the wedge 533 shown in the exemplary embodiment of FIG. 39D is fully past and/or within the cutout 536, the amount of deformation of the wedge 533 and axial distance traveled by the wedge 533 past the cutout 536 depends on how much force is required to actuate a particular plug 603 connected to the plug-setting sleeve 602/setting tool 100 and the resultant recoil of the inner piston 104 after the plug 603 is set and detached therefrom. The amount of force may vary depending on particular designs of particular manufacturers.

The exemplary embodiments of a setting tool 100 as shown and discussed with respect to, e.g., FIGS. 35-37 and 39A-39D, may exert a minimum setting force of approximately 45,000 psi during the inner piston stroke and setting sequence. A setting tool 100 according to the exemplary embodiments discussed throughout this disclosure may may have a temperature rating of 190° C. (375° F.). Moreover, the inner piston 104 in the exemplary embodiments may connect to a tandem seal adapter 512 that connects the setting tool 100 in a tool string 600 and pressure isolates the setting tool 100 from an adjacent wellbore tool in the tool string 600. Thus, in an aspect, the exemplary embodiments do not require a firing head, or associated adapters or connecting portions for a firing head, for initiating the power charge/tapered power charge 116.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one," "one or more" and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment," "some embodiments," "an embodiment," and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic, or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine," "calculate," and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A single use setting tool for actuating a tool in a wellbore, the single use setting tool comprising:

an inner piston having a piston proximal end, a piston distal end opposite the piston proximal end, and a piston annular wall, wherein the piston annular wall defines a piston cavity;

an initiator holder, wherein at least a portion of the initiator holder is positioned within the piston cavity and the initiator holder is configured for receiving and retaining an initiator within the piston proximal end;

a gas-generating power charge positioned within the piston cavity, the power charge extending along a longitudinal axis from a proximal end of the power charge to a distal end of the power charge, the power charge having a first width at a first axial position and having a second width at a second axial position, wherein the first width is different than the second width, and the piston cavity is dimensioned complementarily to the power charge, for receiving the power charge including the first width and the second width within the piston cavity.

2. The single use setting tool of claim 1, wherein the power charge includes a tapered portion.

3. The single use setting tool of claim 2, wherein the tapered portion tapers towards the distal end of the power charge.

4. The single use setting tool of claim 1, wherein the power charge contacts the piston annular wall at circumferentially spaced positions along an external surface of the power charge.

5. The single use setting tool of claim 1, wherein the power charge has a hexagonal cross-section transverse to the longitudinal axis.

6. The single use setting tool of claim 1, further comprising an outer sleeve having a sleeve proximal end, a sleeve distal end, and a sleeve central bore extending from the sleeve proximal end to the sleeve distal end, wherein a portion of the inner piston including the piston cavity is positioned within the sleeve central bore and the inner piston and the outer sleeve are configured for axially sliding relative to one another, wherein the outer sleeve includes a shear element aperture extending from the outer surface of the outer sleeve to the sleeve central bore, the inner piston includes a shear element groove formed in and extending circumferentially on an outer surface of the inner piston, and the shear element aperture is configured to align with the shear element groove, and the shear element aperture and the shear element groove are together configured for receiving a shear element extending between and positioned within each of the shear element aperture and the shear element groove.

7. The single use setting tool of claim 6, further comprising a piston extension connected to the piston distal end, wherein at least a portion of the piston extension is dimensioned to extend within the sleeve central bore when the inner piston slides relative to the outer sleeve at least a certain distance.

8. The single use setting tool of claim 7, further comprising a shock absorbing wedge positioned on the piston extension, wherein the sleeve distal end includes a cutout dimensioned for receiving a portion of the shock absorbing wedge.

9. The single use setting tool of claim 8, wherein the shock absorbing wedge has a tapered profile and the cutout in the sleeve distal end is frustoconically shaped.

10. The single use setting tool of claim 1, wherein the power charge is contained within a power charge container.

11. The single use setting tool of claim 1, further comprising a booster, wherein the power charge defines an indentation for retaining the booster at the proximal end of the power charge, adjacent to the initiator holder.

12. The single use setting tool of claim 11, wherein the initiator holder is configured for positioning the initiator such that an ignition material of the initiator is spaced from the booster by an air gap.

13. A single use setting tool for actuating a tool in a wellbore, the single use setting tool comprising:

an inner piston having a piston proximal end, a piston distal end opposite the piston proximal end, and a piston inner wall, wherein the piston proximal end includes a seal adapter portion and the piston inner wall defines a piston cavity;

an outer sleeve having a sleeve proximal end, a sleeve distal end, and a sleeve central bore extending from the sleeve proximal end to the sleeve distal end, wherein a portion of the inner piston including the piston cavity is positioned within the sleeve central bore, a portion of the inner piston extends beyond the sleeve distal end, and the inner piston and the outer sleeve are configured for axially sliding relative to one another, wherein the outer sleeve includes a shear element aperture extending from an outer surface of the outer sleeve to the sleeve central bore and the inner piston includes a shear element groove circumferentially extending in an outer surface of the inner piston, wherein the shear element aperture and the shear element groove are together configured for receiving a shear element extending between and positioned within each of the shear element aperture and the shear element groove, when the inner piston is at a first position relative to the outer sleeve.

14. The single use setting tool of claim 13, wherein the shear element aperture is configured to align with the shear element groove at any relative rotational position between the inner piston and the outer sleeve, when the inner piston is at the first position.

15. The single uses setting tool of claim 14, wherein the inner piston is configured for axially sliding from the first position to a second position relative to the outer sleeve, and the shear element is configured to shear in response to the inner piston axially sliding from the first position to the second position.

16. A single use setting tool for actuating a tool in a wellbore, the single use setting tool comprising:

an inner piston having a piston proximal end, a piston distal end opposite the piston proximal end, and a piston inner wall, wherein the piston proximal end includes a seal adapter portion and the piston inner wall defines a piston cavity;

an outer sleeve having a sleeve proximal end, a sleeve distal end, and a sleeve central bore extending from the sleeve proximal end to the sleeve distal end, wherein a portion of the inner piston including the piston cavity is positioned within the sleeve central bore, a portion of the inner piston extends beyond the sleeve distal end, and the inner piston and the outer sleeve are configured for axially sliding relative to one another; and a piston extension connected to the piston distal end, wherein at least a portion of the piston extension is dimensioned to extend within the sleeve central bore when the inner piston slides relative to the outer sleeve at least a certain distance.

17. The single use setting tool of claim 16, wherein the piston extension has a proximal end having external threads and the piston distal end includes internal threads configured for coupling to the external threads of the piston extension.

18. The single use setting tool of claim 16, further comprising a shock absorbing wedge positioned on the piston extension, wherein the sleeve distal end includes a cutout dimensioned for receiving a portion of the shock absorbing wedge.

19. The single use setting tool of claim 18, wherein the wedge has a tapered profile and the cutout in the sleeve distal end is frustoconically shaped.

20. The single use setting tool of claim 16, further comprising a gas-generating power charge positioned within the piston cavity, wherein the power charge extends along a longitudinal axis from a proximal end to a distal end, wherein the power charge has a tapered portion having an outer surface that tapers along the longitudinal axis.

* * * * *